US008200129B2

(12) United States Patent
Nishiwaki et al.

(10) Patent No.: US 8,200,129 B2
(45) **Date of Patent: *Jun. 12, 2012**

(54) IMAGE FORMING APPARATUS WITH A DEVELOPER FEED DEVICE HAVING A DEVELOPER TRANSPORT BODY FOR TRANSPORTING DEVELOPER

(75) Inventors: Kenjiro Nishiwaki, Nagoya (JP); Seiichi Senda, Nagoya (JP); Tomoaki Hattori, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/814,581

(22) Filed: Jun. 14, 2010

(65) Prior Publication Data

US 2010/0247166 A1 Sep. 30, 2010

Related U.S. Application Data

(63) Continuation of application No. 12/365,642, filed on Feb. 4, 2009, now Pat. No. 7,747,203, which is a continuation of application No. PCT/JP2007/065570, filed on Aug. 2, 2007.

(30) Foreign Application Priority Data

Aug. 4, 2006 (JP) ..... 2006-212846
Aug. 24, 2006 (JP) ..... 2006-227839
Aug. 24, 2006 (JP) ..... 2006-227856

(51) Int. Cl.
*G03G 15/08* (2006.01)

(52) U.S. Cl. ..... 399/265; 399/266; 399/289; 399/291; 399/103; 399/105

(58) Field of Classification Search ..... 399/265, 399/266, 289, 290, 291
See application file for complete search history.

(56) References Cited

U.S. PATENT DOCUMENTS 4,598,991 A 7/1986 Hosoya et al.
5,323,214 A 6/1994 Kai
6,934,496 B2 8/2005 Sakuma et al.
2004/0037593 A1 2/2004 Sakuma et al.
2006/0088337 A1 * 4/2006 Nakazato et al. ..... 399/265
(Continued)

FOREIGN PATENT DOCUMENTS

JP 63-013074 1/1988
(Continued)

OTHER PUBLICATIONS

International Search Report for PCT/JP2007/065570 dtd Sep. 12, 2007.

*Primary Examiner* — David Gray
*Assistant Examiner* — Laura K Roth
(74) *Attorney, Agent, or Firm* — Banner & Witcoff, Ltd.

(57) ABSTRACT

Each transport electrode has its longitudinal direction intersecting with a sub-scanning direction. Transport electrodes are disposed in parallel with each other and are arrayed along the sub-scanning direction. A transport-electrode electricity supply wiring section is connected to root portions of the transport electrodes. The root portions are one end portions of the transport electrodes with respect to the longitudinal direction. Toner transport guide members are disposed to cover the transport-electrode electricity supply wiring section and opposite end portions of the transport electrodes; i.e., the root portions and distal end portions.

18 Claims, 30 Drawing Sheets

U.S. PATENT DOCUMENTS

2006/0133851 A1* 6/2006 Ishii et al.

FOREIGN PATENT DOCUMENTS

| | | |
|---|---|---|
| JP | 63-013078 | 1/1988 |
| JP | 05-031146 | 5/1993 |
| JP | 2002-099143 | 4/2002 |
| JP | 2002-351218 | 12/2002 |
| JP | 2003-015417 | 1/2003 |
| JP | 2004-157259 | 6/2004 |
| JP | 2005-275127 | 10/2005 |
| JP | 2002-091160 | 3/2007 |

* cited by examiner

IMAGE FORMING APPARATUS WITH A DEVELOPER FEED DEVICE HAVING A DEVELOPER TRANSPORT BODY FOR TRANSPORTING DEVELOPER

CROSS REFERENCE TO RELATED APPLICATIONS

This application is a continuation of prior U.S. application Ser. No. 12/365,642, filed Feb. 4, 2009, which is a continuation application of prior international application no. PCT/JP2007/065570, filed Aug. 2, 2007, which claims priority to Japanese patent application nos. 2006-212846, filed Aug. 4, 2006; 2006-227839, filed Aug. 24, 2006; and 2006-227856, filed Aug. 24, 2006; the entire subject matter and contents of which are incorporated herein by reference.

TECHNICAL FIELD

The present invention relates to an image forming apparatus.

BACKGROUND ART

Many mechanisms for transporting toner (developer) by means of traveling-wave electric fields (as disclosed in, for example, Japanese Patent Application Laid-Open (kokai) Nos. 2002-99143, 2002-351218, and 2003-15417) are conventionally known for use in image forming apparatus.

In such a mechanism, a large number of strip-shaped electrodes are juxtaposed in a row on an electrically insulative substrate. A wiring pattern is provided externally of an array of the strip-shaped electrodes at an end portion of the substrate with respect to the width direction of the substrate, the width direction being orthogonal to the direction along which the strip-shaped electrodes are arrayed.

In such a mechanism, polyphase AC voltages are sequentially applied to the plurality of strip-shaped electrodes via the wiring pattern, whereby traveling-wave electric fields are generated. By the action of the traveling-wave electric fields, charged toner particles are transported in a predetermined direction.

DISCLOSURE OF THE INVENTION

In the above-mentioned developer electric field transport device, the surface of the substrate on which the developer is transported may have an area where the developer is not transported smoothly. In such an area, the developer may stagnate for a long period of time. The stagnation of the developer in the area is apt to cause fixation of the developer and scattering of the developer to the exterior of the developer electric field transport device.

For example, in the mechanism (the developer electric field transport device) capable of transporting charged developer by means of traveling-wave electric fields as mentioned above, traveling-wave electric fields capable of transporting the developer well in the predetermined direction are not generated in an area external to the strip-shaped electrodes at an end portion of the substrate with respect to the width direction (an area external to the strip-shaped electrodes with respect to the width direction and an area corresponding to the wiring pattern). Thus, when the developer enters the area, the developer may stagnate in the area for a long period of time. The stagnation of the developer is apt to cause fixation of the developer and scattering of the developer to the exterior of the developer electric field transport device.

Particularly, the stagnation of the developer may occur in the vicinity of a developing position (where the developer is arranged in an image-wise fashion, thereby forming a developer image). In this case, leakage of the developer to the exterior of the developer electric field transport device, defective formation of an image, or a like problem is apt to arise.

The present invention has been conceived for solving the above problems. An object of the invention is to provide a developer electric field transport device capable of smoothly transporting developer by means of traveling waves, a developer feed device equipped with the developer electric field transport device, and an image forming apparatus equipped with the developer electric field transport device.

[1]

(1-1) An image forming apparatus of the present invention comprises an electrostatic-latent-image carrying body and a developer feed device.

The electrostatic-latent-image carrying body has a latent-image forming surface. The latent-image forming surface is configured to be able to form an electrostatic latent image thereon by means of electric-potential distribution. The latent-image forming surface is formed in parallel with a predetermined main scanning direction. The electrostatic-latent-image carrying body is configured such that the latent-image forming surface can move along a sub-scanning direction orthogonal to the main scanning direction.

The developer feed device is disposed in such a manner as to face the electrostatic-latent-image carrying body. The developer feed device is configured to be able to feed the latent-image forming surface with a developer in a charged state. Specifically, the developer feed device comprises a plurality of transport electrodes, an electricity supply wiring section, a developer transport body, and a pair of developer transport guide members.

The plurality of transport electrodes are arrayed in a predetermined developer transport direction along the sub-scanning direction. The transport electrodes are configured to have their longitudinal direction intersecting with the sub-scanning direction. Specifically, for example, the transport electrodes can be configured to have their longitudinal direction parallel to the main scanning direction orthogonal to the sub-scanning direction. The developer transport direction can be set in parallel with the sub-scanning direction.

The electricity supply wiring section is connected to root portions of the transport electrodes. The root portions are one end portions of the transport electrodes with respect to the longitudinal direction. That is, the transport electrodes and the electricity supply wiring section form a predetermined wiring pattern. End portions of the transport electrodes opposite the root portions (other end portions opposite the one end portions with respect to the longitudinal direction); i.e., distal end portions of the transport electrodes, serve as ends of the wiring pattern.

The developer transport body has a developer transport surface parallel to the main scanning direction. The transport electrodes and the electricity supply wiring section are provided on the developer transport body along the developer transport surface. That is, the predetermined wiring pattern composed of the transport electrodes and the electricity supply wiring section is provided on the developer transport body along the developer transport surface.

The developer transport body is disposed such that the developer transport surface faces the electrostatic-latent-image carrying body. The developer transport body is configured to be able to transport the developer along the developer transport direction by means of traveling-wave electric fields which are generated on the developer transport surface through application of predetermined transport voltages to the plurality of transport electrodes.

The pair of developer transport guide members is provided on the developer transport surface at opposite end portions, with respect to a width direction perpendicular to the developer transport direction, of the developer transport body. The developer transport guide members are configured to define an areal range within which the developer is transported on the developer transport surface along the developer transport direction.

In the present invention, each of the paired developer transport guide members is provided in such a manner as to cover the electricity supply wiring section and the root portions and the distal end portions of the transport electrodes. In other words, the pair of developer transport guide members covers the electricity supply wiring section and opposite end portions, with respect to the longitudinal direction, of the transport electrodes.

That is, the present invention is characterized in that the pair of developer transport guide members in the developer feed device provided in the image forming apparatus has the above-mentioned configuration.

The image forming apparatus of the present invention having the above configuration operates as described below in formation of an image.

The latent-image forming surface on which the electrostatic latent image is formed moves along the sub-scanning direction. The developer feed device feeds the developer in a charged state to the latent-image forming surface on which the electrostatic latent image is formed. The developer is transported on the developer transport surface along a predetermined developer transport direction (along the sub-scanning direction along which the plurality of transport electrodes is arrayed). By this procedure, the electrostatic latent image is developed (rendered visible) with the developer.

The above-mentioned transport of the developer on the developer transport surface is effected through formation of predetermined traveling-wave electric fields in the vicinity of the plurality of transport electrodes. The electric fields are formed through application of predetermined voltages to the plurality of transport electrodes via the electricity supply wiring section.

Traveling-wave electric fields along the developer transport direction are formed in a good condition on portions (intermediate portions) of the transport electrodes between the distal end portions and the root portions. By contrast, good traveling-wave electric fields are hard to form (or are not formed) on the distal end portions and the root portions of the transport electrodes and on the electricity supply wiring section.

Thus, in the image forming apparatus of the present invention, the above-mentioned regions where good traveling-wave electric fields are hard to form are covered with the developer transport guide members adapted to define an areal range within on the developer transport surface which the developer is transported.

Thus, the image forming apparatus of the present invention can implement smooth transport of the charged developer on the developer transport surface by means of a simple apparatus configuration. Therefore, the stagnation of the developer on the developer transport surface can be restrained to the greatest possible extent by means of a simple apparatus configuration. In the image forming apparatus, the developer transport guide members may be provided such that a range over which the root portions and the distal end portions of the transport electrodes are covered with each of the developer transport guide members is equal to or greater than the width (electrode width) of each of the transport electrodes as measured orthogonally to the longitudinal direction.

According to the image forming apparatus having the above configuration, the above-mentioned regions where good traveling-wave electric fields are hard to form are more reliably covered with the developer transport guide members. The image forming apparatus may further comprise a plurality of counter electrodes, and the developer transport guide members may intervene between the developer transport surface and the counter electrodes.

The plurality of counter electrodes is arrayed along the developer transport direction. The counter electrodes are configured to have their longitudinal direction intersecting with the sub-scanning direction. For example, the counter electrodes can be configured to have their longitudinal direction parallel to the main scanning direction orthogonal to the sub-scanning direction. Alternatively, the counter electrodes can be formed in parallel with the transport electrodes. The counter electrodes are disposed in such a manner as to face the developer transport surface with a predetermined gap therebetween.

In the image forming apparatus having the above configuration, through application of predetermined voltages, predetermined traveling-wave electric fields are generated on the plurality of counter electrodes and on the plurality of transport electrodes. Thus, the charged developer can be transported smoothly on the developer transport surface. In the image forming apparatus, the developer transport guide members may be configured to be able to restrain deposition of the developer on their top surfaces opposite their surfaces which face the developer transport surface.

According to the image forming apparatus having the above configuration, the stagnation of the developer on the top surfaces of the developer transport guide members can be restrained to the greatest possible extent. The image forming apparatus may further comprise a developer containing casing and a pair of seal members, and the seal members may serve as the developer transport guide members.

The developer containing casing is a box-like member configured to be able to cover the developer transport body and to contain the developer therein. The developer containing casing has an opening portion formed at a position where the electrostatic-latent-image carrying body and the developer transport surface face each other.

The pair of seal members is provided at opposite end portions of the developer containing casing with respect to the width direction. The seal members are configured to be able to restrain leakage of the developer to the exterior of the developer containing casing.

In the image forming apparatus having the above configuration, the above-mentioned regions where good traveling-wave electric fields are hard to form can be more reliably covered with the seal members adapted to restrain leakage of the developer from the developer containing casing. Thus, the stagnation of the charged developer on the developer transport body can be restrained by means of a simple apparatus configuration. In the image forming apparatus, the developer transport guide members may be formed of an elastic material. For example, the developer transport guide members can be formed of foamed sponge or rubber.

The developer transport guide members which are formed of such an elastic material and serve as the seal members can intervene in a compressed condition between the developer containing casing and the opposite end portions of the developer transport body.

According to the image forming apparatus having the above configuration, leakage of the developer to the exterior of the developer containing casing can be more reliably restrained, and the regions of the developer transport surface where good traveling-wave electric fields are hard to form can be more reliably covered.

(1-2) A developer feed device of the present invention is configured to be able to feed a developer in a charged state to a developer-carrying surface of a developer-carrying body. The developer-carrying surface is a surface which is parallel to a predetermined main scanning direction and which can carry the developer thereon.

The developer-carrying body has the developer-carrying surface and is configured to be able to move along a sub-scanning direction orthogonal to the main scanning direction. The developer-carrying body can be, for example, an electrostatic-latent-image carrying body having a latent-image forming surface configured to be able to form an electrostatic latent image thereon by means of electric-potential distribution. Alternatively, the developer-carrying body can be, for example, a recording medium (paper) which is transported along the sub-scanning direction. Alternatively, the developer-carrying body can be, for example, a roller, a sleeve, or a belt member (an intermediate transfer belt, a developing roller, a developing sleeve, etc.) which is configured and disposed so as to be able to transfer the developer onto the recording medium or the electrostatic-latent-image carrying body by means of facing the recording medium or the electrostatic-latent-image carrying body.

The developer feed device of the present invention comprises a plurality of transport electrodes, an electricity supply wiring section, a developer transport body, and a pair of developer transport guide members.

The plurality of transport electrodes are arrayed in a predetermined developer transport direction along the sub-scanning direction. The transport electrodes are configured to have their longitudinal direction intersecting with the sub-scanning direction.

The electricity supply wiring section is connected to root portions of the transport electrodes. The root portions are one end portions of the transport electrodes with respect to the longitudinal direction.

The developer transport body has a developer transport surface parallel to the main scanning direction. The transport electrodes and the electricity supply wiring section are provided on the developer transport body along the developer transport surface. The developer transport body is disposed such that the developer transport surface faces the developer-carrying body. The developer transport body is configured to be able to transport the developer along the developer transport direction by means of traveling-wave electric fields which are generated on the developer transport surface through application of predetermined transport voltages to the plurality of transport electrodes.

The pair of developer transport guide members is provided on the developer transport surface at opposite end portions, with respect to a width direction perpendicular to the developer transport direction, of the developer transport body. The developer transport guide members are configured to define an areal range within which the developer is transported on the developer transport surface along the developer transport direction.

In the developer feed device of the present invention, each of the paired developer transport guide members is provided in such a manner as to cover the electricity supply wiring section and the root portions and distal end portions of the transport electrodes, the distal end portions being opposite the root portions.

That is, the present invention is characterized in that the pair of developer transport guide members in the developer feed device has the above-mentioned configuration.

In the developer feed device of the present invention having the above configuration, the developer is fed in a charged state to a position where the developer-carrying surface (the developer-carrying body), which moves along the sub-scanning direction, and the developer transport surface (the developer transport body) face each other. By this procedure, the developer can be fed to the developer-carrying surface of the developer-carrying body.

At this time, the developer is transported on the developer transport surface along a predetermined developer transport direction along the sub-scanning direction, along which the plurality of transport electrodes are arrayed, while being guided by the developer transport guide members. Such transport of the developer on the developer transport surface is carried out through application of predetermined voltages to the plurality of transport electrodes via the electricity supply wiring section.

Traveling-wave electric fields along the developer transport direction are formed in a good condition on portions (intermediate portions) of the transport electrodes between the distal end portions and the root portions. By contrast, good traveling-wave electric fields are hard to form on the distal end portions and the root portions of the transport electrodes and on the electricity supply wiring section. However, the regions where good traveling-wave electric fields are hard to form are covered with the developer transport guide members adapted to define an areal range on the developer transport surface within which the developer is transported.

Thus, the developer feed device of the present invention can implement smooth transport of the charged developer on the developer transport surface by means of a simple apparatus configuration. Therefore, the stagnation of the developer on the developer transport surface can be restrained to the greatest possible extent by means of a simple apparatus configuration. In the developer feed device, the developer transport guide members may be provided such that a range over which the root portions and the distal end portions of the transport electrodes are covered with each of the developer transport guide members is equal to or greater than the width (electrode width) of each of the transport electrodes as measured orthogonally to the longitudinal direction.

According to the developer feed device having the above configuration, the above-mentioned regions where good traveling-wave electric fields are hard to form are more reliably covered with the developer transport guide members. The developer feed device may further comprise a plurality of counter electrodes, and the developer transport guide members may intervene between the developer transport surface and the counter electrodes.

The plurality of counter electrodes is arrayed along the developer transport direction. The counter electrodes are configured to have their longitudinal direction intersecting with sub-scanning direction. For example, the counter electrodes can be configured to have their longitudinal direction parallel to the main scanning direction orthogonal to the sub-scanning direction. Alternatively, the counter electrodes can be formed in parallel with the transport electrodes. The counter electrodes are disposed in such a manner as to face the developer transport surface with a predetermined gap therebetween.

In the developer feed device having the above configuration, through application of predetermined voltages, predetermined traveling-wave electric fields are generated on the plurality of counter electrodes and on the plurality of transport electrodes. Thus, the charged developer can be transported smoothly on the developer transport surface. In the developer feed device, the developer transport guide members may be configured to be able to restrain deposition of the developer on their top surfaces opposite their surfaces which face the developer transport surface.

According to the developer feed device having the above configuration, the stagnation of the developer on the top surfaces of the developer transport guide members can be restrained to the greatest possible extent. The developer feed device may further comprise a developer containing casing and a pair of seal members, and the seal members may serve as the developer transport guide members.

The developer containing casing is a box-like member configured to be able to cover the developer transport body and to contain the developer therein. The developer containing casing has an opening portion formed at a position where the electrostatic-latent-image carrying body and the developer transport surface face each other.

The pair of seal members is provided at opposite end portions of the developer containing casing with respect to the width direction. The seal members are configured to be able to restrain leakage of the developer to the exterior of the developer containing casing.

In the developer feed device having the above configuration, the above-mentioned regions where good traveling-wave electric fields are hard to form can be more reliably covered with the seal members adapted to restrain leakage of the developer from the developer containing casing. Thus, the stagnation of the charged developer on the developer transport body can be restrained by means of a simple apparatus configuration. In the developer feed device, the developer transport guide members may be formed of an elastic material. For example, the developer transport guide members can be formed of foamed sponge or rubber.

The developer transport guide members which are formed of such an elastic material and serve as the seal members can intervene in a compressed condition between the developer containing casing and the opposite end portions of the developer transport body.

According to the developer feed device having the above configuration, leakage of the developer to the exterior of the developer containing casing can be more reliably restrained, and the regions of the developer transport surface where good traveling-wave electric fields are hard to form can be more reliably covered.

(1-3) A developer electric field transport device of the present invention is configured to be able to transport a charged developer by means of electric fields. Specifically, the developer electric field transport device comprises a plurality of transport electrodes, an electricity supply wiring section, a developer transport body, and a pair of developer transport guide members.

The plurality of transport electrodes are arrayed in a predetermined developer transport direction along a sub-scanning direction. The sub-scanning direction is a moving direction of a developer-carrying body which carries the developer thereon.

The transport electrodes are configured to have their longitudinal direction intersecting with the sub-scanning direction.

The electricity supply wiring section is connected to root portions of the transport electrodes. The root portions are one end portions of the transport electrodes with respect to the longitudinal direction.

The developer transport body has a developer transport surface parallel to a main scanning direction. The main scanning direction is orthogonal to the sub-scanning direction. The transport electrodes and the electricity supply wiring section are provided on the developer transport body along the developer transport surface. The developer transport body is disposed such that the developer transport surface faces the developer-carrying body. The developer transport body is configured to be able to transport the developer along the developer transport direction by means of traveling-wave electric fields which are generated on the developer transport surface through application of predetermined transport voltages to the plurality of transport electrodes.

The pair of developer transport guide members is provided on the developer transport surface at opposite end portions, with respect to a width direction perpendicular to the developer transport direction, of the developer transport body. The developer transport guide members are configured and disposed so as to define an areal range within which the developer is transported on the developer transport surface along the developer transport direction. Each of the paired developer transport guide members is provided in such a manner as to cover the electricity supply wiring section and the root portions and distal end portions of the transport electrodes, the distal end portions being opposite the root portions.

That is, the present invention is characterized in that the pair of developer transport guide members in the developer electric field transport device has the above-mentioned configuration.

In the developer electric field transport device of the present invention having the above configuration, the charged developer is transported toward a position where the developer-carrying surface (the developer-carrying body), which moves along the sub-scanning direction, and the developer transport surface (the developer transport body) face each other. Thus, the developer is transported on the developer transport surface along a predetermined developer transport direction along the sub-scanning direction, along which the plurality of transport electrodes are arrayed, while being guided by the developer transport guide members. By this procedure, the developer is fed to the developer-carrying surface of the developer-carrying body.

The above-mentioned transport of the developer on the developer transport surface is carried out through application of predetermined voltages to the plurality of transport electrodes via the electricity supply wiring section. At this time, traveling-wave electric fields along the developer transport direction are formed in a good condition on portions (intermediate portions) of the transport electrodes between the distal end portions and the root portions. By contrast, good traveling-wave electric fields are hard to form on the distal end portions and the root portions of the transport electrodes and on the electricity supply wiring section.

However, the regions where good traveling-wave electric fields are hard to form are covered with the developer transport guide members adapted to define an areal range on the developer transport surface within which the developer is transported.

Thus, the developer electric field transport device of the present invention can implement smooth transport of the charged developer on the developer transport surface by means of a simple apparatus configuration. Therefore, the stagnation of the developer on the developer transport surface can be restrained to the greatest possible extent by means of a simple apparatus configuration. In the developer electric field transport device, the developer transport guide members may be provided such that a range over which the root portions and the distal end portions of the transport electrodes are covered with each of the developer transport guide members is equal to or greater than the width (electrode width) of each of the transport electrodes as measured orthogonally to the longitudinal direction.

According to the developer electric field transport device having the above configuration, the above-mentioned regions where good traveling-wave electric fields are hard to form can be more reliably covered with the developer transport guide members. In the developer electric field transport device, the developer transport guide members may be configured to be able to restrain deposition of the developer on their top surfaces opposite their surfaces which face the developer transport surface.

According to the developer electric field transport device having the above configuration, the stagnation of the developer on the top surfaces of the developer transport guide members can be restrained to the greatest possible extent.

In the developer electric field transport device, the developer transport guide members may be formed of an elastic material. For example, the developer transport guide members can be formed of foamed sponge or rubber.

(2-1) An image forming apparatus of the present invention comprises an electrostatic-latent-image carrying body and a developer feed device.

The electrostatic-latent-image carrying body has a latent-image forming surface. The latent-image forming surface is configured to be able to form an electrostatic latent image thereon by means of electric-potential distribution. The latent-image forming surface is formed in parallel with a predetermined main scanning direction. The electrostatic-latent-image carrying body is configured such that the latent-image forming surface can move along a sub-scanning direction orthogonal to the main scanning direction.

The developer feed device is disposed in such a manner as to face the electrostatic-latent-image carrying body. The developer feed device is configured to be able to feed the latent-image forming surface with a developer in a charged state. Specifically, the developer feed device comprises a plurality of transport electrodes, an electricity supply wiring section, a developer transport body, and a pair of cover members.

The plurality of transport electrodes are arrayed in a predetermined developer transport direction along the sub-scanning direction. The transport electrodes are configured to have their longitudinal direction intersecting with the sub-scanning direction. Specifically, for example, the transport electrodes can be configured to have their longitudinal direction parallel to the main scanning direction orthogonal to the sub-scanning direction. The developer transport direction can be set in parallel with the sub-scanning direction.

The electricity supply wiring section is connected to root portions of the transport electrodes. The root portions are one end portions of the transport electrodes with respect to the longitudinal direction. That is, the transport electrodes and the electricity supply wiring section form a predetermined wiring pattern. End portions of the transport electrodes opposite the root portions (other end portions opposite the one end portions with respect to the longitudinal direction); i.e., distal end portions of the transport electrodes, serve as ends of the wiring pattern.

The developer transport body has a developer transport surface parallel to the main scanning direction. The transport electrodes and the electricity supply wiring section are provided on the developer transport body along the developer transport surface. That is, the predetermined wiring pattern composed of the transport electrodes and the electricity supply wiring section is provided on the developer transport body along the developer transport surface. The developer transport body is disposed such that the developer transport surface faces the electrostatic-latent-image carrying body. The developer transport body is configured to be able to transport the developer along the developer transport direction by means of traveling-wave electric fields which are generated on the developer transport surface through application of predetermined transport voltages to the plurality of transport electrodes.

The pair of cover members is provided on the developer transport surface at opposite end portions, with respect to a width direction perpendicular to the developer transport direction, of the developer transport body. Each of the paired cover members is provided in such a manner as to cover the electricity supply wiring section and the root portions and the distal end portions of the transport electrodes. In other words, the pair of cover members covers the electricity supply wiring section and opposite end portions, with respect to the longitudinal direction, of the transport electrodes.

That is, the present invention is characterized in that the pair of cover members in the developer feed device provided in the image forming apparatus has the above-mentioned configuration.

The image forming apparatus of the present invention having the above configuration operates as described below in formation of an image.

The latent-image forming surface on which the electrostatic latent image is formed moves along the sub-scanning direction. The developer feed device feeds the developer in a charged state to the latent-image forming surface on which the electrostatic latent image is formed. The developer is transported on the developer transport surface along a predetermined developer transport direction (along the sub-scanning direction along which the plurality of transport electrodes is arrayed). By this procedure, the electrostatic latent image is developed (rendered visible) with the developer.

The above-mentioned transport of the developer on the developer transport surface is effected through formation of predetermined traveling-wave electric fields in the vicinity of the plurality of transport electrodes. The electric fields are formed through application of predetermined voltages to the plurality of transport electrodes via the electricity supply wiring section.

Traveling-wave electric fields along the developer transport direction are formed in a good condition on portions (intermediate portions) of the transport electrodes between the distal end portions and the root portions. By contrast, good traveling-wave electric fields are hard to form (or are not formed) on the distal end portions and the root portions of the transport electrodes and on the electricity supply wiring section.

Thus, in the image forming apparatus of the present invention, the above-mentioned regions where good traveling-wave electric fields are hard to form are covered with the cover members.

Thus, the image forming apparatus of the present invention can implement smooth transport of the charged developer on the developer transport surface by means of a simple apparatus configuration. Therefore, the stagnation of the developer on the developer transport surface can be restrained to the greatest possible extent by means of a simple apparatus configuration. In the image forming apparatus, the cover members may be provided such that a range over which the root portions and the distal end portions of the transport electrodes are covered with each of the cover members is equal to or greater than the width (electrode width) of each of the transport electrodes as measured orthogonally to the longitudinal direction.

According to the image forming apparatus having the above configuration, the above-mentioned regions where good traveling-wave electric fields are hard to form are more reliably covered with the cover members. The image forming apparatus may further comprise a plurality of counter electrodes, and the cover members may intervene between the developer transport surface and the counter electrodes.

The plurality of counter electrodes is arrayed along the developer transport direction. The counter electrodes are configured to have their longitudinal direction intersecting with sub-scanning direction. For example, the counter electrodes can be configured to have their longitudinal direction parallel to the main scanning direction orthogonal to the sub-scanning direction. Alternatively, the counter electrodes can be formed in parallel with the transport electrodes. The counter electrodes are disposed in such a manner as to face the developer transport surface with a predetermined gap therebetween.

In the image forming apparatus having the above configuration, through application of predetermined voltages, predetermined traveling-wave electric fields are generated on the plurality of counter electrodes and on the plurality of transport electrodes. Thus, the charged developer can be transported smoothly on the developer transport surface. In the image forming apparatus, the cover members may be configured to be able to restrain deposition of the developer on their top surfaces opposite their surfaces which face the developer transport surface.

According to the image forming apparatus having the above configuration, the stagnation of the developer on the top surfaces of the cover members can be restrained to the greatest possible extent. The image forming apparatus may further comprise a developer containing casing, and the cover members may be formed of an elastic material and may be provided such that the top surfaces of the cover members are pressed against the developer containing casing.

The developer containing casing is a box-like member configured to be able to cover the developer transport body and to contain the developer therein. The developer containing casing has an opening portion formed at a position where the electrostatic-latent-image carrying body and the developer transport surface face each other. The cover members can be formed of foamed sponge, rubber, or the like.

In the image forming apparatus having the above configuration, the top surfaces of the cover members formed of an elastic material are pressed against the developer containing casing. Thus, the cover members can intervene in a compressed condition between the developer containing casing and the opposite end portions of the developer transport body. Therefore, deposition of the developer on the top surfaces of the cover members can be effectively restrained by means of a simple apparatus configuration. The image forming apparatus may further comprise a pair of seal members, and the seal members may serve as the cover members.

The pair of seal members is provided at opposite end portions of the developer containing casing with respect to the width direction. The seal members are configured to be able to restrain leakage of the developer to the exterior of the developer containing casing.

In the image forming apparatus having the above configuration, the above-mentioned regions where good traveling-wave electric fields are hard to form can be more reliably covered with the seal members adapted to restrain leakage of the developer from the developer containing casing. Thus, leakage of the developer to the exterior of the developer containing casing can be more reliably restrained, and the regions of the developer transport surface where good traveling-wave electric fields are hard to form can be more reliably covered.

(2-2) A developer feed device of the present invention is configured to be able to feed a developer in a charged state to a developer-carrying surface of a developer-carrying body. The developer-carrying surface is a surface which is parallel to a predetermined main scanning direction and which can carry the developer thereon.

The developer-carrying body has the developer-carrying surface and is configured to be able to move along a sub-scanning direction orthogonal to the main scanning direction. The developer-carrying body can be, for example, an electrostatic-latent-image carrying body having a latent-image forming surface configured to be able to form an electrostatic latent image thereon by means of electric-potential distribution. Alternatively, the developer-carrying body can be, for example, a recording medium (paper) which is transported along the sub-scanning direction. Alternatively, the developer-carrying body can be, for example, a roller, a sleeve, or a belt member (an intermediate transfer belt, a developing roller, a developing sleeve, etc.) which is configured and disposed so as to be able to transfer the developer onto the recording medium or the electrostatic-latent-image carrying body by means of facing the recording medium or the electrostatic-latent-image carrying body.

The developer feed device of the present invention comprises a plurality of transport electrodes, an electricity supply wiring section, a developer transport body, and a pair of cover members.

The plurality of transport electrodes are arrayed in a predetermined developer transport direction along the sub-scanning direction. The transport electrodes are configured to have their longitudinal direction intersecting with the sub-scanning direction.

The electricity supply wiring section is connected to root portions of the transport electrodes. The root portions are one end portions of the transport electrodes with respect to the longitudinal direction.

The developer transport body has a developer transport surface parallel to the main scanning direction. The transport electrodes and the electricity supply wiring section are provided on the developer transport body along the developer transport surface. The developer transport body is disposed such that the developer transport surface faces the developer-carrying body. The developer transport body is configured to be able to transport the developer along the developer transport direction by means of traveling-wave electric fields which are generated on the developer transport surface through application of predetermined transport voltages to the plurality of transport electrodes.

The pair of cover members is provided on the developer transport surface at opposite end portions, with respect to a width direction perpendicular to the developer transport direction, of the developer transport body. Each of the paired cover members is provided in such a manner as to cover the electricity supply wiring section and the root portions and the distal end portions of the transport electrodes. In other words, the pair of cover members covers the electricity supply wiring section and opposite end portions, with respect to the longitudinal direction, of the transport electrodes.

That is, the present invention is characterized in that the pair of cover members in the developer feed device has the above-mentioned configuration.

In the developer feed device of the present invention having the above configuration, the developer is fed in a charged state to a position where the developer-carrying surface (the developer-carrying body), which moves along the sub-scanning direction, and the developer transport surface (the developer transport body) face each other. By this procedure, the developer can be fed to the developer-carrying surface of the developer-carrying body.

At this time, the developer is transported on the developer transport surface along a predetermined developer transport direction along the sub-scanning direction, along which the plurality of transport electrodes is arrayed. Such transport of the developer on the developer transport surface is carried out through application of predetermined voltages to the plurality of transport electrodes via the electricity supply wiring section.

Traveling-wave electric fields along the developer transport direction are formed in a good condition on portions (intermediate portions) of the transport electrodes between the distal end portions and the root portions. By contrast, good traveling-wave electric fields are hard to form on the distal end portions and the root portions of the transport electrodes and on the electricity supply wiring section. However, the regions where good traveling-wave electric fields are hard to form are covered with the cover members.

Thus, the developer feed device of the present invention can implement smooth transport of the charged developer on the developer transport surface by means of a simple apparatus configuration. Therefore, the stagnation of the developer on the developer transport surface can be restrained to the greatest possible extent by means of a simple apparatus configuration. In the developer feed device, the cover members may be provided such that a range over which the root portions and the distal end portions of the transport electrodes are covered with each of the cover members is equal to or greater than the width (electrode width) of each of the transport electrodes as measured orthogonally to the longitudinal direction.

According to the developer feed device having the above configuration, the above-mentioned regions where good traveling-wave electric fields are hard to form are more reliably covered with the cover members. The developer feed device may further comprise a plurality of counter electrodes, and the cover members may intervene between the developer transport surface and the counter electrodes.

The plurality of counter electrodes is arrayed along the developer transport direction. The counter electrodes are configured to have their longitudinal direction intersecting with sub-scanning direction. For example, the counter electrodes can be configured to have their longitudinal direction parallel to the main scanning direction orthogonal to the sub-scanning direction. Alternatively, the counter electrodes can be formed in parallel with the transport electrodes. The counter electrodes are disposed in such a manner as to face the developer transport surface with a predetermined gap therebetween.

In the developer feed device having the above configuration, through application of predetermined voltages, predetermined traveling-wave electric fields are generated on the plurality of counter electrodes and on the plurality of transport electrodes. Thus, the charged developer can be transported smoothly on the developer transport surface. In the developer feed device, the cover members may be configured to be able to restrain deposition of the developer on their top surfaces opposite their surfaces which face the developer transport surface.

According to the developer feed device having the above configuration, the stagnation of the developer on the top surfaces of the cover members can be restrained to the greatest possible extent. The developer feed device may further comprise a developer containing casing, and the cover members may be formed of an elastic material and may be provided such that the top surfaces of the cover members are pressed against the developer containing casing.

The developer containing casing is a box-like member configured to be able to cover the developer transport body and to contain the developer therein. The developer containing casing has an opening portion formed at a position where the electrostatic-latent-image carrying body and the developer transport surface face each other. The cover members can be formed of foamed sponge, rubber, or the like.

In the developer feed device having the above configuration, the top surfaces of the cover members formed of an elastic material are pressed against the developer containing casing. Thus, the cover members can intervene in a compressed condition between the developer containing casing and the opposite end portions of the developer transport body. Therefore, deposition of the developer on the top surfaces of the cover members can be effectively restrained by means of a simple apparatus configuration. The developer feed device may further comprise a pair of seal members, and the seal members may serve as the cover members.

The pair of seal members is provided at opposite end portions of the developer containing casing with respect to the width direction. The seal members are configured to be able to restrain leakage of the developer to the exterior of the developer containing casing.

In the developer feed device having the above configuration, the above-mentioned regions where good traveling-wave electric fields are hard to form can be more reliably covered with the seal members adapted to restrain leakage of the developer from the developer containing casing. Thus, leakage of the developer to the exterior of the developer containing casing can be more reliably restrained, and the regions of the developer transport surface where good traveling-wave electric fields are hard to form can be more reliably covered.

(2-3) A developer electric field transport device of the present invention is configured to be able to transport a charged developer by means of electric fields. Specifically, the developer electric field transport device comprises a plurality of transport electrodes, an electricity supply wiring section, a developer transport body, and a pair of cover members.

The plurality of transport electrodes are arrayed in a predetermined developer transport direction along a sub-scanning direction. The sub-scanning direction is a moving direction of a developer-carrying body which carries the developer thereon. The transport electrodes are configured to have their longitudinal direction intersecting with the sub-scanning direction.

The electricity supply wiring section is connected to root portions of the transport electrodes. The root portions are one end portions of the transport electrodes with respect to the longitudinal direction.

The developer transport body has a developer transport surface parallel to a main scanning direction. The main scanning direction is orthogonal to the sub-scanning direction. The transport electrodes and the electricity supply wiring section are provided on the developer transport body along the developer transport surface. The developer transport body is disposed such that the developer transport surface faces the developer-carrying body. The developer transport body is configured to be able to transport the developer along the developer transport direction by means of traveling-wave electric fields which are generated on the developer transport surface through application of predetermined transport voltages to the plurality of transport electrodes.

The pair of cover members is provided on the developer transport surface at opposite end portions, with respect to a width direction perpendicular to the developer transport direction, of the developer transport body. The paired cover members are provided in such a manner as to cover the electricity supply wiring section and those regions which correspond to the root portions and distal end portions of the transport electrodes, the distal end portions being opposite the root portions.

That is, the present invention is characterized in that the pair of cover members in the developer electric field transport device has the above-mentioned configuration.

In the developer electric field transport device of the present invention having the above configuration, the charged developer is transported toward a position where the developer-carrying surface (the developer-carrying body), which moves along the sub-scanning direction, and the developer transport surface (the developer transport body) face each other. Thus, the developer is transported along a predetermined developer transport direction along the sub-scanning direction, along which the plurality of transport electrodes is arrayed. By this procedure, the developer is fed to the developer-carrying surface of the developer-carrying body.

The above-mentioned transport of the developer on the developer transport surface is carried out through application of predetermined voltages to the plurality of transport electrodes via the electricity supply wiring section. At this time, traveling-wave electric fields along the developer transport direction are formed in a good condition on portions (intermediate portions) of the transport electrodes between the distal end portions and the root portions. By contrast, good traveling-wave electric fields are hard to form on the distal end portions and the root portions of the transport electrodes and on the electricity supply wiring section.

However, the regions where good traveling-wave electric fields are hard to form are covered with the cover members.

Thus, the developer electric field transport device of the present invention can implement smooth transport of the charged developer on the developer transport surface by means of a simple apparatus configuration. Therefore, the stagnation of the developer on the developer transport surface can be restrained to the greatest possible extent by means of a simple apparatus configuration. In the developer electric field transport device, the cover members may be provided such that a range over which the root portions and the distal end portions of the transport electrodes are covered with each of the cover members is equal to or greater than the width (electrode width) of each of the transport electrodes as measured orthogonally to the longitudinal direction.

According to the developer electric field transport device having the above configuration, the above-mentioned regions where good traveling-wave electric fields are hard to form can be more reliably covered with the cover members. In the developer electric field transport device, the cover members may be configured to be able to restrain deposition of the developer on their top surfaces opposite their surfaces which face the developer transport surface.

According to the developer electric field transport device having the above configuration, the stagnation of the developer on the top surfaces of the cover members can be restrained to the greatest possible extent. In the developer electric field transport device, the cover members may be formed of an elastic material. For example, the cover members can be formed of foamed sponge or rubber.

[2]

(1) An image forming apparatus of the present invention comprises an electrostatic-latent-image carrying body and a developer feed device.

The electrostatic-latent-image carrying body has a latent-image forming surface. The latent-image forming surface is configured to be able to form an electrostatic latent image thereon by means of electric-potential distribution. The latent-image forming surface is formed in parallel with a predetermined main scanning direction. The electrostatic-latent-image carrying body is configured such that the latent-image forming surface can move along a sub-scanning direction orthogonal to the main scanning direction.

The developer feed device is disposed in such a manner as to face the electrostatic-latent-image carrying body. The developer feed device is configured to be able to feed the latent-image forming surface with a developer in a charged state. Specifically, the developer feed device comprises a plurality of transport electrodes, a developer transport body, a pair of first developer transport guide members, and a pair of second developer transport guide members.

The plurality of transport electrodes are arrayed in a predetermined developer transport direction along the sub-scanning direction. The transport electrodes are configured to have their longitudinal direction intersecting with the sub-scanning direction. Specifically, for example, the transport electrodes can be configured to have their longitudinal direction parallel to the main scanning direction orthogonal to the sub-scanning direction. The developer transport direction can be set in parallel with the sub-scanning direction.

The developer transport body has a developer transport surface parallel to the main scanning direction. The transport electrodes are provided along the developer transport surface. The developer transport body is disposed such that the developer transport surface faces the electrostatic-latent-image carrying body. The developer transport body is configured to be able to transport the developer along the developer transport direction by means of traveling-wave electric fields which are generated on the developer transport surface through application of predetermined transport voltages to the plurality of transport electrodes.

The pair of first developer transport guide members is provided at opposite end portions, with respect to a width direction perpendicular to the developer transport direction, of the developer transport body. The first developer transport guide members are provided on the developer transport surface upstream of a predetermined developing position with respect to the developer transport direction. The developing position is where the electrostatic-latent-image carrying body and the developer transport body face in the closest proximity to each other.

The pair of second developer transport guide members is provided at the opposite end portions, with respect to the width direction, of the developer transport body. The second developer transport guide members are provided on the developer transport surface downstream of the developing position with respect to the developer transport direction.

The first and second developer transport guide members are configured and disposed so as to be able to define a developer transport area with respect to the main scanning direction by means of restraining outward leakage of the developer beyond the first and second developer transport guide members with respect to the width direction. The developer transport area is an areal range (area) on the developer transport surface within which the developer is transported along the developer transport direction.

The first and second developer transport guide members are configured and disposed such that the distance between the paired second developer transport guide members along the main scanning direction is greater than that between the paired first developer transport guide members along the main scanning direction.

The image forming apparatus of the present invention having the above configuration operates as described below in formation of an image.

The latent-image forming surface on which the electrostatic latent image is formed moves along the sub-scanning direction.

Predetermined transport voltages are applied to the plurality of transport electrodes in the developer feed device. By this procedure, predetermined traveling-wave electric fields are formed on the developer transport surface along a predetermined developer transport direction (along the sub-scanning direction along which the plurality of transport electrodes is arrayed). By means of the electric fields, the charged developer is transported on the developer transport surface along the developer transport direction.

In the above-mentioned manner, the developer is transported to the developing position. Thus, the developer is fed in a charged state to the latent-image forming surface on which the electrostatic latent image is formed. The electrostatic latent image is developed (rendered visible) with the developer which is fed to the developing position.

In transport of the developer by means of traveling-wave electric fields as mentioned above, the developer moves on the developer transport surface toward the developing position while being guided by the first developer transport guide members. The developer which has passed the developing position moves further downstream of the developing position along the developer transport direction while being guided by the second developer transport guide members.

At this time, the distance between the paired second developer transport guide members along the main scanning direction is greater than that between the paired first developer transport guide members along the main scanning direction.

The "distance between the paired second developer transport guide members along the main scanning direction" is the width of a region of the developer transport surface lying between the paired second developer transport guide members; in other words, the width of a region (the developer transport area) where the developer can be effectively transported (this convention applies to the "distance between the paired first developer transport guide members along the main scanning direction").

Also, the developer transport area which is defined by the paired first developer transport guide members and is located upstream of the developing position with respect to the developer transport direction is hereinafter referred to as the "upstream developer transport area." Furthermore, the developer transport area which is defined by the paired second developer transport guide members and is located downstream of the developing position with respect to the developer transport direction is hereinafter referred to as the "downstream developer transport area."

That is, according to the above configuration, the width of the downstream developer transport area is greater than that of the upstream developer transport area. Thus, the developer which has been transported to the developing position while being guided within the upstream developer transport area by the pair of first developer transport guide members passes the developing position and is guided smoothly into the downstream developer transport area, which is wider than the upstream developer transport area.

The above configuration can effectively restrain the stagnation of the developer when the developer passes the developing position and is to be guided into the downstream developer transport area. That is, the stagnation of the developer on the developer transport surface can be restrained to the greatest possible extent by means of a simple apparatus configuration.

Thus, the image forming apparatus of the present invention can implement smooth transport of the charged developer on the developer transport surface by means of a simple apparatus configuration. Therefore, for example, leakage of the developer to the exterior of the developer feed device at end portions, with respect to the main scanning direction, of the electrostatic-latent-image carrying body can be restrained to the greatest possible extent. The width of the latent-image forming surface along the main scanning direction may be set equal to or greater than the distance between the paired first developer transport guide members along the main scanning direction.

The above configuration effectively restrains adhesion of the developer to end portions, with respect to the main scanning direction, of the electrostatic-latent-image carrying body which do not contribute to formation of an image. Therefore, the configuration can effectively restrain the occurrence of smudge on the end portions of the electrostatic-latent-image carrying body and leakage of the developer form the vicinity of the end portions to the exterior of the developer feed device. The distance between the paired second developer transport guide members along the main scanning direction may be set greater than the width of the latent-image forming surface along the main scanning direction.

By virtue of the above configuration, when the developer moves from the developing position to the downstream developer transport area, the developer which attempts to scatter from end portions, with respect to the main scanning direction, of the latent-image forming surface to the outside, with respect to the main scanning direction, of the latent-image forming surface can be reliably guided into the area which lies between the paired second developer transport guide members. Therefore, the configuration can effectively restrain leakage of the developer to the exterior of the developer feed device in the vicinity of the end portions, with respect to the main scanning direction, of the electrostatic-latent-image carrying body. The image forming apparatus may further comprise spacer members.

The spacer members are provided in such a manner as to intervene between the electrostatic-latent-image carrying body and the developer transport body. The spacer members are configured to be able to determine the distance between the latent-image forming surface and the developer transport surface at the developing position. The spacer members are disposed in such a manner as to face portions of the electrostatic-latent-image carrying body which are located outwardly of the latent-image forming surface with respect to the main scanning direction.

According to the above configuration, when the latent-image forming surface on which the electrostatic latent image is formed moves along the sub-scanning direction, the spacer members face portions of the electrostatic-latent-image carrying body which are located outwardly of the latent-image forming surface with respect to the main scanning direction. Thus, the distance between the latent-image forming surface and the developer transport surface at the developing position is determined.

According to the image forming apparatus having the above configuration, there can be effectively restrained a problem in that, when the latent-image forming surface on which the electrostatic latent image is formed moves along the sub-scanning direction, the spacer members scratch or wear the latent-image forming surface. Because of effective restraint of variation in positional relation between the developer transport surface and the latent-image forming surface caused by wear or the like of the latent-image forming surface, the quality of a formed image can be stabilized. In the image forming apparatus, the first and second developer transport guide members may be configured to be able to restrain deposition of the developer on their top surfaces. The top surfaces are opposite those surfaces (bottom surfaces) which face the developer transport surface.

Specifically, for example, the first and second developer transport guide members can be configured such that the top surfaces touch a developer containing casing which serves as a casing of the developer feed device. Alternatively, the top surfaces can be formed into slopes such that the developer thereon slips down toward an intermediate portion of the developer transport surface.

According to the image forming apparatus having the above configuration, the stagnation of the developer on the top surfaces of the first and second developer transport guide members can be restrained to the greatest possible extent. The image forming apparatus may further comprise a plurality of counter electrodes, and the first and second developer transport guide members may intervene between the developer transport surface and the counter electrodes.

The counter electrodes are configured to have their longitudinal direction intersecting with the sub-scanning direction. For example, the counter electrodes can be configured to have their longitudinal direction parallel to the main scanning direction orthogonal to the sub-scanning direction. Alternatively, the counter electrodes can be formed in parallel with the transport electrodes.

The counter electrodes are disposed in such a manner as to face the developer transport surface with a predetermined gap therebetween. The plurality of counter electrodes is arrayed along the developer transport direction.

In the image forming apparatus having the above configuration, through application of predetermined voltages, predetermined traveling-wave electric fields are generated on the plurality of counter electrodes and on the plurality of transport electrodes. Thus, the charged developer can be transported more smoothly on the developer transport surface while being guided by the first and second developer transport guide members. The image forming apparatus may further comprise a developer containing casing, and the first and second developer transport guide members may be configured such that their top surfaces touch the developer containing casing.

The developer containing casing is a box-like member which is configured to be able to contain the developer therein. The developer containing casing is configured to cover the developer transport body and the first and second developer transport guide members. The developer containing casing has an opening portion at a position where the electrostatic-latent-image carrying body and the developer transport surface face each other. That is, the opening portion is formed in such a manner as to surround the developing position.

In the above configuration, the top surfaces of the first and second developer transport guide members touch the developer containing casing. Thus, transport of the developer can be reliably guided within the upstream developer transport area and within the downstream developer transport area. Also, the stagnation of the developer on the top surfaces of the first and second developer transport guide members can be effectively restrained. In the image forming apparatus, the first and second developer transport guide members may be formed of an elastic material. For example, the first and second developer transport guide members can be formed of foamed sponge or rubber.

The first and second developer transport guide members which are formed of such an elastic material can intervene in a compressed condition between the developer containing casing and the opposite end portions of the developer transport body.

According to the image forming apparatus having the above configuration, transport of the developer can be more reliably guided within the upstream developer transport area and within the downstream developer transport area. Also, the stagnation of the developer on the top surfaces of the first and second developer transport guide members can be more effectively restrained. Thus, for example, there can be more reliably restrained leakage of the developer to the exterior of the developer feed device in the vicinity of end portions, with respect to the main scanning direction, of the electrostatic-latent-image carrying body.

(2) A developer feed device of the present invention is configured to be able to feed a developer in a charged state to a developer-carrying surface of a developer-carrying body. The developer-carrying surface is a surface which is parallel to a predetermined main scanning direction and which can carry the developer thereon.

The developer-carrying body has the developer-carrying surface and is configured to be able to move along a sub-scanning direction orthogonal to the main scanning direction. The developer-carrying body can be, for example, an electrostatic-latent-image carrying body having a latent-image forming surface configured to be able to form an electrostatic latent image thereon by means of electric-potential distribution. Alternatively, the developer-carrying body can be, for example, a recording medium (paper) which is transported along the sub-scanning direction. Alternatively, the developer-carrying body can be, for example, a roller, a sleeve, or a belt member (an intermediate transfer belt, a developing roller, a developing sleeve, etc.) which is configured and disposed so as to be able to transfer the developer onto the recording medium or the electrostatic-latent-image carrying body by means of facing the recording medium or the electrostatic-latent-image carrying body.

The developer feed device comprises a plurality of transport electrodes, a developer transport body, a pair of first developer transport guide members, and a pair of second developer transport guide members.

The plurality of transport electrodes are arrayed in a predetermined developer transport direction along the sub-scanning direction. The transport electrodes are configured to have their longitudinal direction intersecting with the sub-scanning direction.

The developer transport body has a developer transport surface parallel to the main scanning direction. The transport electrodes are provided along the developer transport surface.

The developer transport body is disposed such that the developer transport surface faces the developer-carrying body. The developer transport body is configured to be able to transport the developer along the developer transport direction by means of traveling-wave electric fields which are generated on the developer transport surface through application of predetermined transport voltages to the plurality of transport electrodes.

The pair of first developer transport guide members is provided at opposite end portions, with respect to a width direction perpendicular to the developer transport direction, of the developer transport body. The first developer transport guide members are provided on the developer transport surface upstream of a predetermined developing position with respect to the developer transport direction. The developing position is where the developer-carrying body and the developer transport body face in the closest proximity to each other.

The pair of second developer transport guide members is provided at the opposite end portions, with respect to the width direction, of the developer transport body. The second developer transport guide members are provided on the developer transport surface downstream of the developing position with respect to the developer transport direction.

The first and second developer transport guide members are configured and disposed so as to be able to define a developer transport area with respect to the main scanning direction by means of restraining outward leakage of the developer beyond the first and second developer transport guide members with respect to the width direction. The developer transport area is an areal range (area) on the developer transport surface within which the developer is transported along the developer transport direction.

The first and second developer transport guide members are configured and disposed such that the distance between the paired second developer transport guide members along the main scanning direction is greater than that between the paired first developer transport guide members along the main scanning direction.

In the developer feed device of the present invention having the above configuration, the developer is transported in a charged state toward the developing position where the developer transport surface (the developer transport body) and the developer-carrying surface (the developer-carrying body), which moves along the sub-scanning direction, face in the closest proximity to each other. By this procedure, the charged developer is fed to the developing position, whereby the developer is carried on the developer-carrying surface.

At this time, the developer moves on the developer transport surface toward the developing position while being guided by the first developer transport guide members. The developer which has passed the developing position moves further downstream of the developing position along the developer transport direction while being guided by the second developer transport guide members.

In the developer feed device of the present invention, the distance between the paired second developer transport guide members along the main scanning direction is greater than that between the paired first developer transport guide members along the main scanning direction.

Thus, the developer which has been transported to the developing position while being guided within the upstream developer transport area by the pair of first developer transport guide members passes the developing position and can be guided smoothly into the downstream developer transport area, which is wider than the upstream developer transport area. That is, when the developer passes the developing position and is to be guided into the downstream developer transport area, the stagnation of the developer can be effectively restrained.

Thus, the developer feed device of the present invention can implement smooth transport of the charged developer on the developer transport surface by means of a simple apparatus configuration. Therefore, the stagnation of the developer on the developer transport surface can be restrained to the greatest possible extent by means of a simple apparatus configuration. Thus, for example, leakage of the developer to the exterior of the developer feed device around the periphery of end portions, with respect to the main scanning direction, of the developer-carrying body can be restrained to the greatest possible extent. The width of the developer-carrying surface along the main scanning direction may be set equal to or greater than the distance between the paired first developer transport guide members along the main scanning direction.

The above configuration effectively restrains adhesion of the developer to end portions, with respect to the main scanning direction, of the developer-carrying body which do not contribute to formation of an image. Therefore, the configuration can effectively restrain the occurrence of smudge on the end portions of the developer-carrying body and leakage of the developer form the vicinity of the end portions to the exterior of the developer feed device. The distance between the paired second developer transport guide members along the main scanning direction may be set greater than the width of the developer-carrying surface along the main scanning direction.

By virtue of the above configuration, when the developer moves from the developing position to the downstream developer transport area, the developer which attempts to scatter from end portions, with respect to the main scanning direction, of the developer-carrying surface to the outside, with respect to the main scanning direction, of the developer-carrying surface can be guided into the area which lies between the paired second developer transport guide members. Therefore, the configuration can effectively restrain leakage of the developer to the exterior of the developer feed device in the vicinity of the end portions, with respect to the main scanning direction, of the developer-carrying body. The developer feed device may further comprise spacer members.

The spacer members are provided in such a manner as to intervene between the developer-carrying body and the developer transport body. The spacer members are configured to be able to determine the distance between the developer-carrying surface and the developer transport surface at the developing position. The spacer members are disposed in such a manner as to face portions of the developer-carrying body which are located outwardly of the developer-carrying surface with respect to the main scanning direction.

According to the above configuration, when the developer-carrying surface moves along the sub-scanning direction, the spacer members face portions of the developer-carrying body which are located outwardly of the developer-carrying surface with respect to the main scanning direction. Thus, the distance between the developer-carrying surface and the developer transport surface at the developing position is determined.

According to the developer feed device having the above configuration, there can be effectively restrained a problem in that, when the developer-carrying surface moves along the sub-scanning direction, the spacer members scratch or wear the developer-carrying surface. Because of effective restraint of variation in positional relation between the developer transport surface and the developer-carrying surface caused by wear or the like of the developer-carrying surface, the quality of a formed image can be stabilized. The first and second developer transport guide members may be configured to be able to restrain deposition of the developer on their top surfaces. The top surfaces are opposite those surfaces (bottom surfaces) which face the developer transport surface. Specifically, for example, the first and second developer transport guide members can be configured such that the top surfaces touch a developer containing casing which serves as a casing of the developer feed device. Alternatively, the top surfaces can be formed into slopes such that the developer thereon slips down toward an intermediate portion of the developer transport surface.

According to the developer feed device having the above configuration, the stagnation of the developer on the top surfaces of the first and second developer transport guide members can be restrained to the greatest possible extent. The developer feed device may further comprise a plurality of counter electrodes, and the first and second developer transport guide members may intervene between the developer transport surface and the counter electrodes. The counter electrodes are configured to have their longitudinal direction intersecting with the sub-scanning direction. The counter electrodes are disposed in such a manner as to face the developer transport surface with a predetermined gap therebetween. The plurality of counter electrodes is arrayed along the developer transport direction.

In the developer feed device having the above configuration, through application of predetermined voltages, predetermined traveling-wave electric fields are generated on the plurality of counter electrodes and on the plurality of transport electrodes. Thus, the charged developer can be transported more smoothly on the developer transport surface. The developer feed device may further comprise a developer containing casing, and the first and second developer transport guide members may be configured such that their top surfaces touch the developer containing casing.

The developer containing casing is a box-like member which is configured to be able to contain the developer therein. The developer containing casing is configured to cover the developer transport body and the first and second developer transport guide members. The developer containing casing has an opening portion at a position where the developer-carrying body and the developer transport surface face each other.

In the above configuration, the top surfaces of the first and second developer transport guide members touch the developer containing casing. Thus, transport of the developer can be reliably guided within the upstream developer transport area and within the downstream developer transport area. Also, the stagnation of the developer on the top surfaces of the first and second developer transport guide members can be effectively restrained. In the developer feed device, the first and second developer transport guide members may be formed of an elastic material. For example, the first and second developer transport guide members can be formed of foamed sponge or rubber. The first and second developer transport guide members, for example, can intervene in a compressed condition between the developer containing casing and the opposite end portions of the developer transport body.

According to the developer feed device having the above configuration, transport of the developer can be more reliably guided within the upstream developer transport area and within the downstream developer transport area. Also, the stagnation of the developer on the top surfaces of the first and second developer transport guide members can be more effectively restrained. Thus, for example, there can be more effectively restrained leakage of the developer to the exterior of the developer feed device in the vicinity of end portions, with respect to the main scanning direction, of the developer-carrying body.

(3) A developer electric field transport device of the present invention is configured to be able to transport a charged developer by means of electric fields. Specifically, the developer electric field transport device comprises a plurality of transport electrodes, a developer transport body, a pair of first developer transport guide members, and a pair of second developer transport guide members.

The plurality of transport electrodes are arrayed in a predetermined developer transport direction along a sub-scanning direction. The sub-scanning direction is a moving direction of a developer-carrying body which carries the developer thereon.

The transport electrodes are configured to have their longitudinal direction intersecting with the sub-scanning direction.

The developer transport body has a developer transport surface parallel to a main scanning direction. The main scanning direction is orthogonal to the sub-scanning direction. The transport electrodes are provided along the developer transport surface.

The developer transport body is disposed such that the developer transport surface faces the developer-carrying body. The developer transport body is configured to be able to transport the developer along the developer transport direction by means of traveling-wave electric fields which are generated on the developer transport surface through application of predetermined transport voltages to the plurality of transport electrodes.

The pair of first developer transport guide members is provided at opposite end portions, with respect to a width direction perpendicular to the developer transport direction, of the developer transport body. The first developer transport guide members are provided on the developer transport surface upstream of a predetermined developing position with respect to the developer transport direction. The developing position is where the developer-carrying body and the developer transport body face in the closest proximity to each other.

The pair of second developer transport guide members is provided at the opposite end portions, with respect to the width direction, of the developer transport body. The second developer transport guide members are provided on the developer transport surface downstream of the developing position with respect to the developer transport direction.

The first and second developer transport guide members are configured and disposed so as to be able to define a developer transport area with respect to the main scanning direction by means of restraining outward leakage of the developer beyond the first and second developer transport guide members with respect to the width direction.

The developer transport area is an areal range (area) on the developer transport surface within which the developer is transported along the developer transport direction.

The first and second developer transport guide members are configured and disposed such that the distance between the paired second developer transport guide members along the main scanning direction is greater than that between the paired first developer transport guide members along the main scanning direction.

In the developer electric field transport device of the present invention, predetermined transport voltages are applied to the plurality of transport electrodes. By this procedure, predetermined traveling-wave electric fields are formed on the developer transport surface along a predetermined developer transport direction. By means of the electric fields, the charged developer is transported on the developer transport surface along the developer transport direction.

In the above-mentioned manner, the developer is transported in a charged state toward the developing position where the developer transport surface (the developer transport body) and the developer-carrying surface (the developer-carrying body), which moves along the sub-scanning direction, face in the closest proximity to each other. By this procedure, the developer is carried on the developer-carrying surface.

At this time, the developer moves on the developer transport surface toward the developing position while being guided by the first developer transport guide members. The developer which has passed the developing position moves further downstream of the developing position along the developer transport direction while being guided by the second developer transport guide members.

In the developer electric field transport device of the present invention, the distance between the paired second developer transport guide members along the main scanning direction is greater than that between the paired first developer transport guide members along the main scanning direction.

Thus, the developer which has been transported to the developing position while being guided within the upstream developer transport area by the pair of first developer transport guide members passes the developing position and can be guided smoothly into the downstream developer transport area, which is wider than the upstream developer transport area. That is, when the developer passes the developing position and is to be guided into the downstream developer transport area, the stagnation of the developer can be effectively restrained.

Thus, the developer electric field transport device of the present invention can implement smooth transport of the charged developer on the developer transport surface by means of a simple apparatus configuration. Therefore, the stagnation of the developer on the developer transport surface can be restrained to the greatest possible extent by means of a simple apparatus configuration. Thus, for example, leakage of the developer to the exterior of the developer feed device around the periphery of end portions, with respect to the main scanning direction, of the developer-carrying body can be restrained to the greatest possible extent. The width of the developer-carrying surface along the main scanning direction may be set equal to or greater than the distance between the paired first developer transport guide members along the main scanning direction.

The above configuration effectively restrains adhesion of the developer to end portions, with respect to the main scanning direction, of the developer-carrying body which do not contribute to formation of an image. Therefore, the configuration can effectively restrain the occurrence of smudge on the end portions of the developer-carrying body and leakage of the developer form the vicinity of the end portions to the exterior of the developer electric field transport device. The distance between the paired second developer transport guide members along the main scanning direction may be set greater than the width of the developer-carrying surface along the main scanning direction.

By virtue of the above configuration, when the developer moves from the developing position to the downstream developer transport area, the developer which attempts to scatter from end portions, with respect to the main scanning direction, of the developer-carrying surface to the outside, with respect to the main scanning direction, of the developer-carrying surface can be guided into the area which lies between the paired second developer transport guide members. Therefore, the configuration can effectively restrain leakage of the developer to the exterior of the developer electric field transport device in the vicinity of the end portions, with respect to the main scanning direction, of the developer-carrying body. The developer electric field transport device may further comprise spacer members.

The spacer members are provided in such a manner as to intervene between the developer-carrying body and the developer transport body. The spacer members are configured to be able to determine the distance between the developer-carrying surface and the developer transport surface at the developing position. The spacer members are disposed in such a manner as to face portions of the developer-carrying body which are located outwardly of the developer-carrying surface with respect to the main scanning direction.

According to the above configuration, when the developer-carrying surface moves along the sub-scanning direction, the spacer members face portions of the developer-carrying body which are located outwardly of the developer-carrying surface with respect to the main scanning direction. Thus, the distance between the developer-carrying surface and the developer transport surface at the developing position is determined.

According to the developer electric field transport device having the above configuration, there can be effectively restrained a problem in that, when the developer-carrying surface moves along the sub-scanning direction, the spacer members scratch or wear the developer-carrying surface. Because of effective restraint of variation in positional relation between the developer transport surface and the developer-carrying surface caused by wear or the like of the developer-carrying surface, the quality of a formed image can be stabilized. The first and second developer transport guide members may be configured to be able to restrain deposition of the developer on their top surfaces. The top surfaces are opposite those surfaces (bottom surfaces) which face the developer transport surface. Specifically, for example, the first and second developer transport guide members can be configured such that the top surfaces touch a developer containing casing which is a box-like member to cover the developer electric field transport device. Alternatively, the top surfaces can be formed into slopes such that the developer thereon slips down toward an intermediate portion of the developer transport surface.

According to the developer electric field transport device having the above configuration, the stagnation of the developer on the top surfaces of the first and second developer transport guide members can be restrained to the greatest possible extent. The developer electric field transport device may further comprise a plurality of counter electrodes, and the first and second developer transport guide members may intervene between the developer transport surface and the counter electrodes. The counter electrodes are configured to have their longitudinal direction intersecting with the sub-scanning direction. The counter electrodes are disposed in such a manner as to face the developer transport surface with a predetermined gap therebetween. The plurality of counter electrodes is arrayed along the developer transport direction.

In the developer electric field transport device having the above configuration, through application of predetermined voltages, predetermined traveling-wave electric fields are generated on the plurality of counter electrodes and on the plurality of transport electrodes. Thus, the charged developer can be transported more smoothly on the developer transport surface. In the developer electric field transport device, the first and second developer transport guide members may be formed of an elastic material. For example, the first and second developer transport guide members can be formed of foamed sponge or rubber. The first and second developer transport guide members, for example, can intervene in a compressed condition between the developer containing casing and the opposite end portions of the developer transport body.

According to the developer electric field transport device having the above configuration, transport of the developer can be more reliably guided within the upstream developer transport area and within the downstream developer transport area. Also, the stagnation of the developer on the top surfaces of the first and second developer transport guide members can be more effectively restrained. Thus, for example, there can be more effectively restrained leakage of the developer to the exterior of the developer electric field transport device in the vicinity of end portions, with respect to the main scanning direction, of the developer-carrying body.

[3]

(1) An image forming apparatus of the present invention comprises an electrostatic-latent-image carrying body and a developer feed device.

The electrostatic-latent-image carrying body has a latent-image forming surface. The latent-image forming surface is configured to be able to form an electrostatic latent image thereon by means of electric-potential distribution. The latent-image forming surface is formed in parallel with a predetermined main scanning direction. The electrostatic-latent-image carrying body is configured such that the latent-image forming surface can move along a sub-scanning direction orthogonal to the main scanning direction.

The developer feed device is disposed in such a manner as to face the electrostatic-latent-image carrying body. The developer feed device is configured to be able to feed the latent-image forming surface with a developer in a charged state. Specifically, the developer feed device comprises a plurality of transport electrodes, an electricity supply wiring section, a developer transport body, a pair of developer transport guide members, and a developer containing casing.

The plurality of transport electrodes are arrayed in a predetermined developer transport direction along the sub-scanning direction. The transport electrodes are configured to have their longitudinal direction intersecting with the sub-scanning direction. Specifically, for example, the transport electrodes can be configured to have their longitudinal direction parallel to the main scanning direction orthogonal to the sub-scanning direction. The developer transport direction can be set in parallel with the sub-scanning direction.

The electricity supply wiring section is connected to root portions of the transport electrodes. The root portions are one end portions of the transport electrodes with respect to the longitudinal direction. That is, the transport electrodes and the electricity supply wiring section form a predetermined wiring pattern. End portions of the transport electrodes opposite the root portions (other end portions opposite the one end portions with respect to the longitudinal direction); i.e., distal end portions of the transport electrodes, serve as ends of the wiring pattern.

The developer transport body has a developer transport surface parallel to the main scanning direction. The transport electrodes and the electricity supply wiring section are provided on the developer transport body along the developer transport surface. That is, the predetermined wiring pattern composed of the transport electrodes and the electricity supply wiring section is provided on the developer transport body along the developer transport surface.

The developer transport body is disposed such that the developer transport surface faces the electrostatic-latent-image carrying body. The developer transport body is configured to be able to transport the developer along the developer transport direction by means of traveling-wave electric fields which are generated on the developer transport surface through application of predetermined transport voltages to the plurality of transport electrodes.

The pair of developer transport guide members is provided on the developer transport surface at opposite end portions, with respect to a width direction perpendicular to the developer transport direction, of the developer transport body. The developer transport guide members are configured to define an areal range within which the developer is transported on the developer transport surface along the developer transport direction.

The developer containing casing is a box-like member configured to be able to cover the developer transport body and the developer transport guide members and to contain the developer therein. The developer containing casing has an opening portion. The opening portion is provided at a position where the electrostatic-latent-image carrying body and the developer transport surface face each other.

The present invention is characterized in the following: the developer transport guide members are provided inwardly, with respect to the width direction, of the root portions and distal end portions of the transport electrodes, the distal end portions being opposite the root portions, in such a manner as to project toward a surface of the developer containing casing in which the opening portion is formed. The developer transport guide members are configured and disposed so as to be able to restrain outward leakage of the developer beyond the developer transport guide members with respect to the width direction by means of their above-mentioned projecting feature.

The image forming apparatus of the present invention having the above configuration operates as described below in formation of an image.

The latent-image forming surface on which the electrostatic latent image is formed moves along the sub-scanning direction. The developer feed device feeds the developer in a charged state to the latent-image forming surface on which the electrostatic latent image is formed. The developer is transported on the developer transport surface along a predetermined developer transport direction (along the sub-scanning direction along which the plurality of transport electrodes is arrayed). By this procedure, the electrostatic latent image is developed (rendered visible) with the developer.

The above-mentioned transport of the developer on the developer transport surface is effected through formation of predetermined traveling-wave electric fields in the vicinity of the plurality of transport electrodes. The electric fields are formed through application of predetermined voltages to the plurality of transport electrodes via the electricity supply wiring section.

Traveling-wave electric fields along the developer transport direction are formed in a good condition on portions (intermediate portions) of the transport electrodes located inwardly, with respect to the width direction, of the distal end portions and the root portions. By contrast, good traveling-wave electric fields are hard to form (or are not formed) on the distal end portions and the root portions of the transport electrodes and on the electricity supply wiring section.

In the image forming apparatus of the present invention, the developer transport guide members project at positions located inwardly, with respect to the width direction, of the distal end portions and the root portions of the transport electrodes. That is, the developer transport guide members are provided in a standing condition along outer edges, with respect to the width direction, of the intermediate portions of the transport electrodes. Thus, the developer transport guide members restrain leakage of the developer to the above-mentioned regions where good traveling-wave electric fields are hard to form.

Thus, the image forming apparatus of the present invention can implement smooth transport of the charged developer on the developer transport surface by means of a simple apparatus configuration. Therefore, the stagnation of the developer on the developer transport surface can be restrained to the greatest possible extent by means of a simple apparatus configuration. In the image forming apparatus, the developer transport guide members may be configured to be able to restrain deposition of the developer on their top surfaces opposite their surfaces which face the developer transport surface. Specifically, for example, the developer transport guide members can be configured such that their top surfaces touch the developer containing casing. Alternatively, for example, the top surfaces can be formed into slopes such that the developer thereon slips down toward an intermediate portion of the developer transport surface.

According to the image forming apparatus having the above configuration, the stagnation of the developer on the top surfaces of the developer transport guide members can be restrained to the greatest possible extent. The image forming apparatus may further comprise a plurality of counter electrodes, and the developer transport guide members may intervene between the developer transport surface and the counter electrodes.

The plurality of counter electrodes is arrayed along the developer transport direction. The counter electrodes are configured to have their longitudinal direction intersecting with the sub-scanning direction. For example, the counter electrodes can be configured to have their longitudinal direction parallel to the main scanning direction orthogonal to the sub-scanning direction. Alternatively, the counter electrodes can be formed in parallel with the transport electrodes. The counter electrodes are disposed in such a manner as to face the developer transport surface with a predetermined gap therebetween.

In the image forming apparatus having the above configuration, through application of predetermined voltages, predetermined traveling-wave electric fields are generated on the plurality of counter electrodes and on the plurality of transport electrodes. Thus, the charged developer can be transported smoothly on the developer transport surface. In the image forming apparatus, the developer transport guide members may be formed of an elastic material. For example, the developer transport guide members can be formed of foamed sponge or rubber.

The developer transport guide members which are formed of such an elastic material can intervene in a compressed condition between the developer containing casing and the opposite end portions of the developer transport body.

According to the image forming apparatus having the above configuration, leakage of the developer to the above-mentioned regions where good traveling-wave electric fields are hard to form can be more effectively restrained.

(2) A developer feed device of the present invention is configured to be able to feed a developer in a charged state to a developer-carrying surface of a developer-carrying body. The developer-carrying surface is a surface which is parallel to a predetermined main scanning direction and which can carry the developer thereon.

The developer-carrying body has the developer-carrying surface and is configured to be able to move along a sub-scanning direction orthogonal to the main scanning direction. The developer-carrying body can be, for example, an electrostatic-latent-image carrying body having a latent-image forming surface configured to be able to form an electrostatic latent image thereon by means of electric-potential distribution. Alternatively, the developer-carrying body can be, for example, a recording medium (paper) which is transported along the sub-scanning direction. Alternatively, the developer-carrying body can be, for example, a roller, a sleeve, or a belt member (an intermediate transfer belt, a developing roller, a developing sleeve, etc.) which is configured and disposed so as to be able to transfer the developer onto the recording medium or the electrostatic-latent-image carrying body by means of facing the recording medium or the electrostatic-latent-image carrying body.

The developer feed device of the present invention comprises a plurality of transport electrodes, an electricity supply wiring section, a developer transport body, a pair of developer transport guide members, and a developer containing casing.

The plurality of transport electrodes are arrayed in a predetermined developer transport direction along the sub-scanning direction. The transport electrodes are configured to have their longitudinal direction intersecting with the sub-scanning direction.

The electricity supply wiring section is connected to root portions of the transport electrodes. The root portions are one end portions of the transport electrodes with respect to the longitudinal direction.

The developer transport body has a developer transport surface parallel to the main scanning direction. The transport electrodes and the electricity supply wiring section are provided on the developer transport body along the developer transport surface. The developer transport body is disposed such that the developer transport surface faces the developer-carrying body. The developer transport body is configured to be able to transport the developer along the developer transport direction by means of traveling-wave electric fields which are generated on the developer transport surface through application of predetermined transport voltages to the plurality of transport electrodes.

The pair of developer transport guide members is provided on the developer transport surface at opposite end portions, with respect to a width direction perpendicular to the developer transport direction, of the developer transport body. The developer transport guide members are configured to define an areal range within which the developer is transported on the developer transport surface along the developer transport direction.

The developer containing casing is a box-like member configured to be able to cover the developer transport body and the developer transport guide members and to contain the developer therein. The developer containing casing has an opening portion. The opening portion is provided at a position where the developer-carrying body and the developer transport surface face each other.

The present invention is characterized in the following: the developer transport guide members are provided inwardly, with respect to the width direction, of the root portions and distal end portions of the transport electrodes, the distal end portions being opposite the root portions, in such a manner as to project toward a surface of the developer containing casing in which the opening portion is formed. The developer transport guide members are configured and disposed so as to be able to restrain outward leakage of the developer beyond the developer transport guide members with respect to the width direction by means of their above-mentioned projecting feature.

In the developer feed device of the present invention having the above configuration, the developer is fed in a charged state to a position where the developer-carrying surface (the developer-carrying body), which moves along the sub-scanning direction, and the developer transport surface (the developer transport body) face each other. By this procedure, the developer can be fed to the developer-carrying surface of the developer-carrying body.

At this time, the developer is transported on the developer transport surface along a predetermined developer transport direction along the sub-scanning direction, along which the plurality of transport electrodes are arrayed, while being guided by the developer transport guide members. Such transport of the developer on the developer transport surface is carried out through application of predetermined voltages to the plurality of transport electrodes via the electricity supply wiring section.

Traveling-wave electric fields along the developer transport direction are formed in a good condition on portions (intermediate portions) of the transport electrodes between the distal end portions and the root portions. By contrast, good traveling-wave electric fields are hard to form on the distal end portions and the root portions of the transport electrodes and on the electricity supply wiring section.

However, in the developer feed device of the present invention, the developer transport guide members are provided in a standing condition along outer edges of the intermediate portions of the transport electrodes. Therefore, the developer transport guide members can effectively restrain leakage of the developer to the above-mentioned regions where good traveling-wave electric fields are hard to form.

Thus, the developer feed device of the present invention can implement smooth transport of the charged developer on the developer transport surface by means of a simple apparatus configuration. Therefore, the stagnation of the developer on the developer transport surface can be restrained to the greatest possible extent by means of a simple apparatus configuration. In the developer feed device, the developer transport guide members may be configured to be able to restrain deposition of the developer on their top surfaces opposite their surfaces which face the developer transport surface. Specifically, for example, the developer transport guide members can be configured such that their top surfaces touch the developer containing casing.

According to the developer feed device having the above configuration, the stagnation of the developer on the top surfaces of the developer transport guide members can be restrained to the greatest possible extent. The developer feed device may further comprise a plurality of counter electrodes, and the developer transport guide members may intervene between the developer transport surface and the counter electrodes.

The plurality of counter electrodes is arrayed along the developer transport direction. The counter electrodes are configured to have their longitudinal direction intersecting with the sub-scanning direction. For example, the counter electrodes can be configured to have their longitudinal direction parallel to the main scanning direction orthogonal to the sub-scanning direction. Alternatively, the counter electrodes can be formed in parallel with the transport electrodes. The counter electrodes are disposed in such a manner as to face the developer transport surface with a predetermined gap therebetween.

In the developer feed device having the above configuration, through application of predetermined voltages, predetermined traveling-wave electric fields are generated on the plurality of counter electrodes and on the plurality of transport electrodes. Thus, the charged developer can be transported smoothly on the developer transport surface. In the developer feed device, the developer transport guide members may be formed of an elastic material. For example, the developer transport guide members can be formed of foamed sponge or rubber. The developer transport guide members, for example, can intervene in a compressed condition between the developer containing casing and the opposite end portions of the developer transport body.

According to the developer feed device having the above configuration, leakage of the developer to the above-mentioned regions where good traveling-wave electric fields are hard to form can be more effectively restrained.

(3) A developer electric field transport device of the present invention is configured to be able to transport a charged developer by means of electric fields. Specifically, the developer electric field transport device comprises a plurality of transport electrodes, an electricity supply wiring section, a developer transport body, and a pair of developer transport guide members.

The plurality of transport electrodes are arrayed in a predetermined developer transport direction along a sub-scanning direction. The sub-scanning direction is a moving direction of a developer-carrying body which carries the developer thereon. The transport electrodes are configured to have their longitudinal direction intersecting with the sub-scanning direction.

The electricity supply wiring section is connected to root portions of the transport electrodes. The root portions are one end portions of the transport electrodes with respect to the longitudinal direction.

The developer transport body has a developer transport surface parallel to a main scanning direction. The main scanning direction is orthogonal to the sub-scanning direction. The transport electrodes and the electricity supply wiring section are provided on the developer transport body along the developer transport surface. The developer transport body is disposed such that the developer transport surface faces the developer-carrying body. The developer transport body is configured to be able to transport the developer along the developer transport direction by means of traveling-wave electric fields which are generated on the developer transport surface through application of predetermined transport voltages to the plurality of transport electrodes.

The pair of developer transport guide members is provided on the developer transport surface at opposite end portions, with respect to a width direction perpendicular to the developer transport direction, of the developer transport body. The developer transport guide members are configured and disposed so as to define an areal range within which the developer is transported on the developer transport surface along the developer transport direction.

The present invention is characterized in the following: the developer transport guide members are provided inwardly, with respect to the width direction, of the root portions and distal end portions of the transport electrodes, the distal end portions being opposite the root portions. The developer transport guide members are configured to be able to restrain outward leakage of the developer beyond the developer transport guide members with respect to the width direction.

In the developer electric field transport device of the present invention having the above configuration, the charged developer is transported toward a position where the developer-carrying surface (the developer-carrying body), which moves along the sub-scanning direction, and the developer transport surface (the developer transport body) face each other. Thus, the developer is transported on the developer transport surface along a predetermined developer transport direction along the sub-scanning direction, along which the plurality of transport electrodes are arrayed, while being guided by the developer transport guide members. By this procedure, the developer is fed to the developer-carrying surface of the developer-carrying body.

The above-mentioned transport of the developer on the developer transport surface is carried out through application of predetermined voltages to the plurality of transport electrodes via the electricity supply wiring section. At this time, traveling-wave electric fields along the developer transport direction are formed in a good condition on portions (intermediate portions) of the transport electrodes between the distal end portions and the root portions. By contrast, good traveling-wave electric fields are hard to form on the distal end portions and the root portions of the transport electrodes and on the electricity supply wiring section.

However, leakage of the developer to the regions where good traveling-wave electric fields are hard to form are effectively restrained by the developer transport guide members adapted to define an areal range on the developer transport surface within which the developer is transported.

Thus, the developer electric field transport device of the present invention can implement smooth transport of the charged developer on the developer transport surface by means of a simple apparatus configuration. Therefore, the stagnation of the developer on the developer transport surface can be restrained to the greatest possible extent by means of a simple apparatus configuration. In the developer electric field transport device, the developer transport guide members may be configured to be able to restrain deposition of the developer on their top surfaces opposite their surfaces which face the developer transport surface.

According to the developer electric field transport device having the above configuration, the stagnation of the developer on the top surfaces of the developer transport guide members can be restrained to the greatest possible extent. In the developer electric field transport device, the developer transport guide members may be formed of an elastic material. For example, the developer transport guide members can be formed of foamed sponge or rubber.

BEST MODE FOR CARRYING OUT THE INVENTION

Embodiments of the present invention (embodiments which the applicant contemplated as the best at the time of filing the present application) will next be described with reference to the drawings.

[1]

First, a first embodiment of the present invention will be described.

<Overall Configuration of Laser Printer>

Figure 1:
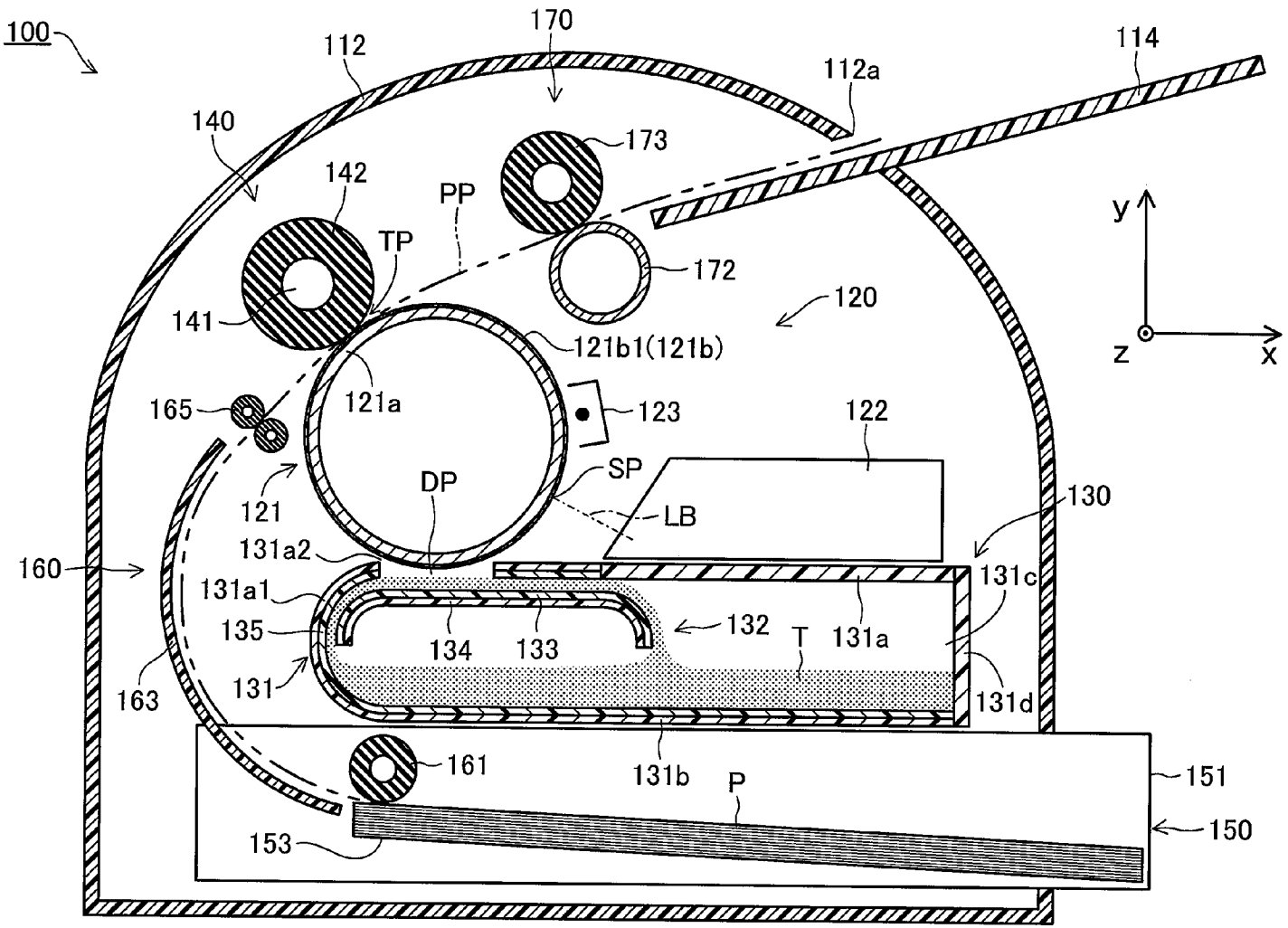
FIG. 1 is a side sectional view showing the schematic configuration of a laser printer to which an embodiment of the present invention is applied.

FIG. 1 is a side sectional view showing the schematic configuration of a laser printer 100 to which the first embodiment of the present invention is applied.

In FIG. 1, the alternate-long-and-two-short-dashes line indicates a paper path PP along which a paper P is transported. The paper P serves as a recording medium on which an image is formed. A direction tangent to the paper path PP is called the paper transport direction.

In FIG. 1, an x-axis direction is called the front-rear direction. With respect to the front-rear direction, a side toward one end of the laser printer 100 (right side in FIG. 1) is called the "front" side. A side toward the other end, opposite the one end, of the laser printer 100 (left side in FIG. 1) is called the "rear" side. Furthermore, a direction orthogonal to a height direction (y-axis direction in FIG. 1) of the laser printer 100, to the paper transport direction, and to the front-rear direction is called the paper width direction (z-axis direction in FIG. 1), which corresponds to the "width direction" in the present invention.

<<Body Section>>

Referring to FIG. 1, the laser printer 100 includes a body casing 112 and corresponds to the image forming apparatus of the present invention. The body casing 112 is an outer cover of the laser printer 100 and is integrally formed from a synthetic resin plate. The body casing 112 has a paper ejection port 112*a* in the form of a slit-like through-hole located at an upper front portion thereof.

A catch tray 114 is attached to an upper front portion of the body casing 112 at a position corresponding to the paper ejection port 112*a*. The catch tray 114 is configured to receive the paper P which is ejected through the paper ejection port 112*a* and on which an image has been formed.

<<Electrostatic-Latent-Image Forming Section>>

The body casing 112 houses an electrostatic-latent-image forming section 120. The electrostatic-latent-image forming section 120 includes a photoconductor drum 121, which corresponds to the electrostatic-latent-image carrying body and the developer carrying body of the present invention.

The photoconductor drum 121 is a generally cylindrical member and is disposed such that its center axis of rotation is in parallel with the paper width direction. The photoconductor drum 121 is configured to be able to be rotatably driven clockwise in FIG. 1.

Specifically, the photoconductor drum 121 includes a drum body 121*a* and a photoconductor layer 121*b*.

The drum body 121*a* is a metal tube of an aluminum alloy or the like. The photoconductor layer 121*b* is a positively charged photoconductive layer and is formed on the outer circumference of the drum body 121*a*.

The photoconductor drum 121 has an image carrying surface 121*b*1, which corresponds to the latent-image forming surface and the developer-carrying surface of the present invention. The circumferential surface of the photoconductor layer 121*b* serves as the image carrying surface 121*b*1. The image carrying surface 121*b*1 is formed in parallel with the paper width direction and a main scanning direction, which will be described later. The image carrying surface 121*b*1 is configured such that an electrostatic latent image can be formed by electric-potential distribution.

That is, the photoconductor drum 121 is configured such that the image carrying surface 121*b*1 can move along a sub-scanning direction, which is orthogonal to the main scanning direction and will be described later.

The electrostatic-latent-image forming section 120 includes a scanner unit 122 and a charger 123.

The scanner unit 122 is configured and disposed such that the image carrying surface 121*b*1 can be irradiated at a predetermined scanning position SP with a laser beam LB having a predetermined wavelength and modulated on the basis of image information while the laser beam LB is scanning along the main scanning direction (z-axis direction in FIG. 1) parallel to the paper width direction. The charger 123 is disposed upstream of the scanning direction SP with respect to the direction of movement of the image carrying surface 121*b*1 (direction of rotation of the photoconductor drum 121). The charger 123 is configured and disposed so as to be able to uniformly, positively charge the image carrying surface 121*b*1 at a position located upstream of the scanning position SP with respect to the above-mentioned direction.

The electrostatic-latent-image forming section 120 is configured such that the scanner unit 122 irradiates, with the laser beam LB, the image carrying surface 121*b*1 which is uniformly, positively charged by the charger 123, whereby an electrostatic latent image by electric-potential distribution (charge distribution) can be formed on the image carrying surface 121*b*1. The electrostatic-latent-image forming section 120 is configured to be able to move the image carrying surface 121*b*1 on which an electrostatic latent image is formed, along the sub-scanning direction, which will be described later.

The "sub-scanning direction" is an arbitrary direction orthogonal to the main scanning direction. Usually, the sub-scanning direction is a direction which intersects a vertical line. That is, the sub-scanning direction is a direction along the front-rear direction of the laser printer 100 (x-axis direction in FIG. 1).

<<Developing Device>>

The body casing 112 houses a developing device 130, which corresponds to the developer feed device and the developer electric field transport device of the present invention. The developing device 130 is disposed in such a manner as to face the photoconductor drum 121 at a developing position DP.

The developing device 130 is configured and disposed as described below so as to be able to feed the image carrying surface 121*b*1 on which an electrostatic latent image is formed, with a toner T in a charged state in the vicinity of the developing position DP. The toner T is a dry developer in the form of particles (powder developer). Notably, the toner T used in the present embodiment is a non-magnetic 1-component developer for use in electrophotography.

Figure 2:
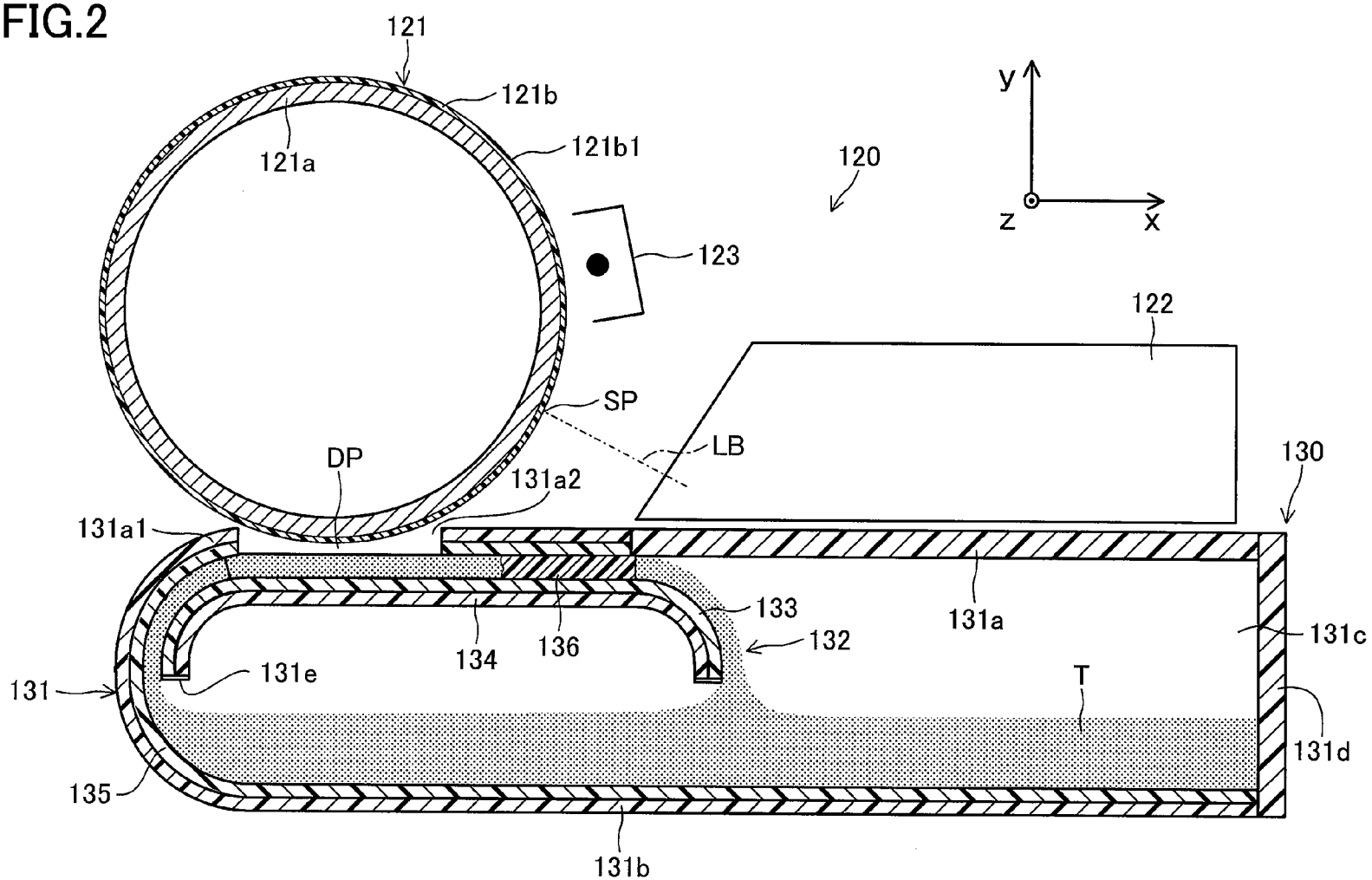
FIG. 2 is an enlarged side sectional view showing an electrostatic-latent-image forming section shown in FIG. 1 and a developing device according to a first embodiment of the present invention.

FIG. 2 is an enlarged side sectional view showing the electrostatic-latent-image forming section 120 shown in FIG. 1 and the developing device 130 according to the first embodiment of the present invention.

Referring to FIGS. 1 and 2, the developing device 130 is disposed below the photoconductor drum 121 in such a manner as to face the image carrying surface 121*b*1 at a position located downstream of the scanning position SP with respect to the direction of movement of the image carrying surface 121*b*1.

<<<Developing Casing>>>

A developing casing 131 is a box-like member and is configured to be able to contain the toner T therein. The developing casing 131 corresponds to the developer containing casing of the present invention.

A developing-section counter plate 131*a*1 is a rear portion of a casing top cover 131*a*, which serves as the ceiling of the developing casing 131. The developing-section counter plate 131*a*1 has a developing opening portion 131*a*2, which corresponds to the opening portion of the present invention. The developing opening portion 131*a*2 is provided in the developing-section counter plate 131*a*1 at a position facing the image carrying surface 121*b*1.

A casing bottom plate 131*b*, which serves as the bottom plate of the developing casing 131, and the developing-section counter plate 131*a*1 are formed integrally with each other in such a manner as to have a cross-sectional shape resembling the letter U at the rear end portion of the developing casing 131. A pair of casing side plates 131*c* is closingly attached to the opposite ends, with respect to the paper width direction, of the casing top cover 131*a* and to those of the casing bottom plate 131*b*. Also, a casing front blind plate 131*d* is closingly attached to the front end of the casing top cover 131*a*, to that of the casing bottom plate 131*b*, and to those of the paired casing side plates 131*c*.

<<<Developer Electric Field Transport Body>>>

Referring to FIG. 2, an engagement groove 131*e* is formed on the inner surface (a surface that faces a space where the toner T is contained) of each of the casing side plates 131*c*. The engagement groove 131*e* is formed in a shape resembling the inverted letter U as viewed from the lateral direction.

The developing casing 131 houses a toner electric field transport body 132, which corresponds to the developer transport body of the present invention. That is, the toner electric field transport body 132 is enclosed within the developing casing 131.

The toner electric field transport body 132 is disposed in the inner space of the developing casing 131 at a rearward position, in such a manner as to face the image carrying surface 121*b*1 with the developing opening portion 131*a*2 therebetween. That is, the toner electric field transport body 132 is provided such that the photoconductor drum 121 and the toner electric field transport body 132 face each other with the developing opening portion 131*a*2 therebetween.

The opposite ends of the toner electric field transport body 132 are fitted into the respective engagement grooves 131*e* formed on the paired casing side plates 131*c*. Thus, the toner electric field transport body 132 is supported at a position located above the casing bottom plate 131*b* while facing the developing-section counter plate 131*a*1 with a predetermined gap therebetween.

Figure 3:
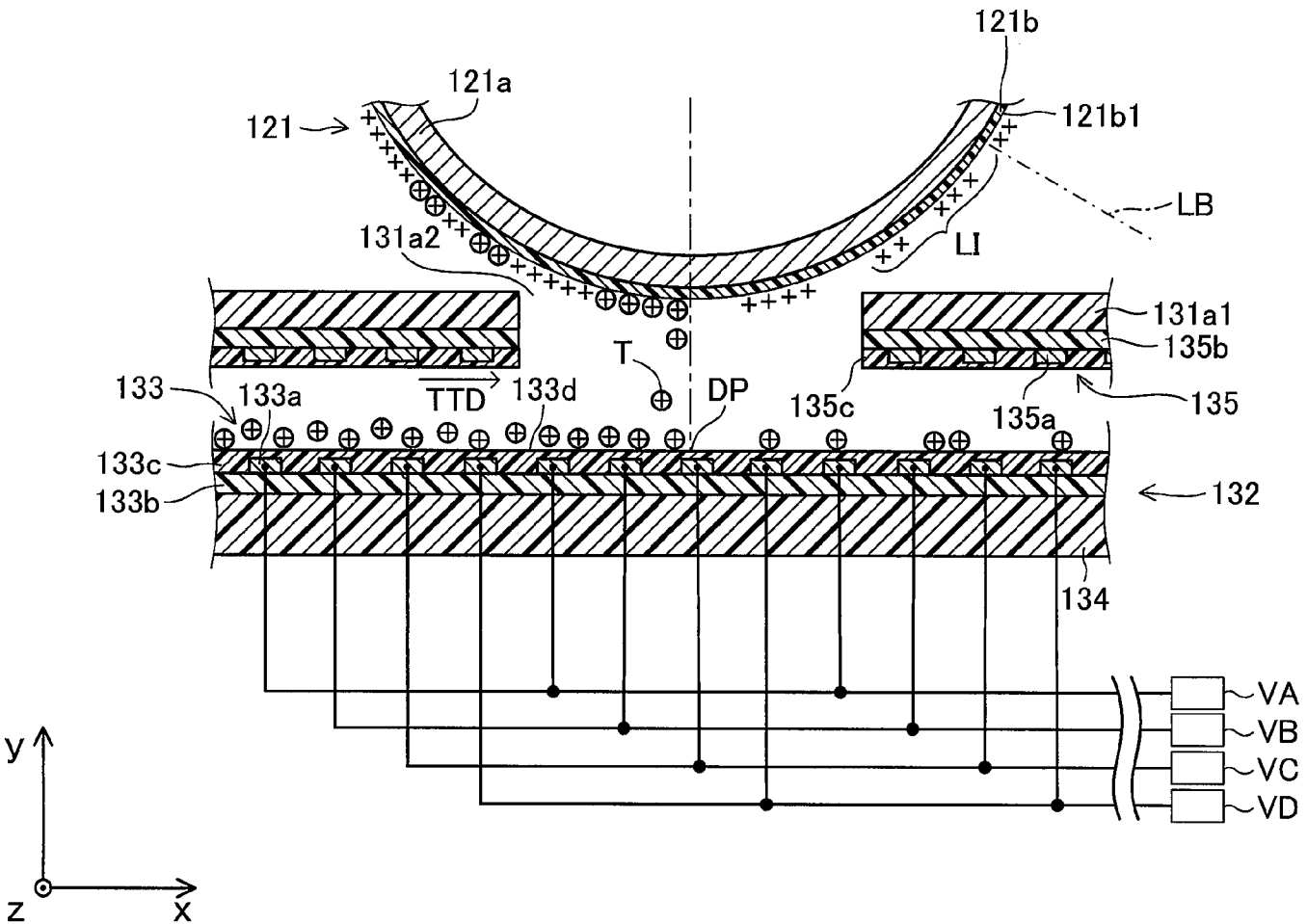
FIG. 3 is an enlarged side sectional view showing a developing opening portion and its periphery of a developer electric field transport body shown in FIG. 2.

FIG. 3 is an enlarged side sectional view showing a portion of the toner electric field transport body 132 (shown in FIG. 2) in the vicinity of the developing opening portion 131*a*2. Referring to FIGS. 2 and 3, the toner electric field transport body 132 includes a transport wiring substrate 133. The transport wiring substrate 133 is disposed in such a manner as to face the image carrying surface 121*b*1 with the developing opening portion 131*a*2 therebetween.

Referring to FIG. 3, the transport wiring substrate 133 is a printed wiring substrate and includes a plurality of transport electrodes 133*a*, a transport-electrode support substrate 133*b*, and a transport-electrode coating layer 133*c*.

The transport electrodes 133*a* are formed of a copper foil having a thickness of about several tens of micrometers and are provided on the transport-electrode support substrate 133*b*. The transport electrodes 133*a* are formed in a strip-like wiring pattern such that their longitudinal direction is parallel to the main scanning direction (orthogonal to the sub-scanning direction). The plurality of transport electrodes 133*a* are disposed in parallel with one another and are arrayed along a predetermined toner transport direction TTD, which is parallel to the sub-scanning direction (x-axis direction in FIG. 3).

A large number of the transport electrodes 133*a* arrayed along the sub-scanning direction are connected to power supply circuits such that every fourth transport electrode 133*a* is connected to the same power supply circuit. That is, the transport electrode 133*a* connected to a power supply circuit VA, the transport electrode 133*a* connected to a power supply circuit VB, the transport electrode 133*a* connected to a power supply circuit VC, the transport electrode 133*a* connected to a power supply circuit VD, the transport electrode 133*a* connected to the power supply circuit VA, the transport electrode 133*a* connected to the power supply circuit VB, . . . , are sequentially arrayed along the sub-scanning direction.

The transport-electrode support substrate 133*b* is a flexible film of an electrically insulative synthetic resin, such as polyimide resin. The surface of the transport-electrode support substrate 133*b* on which the transport electrodes 133*a* are formed is covered with the transport-electrode coating layer 133*c*.

The transport-electrode coating layer 133*c* covers the transport-electrode support substrate 133*b* and the transport electrodes 133*a*, thereby forming a smooth toner transport surface 133*d*, which corresponds to the developer transport surface of the present invention. The toner transport surface 133*d* is the surface of the transport wiring substrate 133 which faces the image carrying surface 121*b*1, and is formed in parallel with the main scanning direction (z-axis direction in FIG. 3). The toner transport surface 133*d* and the image carrying surface 121*b*1 are in the closest proximity to each other at the developing position DP. The transport electrodes 133*a* are provided along the toner transport surface 133*d*.

Referring to FIGS. 2 and 3, the toner electric field transport body 132 includes a transport-substrate support member 134. The transport-substrate support member 134 is provided so as to support the transport wiring substrate 133 from underneath.

Referring to FIG. 2, a rear end portion of the transport-substrate support member 134 is curved downward along a rear end portion of the casing top cover 131*a* (developing-section counter plate 131*a*1) of the developing casing 131. Also, a front end portion of the transport-substrate support member 134 is curved downward in a manner similar to that of the rear end portion. A portion of the transport-substrate support member 134 between the above-mentioned front and rear portions assumes the form of a generally flat plate. That is, the transport-substrate support member 134 is formed in a shape resembling the inverted letter U as viewed from the lateral direction, the shape being generally similar to that of the engagement groove 131*e*.

Figure 4:
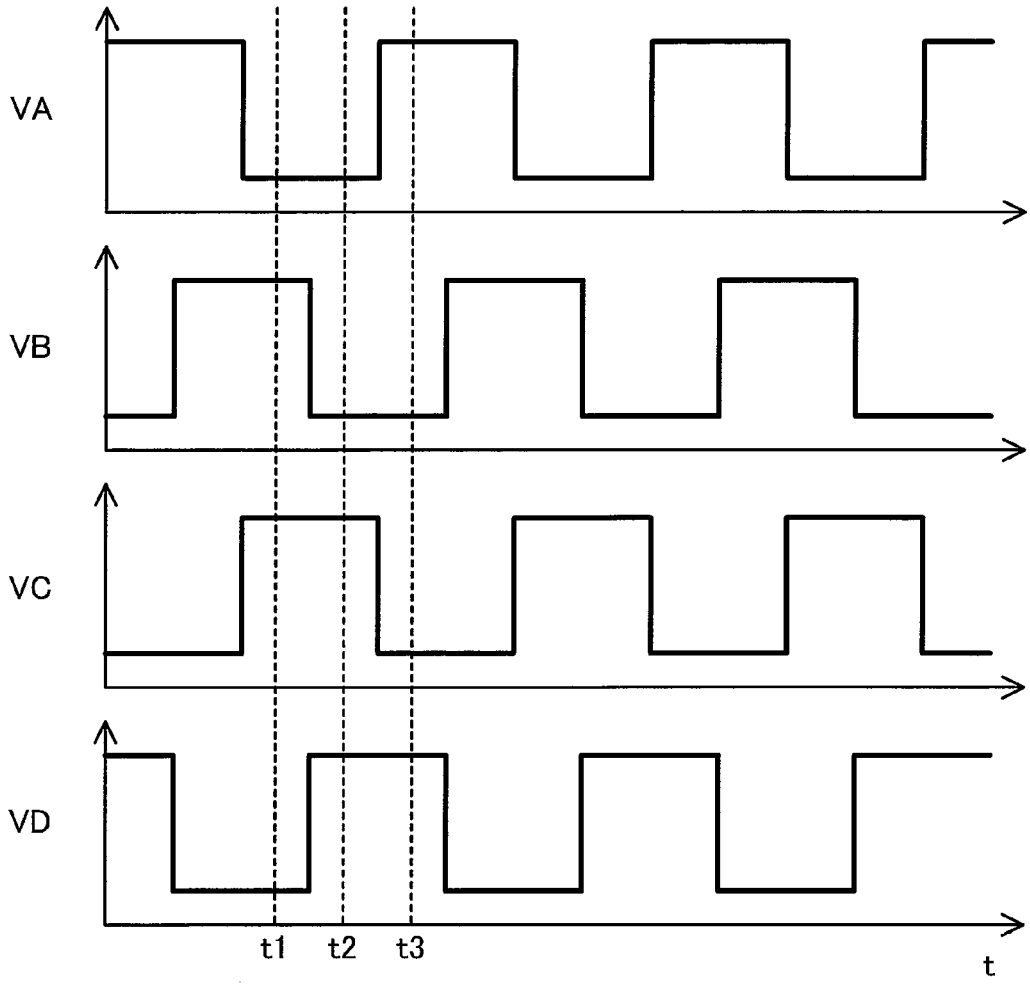
FIG. 4 is a set of graphs showing waveforms of voltages generated by power supply circuits shown in FIG. 3.

FIG. 4 is a set of graphs showing waveforms of voltages generated by the power supply circuits VA to VD shown in FIG. 3. As shown in FIG. 4, the power supply circuits VA to VD are configured to generate AC voltages of substantially the same waveform. The waveforms of voltages generated by the power supply circuits VA to VD shift 900 in phase from one another. An unillustrated control circuit controls the power supply circuits VA to VD such that, in the sequence of the power supply circuits VA to VD, the phase of voltage delays in increments of 90°.

Referring to FIGS. 2 and 3, the toner electric field transport body 132 is configured to be able to transport the toner T as follows. Transport voltages as shown in FIG. 4 are applied to the transport electrodes 133*a* of the transport wiring substrate 133, thereby generating traveling-wave electric fields along the toner transport direction TTD parallel to the sub-scanning direction. By this procedure, the positively charged toner T can be transported along the toner transport direction TTD.

Referring to FIGS. 1 and 2, a counter wiring substrate 135 is supported on the inner wall surfaces of the developing-section counter plate 131*a*1 and on that of the casing bottom plate 131*b*, That is, the counter wiring substrate 135 is supported on the inner wall surface of the developing-section counter plate 131*a*1 having the developing opening portion 131*a*2, in such a manner as to face the toner transport surface 133*d* with a predetermined gap therebetween. In the present embodiment, the counter wiring substrate 135 is provided along substantially the entire length of the casing bottom plate 131*b* along the front-rear direction.

The counter wiring substrate 135 has a configuration similar to that of the above-described transport wiring substrate 133. That is, referring to FIG. 3, the counter wiring substrate 135 includes a plurality of counter electrodes 135*a*, a counter-electrode support substrate 135*b*, and a counter-electrode coating layer 135*c*.

Specifically, similar to the transport electrodes 133*a*, the counter electrodes 135*a* have their longitudinal direction along the main scanning direction orthogonal to the sub-scanning direction. The plurality of counter electrodes 135*a* is disposed in parallel with one another. Furthermore, the plurality of counter electrodes 135*a* are arrayed along the toner transport direction TTD parallel to the sub-scanning direction.

Like the above-described transport wiring substrate 133, the counter wiring substrate 135 is configured to be able to transport the toner T as follows. Predetermined voltages are applied to the plurality of counter electrodes 135*a*, thereby generating traveling-wave electric fields along the toner transport direction TTD parallel to the sub-scanning direction. By this procedure, the positively charged toner T can be transported along the toner transport direction TTD.

<<<Toner Transport Guide Member>>>

Figure 5:
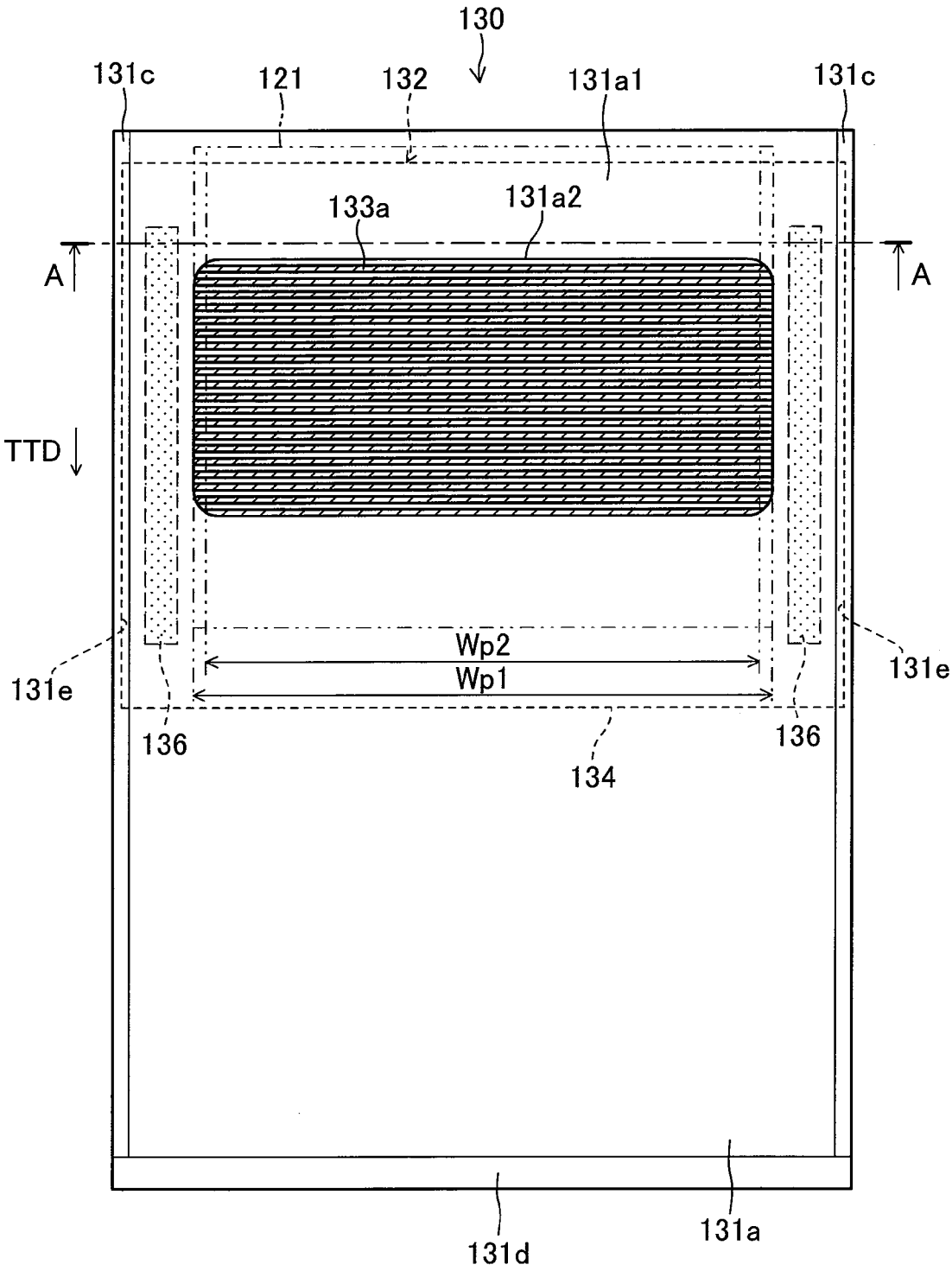
FIG. 5 is a plan view of a developing device shown in FIG. 2.
Figure 6:
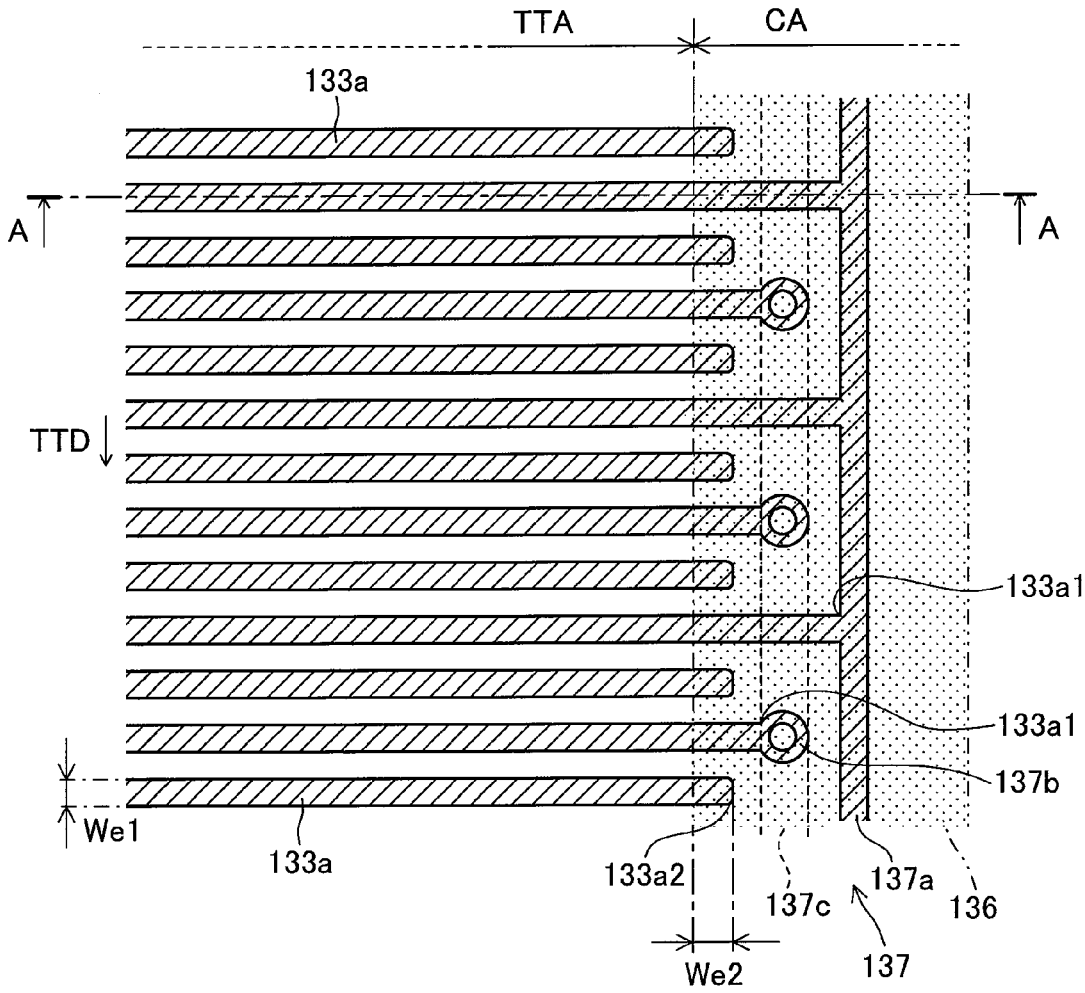
FIG. 6 is an enlarged plan view showing, in a see-through manner, end portions, with respect to a main scanning direction, of transport electrodes shown in FIG. 3, and their periphery.
Figure 7:
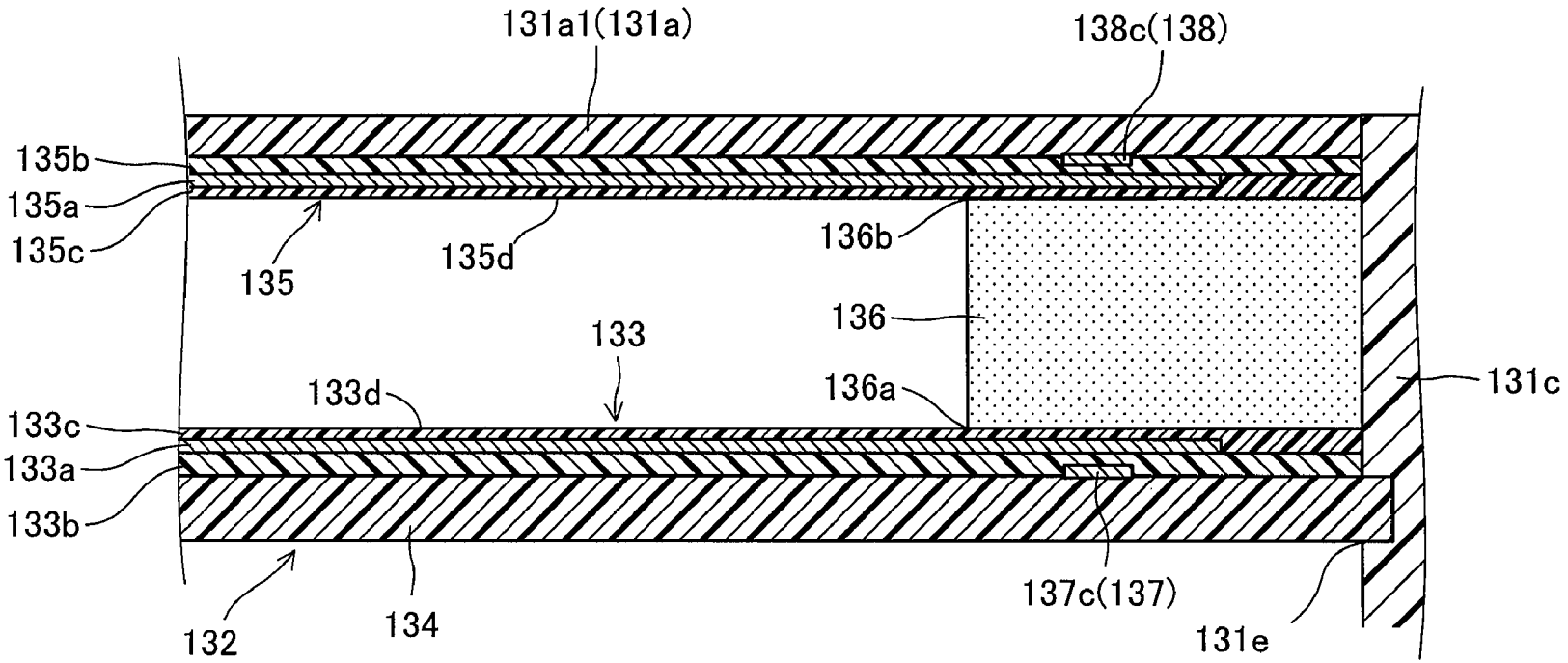
FIG. 7 is a sectional view taken along line A-A of FIGS. 5 and 6.
Figure 8:
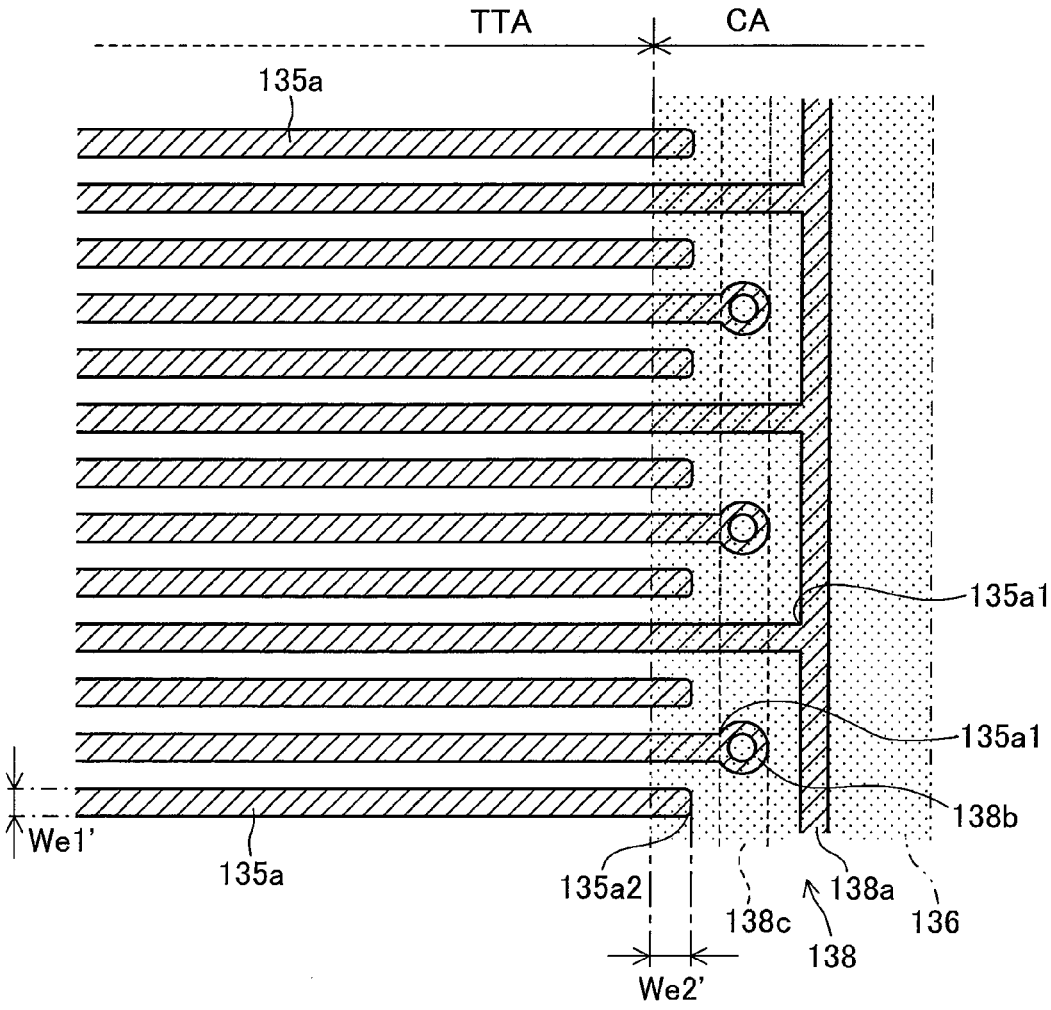
FIG. 8 is an enlarged plan view showing, in a see-through manner, end portions, with respect to the main scanning direction, of counter electrodes shown in FIG. 3, and their periphery.

FIG. 5 is a plan view of the developing device 130 shown in FIG. 2. FIG. 6 is an enlarged plan view showing, in a see-through manner, end portions, with respect to the main scanning direction, of the transport electrodes 133*a* shown in FIG. 3 and their periphery. FIG. 7 is a sectional view taken along line A-A of FIGS. 5 and 6. FIG. 8 is an enlarged plan view showing, in a see-through manner, end portions, with respect to the main scanning direction, of the counter electrodes 135*a* shown in FIG. 3 and their periphery.

Referring to FIG. 5, a pair of toner transport guide members 136 is provided at opposite end portions, with respect to the paper width direction (the main scanning direction), of the toner electric field transport body 132. The paired toner transport guide members 136 correspond to the cover members and to the developer transport guide members of the present invention. Each of the toner transport guide members 136 is formed of an elastic material; namely, single-bubble-type foamed sponge, and assumes the form of a bar-like member whose longitudinal direction coincides with the sub-scanning direction (vertical direction in FIG. 5). The length of the toner transport guide member 136 is determined so as to be sufficiently longer than that of the developing opening portion 131*a*2 as measured along the sub-scanning direction.

The distance between the inner ends of the paired toner transport guide members 136 along the paper width direction (the main scanning direction) is determined so as to be wider than a photoconductor-drum outline width Wp1 and a photoconductor-drum effective width Wp2. The photoconductor-drum outline width Wp1 is the width of the outline of the photoconductor drum 121 as measured along the main scanning direction. The photoconductor-drum effective width Wp2 is the width of an area of the photoconductor drum 121 in which an electrostatic latent image can be formed (the width of the photoconductor layer 121*b* shown in FIG. 2 as measured along the main scanning direction).

Referring to FIGS. 6 and 7, the toner transport guide members 136 are provided on the toner transport surface 133*d* at opposite end portions of the toner electric field transport body 132 with respect to the paper width direction (the main scanning direction) perpendicular to the toner transport direction TTD. The toner transport guide members 136 are configured to define an areal range within Which the toner T (see FIG. 3) is transported on the toner transport surface 133*d* along the toner transport direction TTD, by covering opposite end portions, with respect to the paper width direction (the main scanning direction), of the toner transport surface 133*d*.

A covered area CA in FIG. 6 is an area of the toner transport surface 133*d* which is covered by the toner transport guide member 136. A toner transport area TTA is an intermediate area of the toner transport surface 133*d* which lies between the covered areas CA located at opposite ends, with respect to the paper width direction (the main scanning direction), of the toner transport surface 133*d*. The toner transport guide members 136 are configured and disposed to be able to guide transport of the toner T (see FIG. 3) on the toner transport area TTA lying between the covered areas CA.

Referring to FIGS. 5 and 6, the toner transport area TTA is formed such that its width along the main scanning direction is wider than the photoconductor-drum outline width Wp1 and the photoconductor-drum effective width Wp2.

Referring to FIG. 7, a cover surface 136*a*; i.e., the bottom surface (a surface which faces the toner transport surface 133*d*), of the toner transport guide member 136 is fixed on the toner transport surface 133*d* by bonding or by means of double-sided adhesive tape. A top surface 136*b* of the toner transport guide member 136 opposite the cover surface 136*a* is in contact with the counter wiring substrate 135 under a predetermined pressure. That is, the toner transport guide members 136 intervene between the counter wiring substrate 135 supported on the casing top cover 131*a* (developing-section counter plate 131*a*1), and the opposite end portions, with respect to the main scanning direction, of the toner electric field transport body 132 (toner transport surface 133*d*) in a state of being elastically deformed under a predetermined pressure.

Referring to FIGS. 6 and 7, a transport-electrode electricity supply wiring section 137 is a wiring pattern for supplying electricity to the transport electrodes 133*a* and is formed of copper foil having a thickness of about several tens of micrometers. The transport-electrode electricity supply wiring section 137 corresponds to the electricity supply wiring section of the present invention. The transport-electrode electricity supply wiring section 137 is provided along the toner transport surface 133*d*.

The transport-electrode electricity supply wiring section 137 includes a transport-electrode electricity supply wiring pattern 137*a*, a plurality of through-holes 137*b*, and a through-hole electricity supply wiring pattern 137*c*.

The transport-electrode electricity supply wiring pattern 137*a* is provided, along the sub-scanning direction, on the same plane as that where the transport electrodes 133*a* reside (on the upper surface of the transport-electrode support substrate 133*b*). The transport-electrode electricity supply wiring pattern 137*a* is formed in such a manner as to be seamlessly integral with a root portion 133*a*1 of every fourth transport electrode 133*a* in an array of the transport electrodes 133*a* along the sub-scanning direction. The root portion 133*a*1 is one end portion of the transport electrode 133*a* with respect to the longitudinal direction of the transport electrode 133*a*, and a distal end portion 133*a*2 is the other end portion of the transport electrode 133*a*. The root portions 133*a*1 are disposed outwardly of the distal end portions 133*a*2 with respect to the longitudinal direction.

A large number of the through-holes 137*b* are arrayed along the sub-scanning direction. Each of the through-holes 137*b* is disposed between the transport electrodes 133*a* connected to the transport-electrode electricity supply wiring pattern 137*a*.

The through-hole electricity supply wiring pattern 137*c* is provided, along the sub-scanning direction, on the back surface (the surface opposite the aforementioned upper surface on which the transport electrodes 133*a* and the transport-electrode electricity supply wiring pattern 137*a* are formed) of the transport-electrode support substrate 133*b*. The through-holes 137*b* are formed such that each of the through-holes 137*b* is seamlessly integral with the root portion 133*a*1 of every corresponding fourth transport electrode 133*a* in an array of the transport electrodes 133*a* along the sub-scanning direction. The through-holes 137*b* are connected to the through-hole electricity supply wiring pattern 137*c* while extending through the transport-electrode support substrate 133*b*.

Referring to FIGS. 6 and 7, the toner transport guide member 136 entirely covers (physically covers) the root portions 133*a*1 and the distal end portions 133*a*2, which are longitudinally opposite end portions of the transport electrodes 133*a*, and the transport-electrode electricity supply wiring section 137 connected to the root portions 133*a*1.

When an electrode width We1 represents the width of the transport electrode 133*a* as measured along a direction perpendicular to the longitudinal direction and the thickness direction of the transport electrode 133*a*, and a covered width We2 represents the width of each of end portions of the transport electrode 133*a* covered by the tonner transport guide member 136, the covered width We2 is determined so as to be wider than the electrode width We1. That is, the toner guide member 136 covers the distal end portions 133*a*2 of the transport electrodes 133*a* over a range of the covered width We2, which is wider than the electrode width We1, extending longitudinally inward from the distal ends of the transport electrodes 133*a* (in FIG. 6, the right ends of the distal end portion 133*a*2).

Furthermore, similar to the end portions of the transport electrodes 133*a* and the transport-electrode electricity supply wiring section 137 as described above, end portions of the counter electrodes 135*a* and a counter-electrode electricity supply wiring section 138 for supplying electricity to the counter electrodes 135*a* are covered by the toner transport guide members 136.

Specifically, referring to FIGS. 7 and 8, a counter-electrode electricity supply wiring pattern 138*a* and a plurality of through-holes 138*b*, which constitute the counter-electrode electricity supply wiring section 138, are connected to root portions 135*a*1 of the counter electrodes 135*a*. The root portions 135*a*1 are one end portions of the counter electrodes 135*a* with respect to the longitudinal direction of the counter electrodes 135*a*. A through-hole electricity supply wiring pattern 138*c* electrically connects the through-holes 138*b* to one another. The root portions 135*a*1 are disposed outwardly of distal end portions 135*a*2, which are the other end portions of the counter electrodes 135*a* with respect to the longitudinal direction of the counter electrodes 135*a*.

The top surface 136*b* of the toner transport guide member 136 covers the root portions 135*a*1 and the distal end portions 135*a*2, which are opposite the root portions 135*a*1, of the counter electrodes 135*a*, and the counter-electrode electricity supply wiring section 138. When an electrode width We1' represents the width of the counter electrode 135*a* as measured along a direction perpendicular to the longitudinal direction and the thickness direction of the counter electrode 135*a*, and a covered width We2' represents the width of each of end portions of the counter electrode 135*a* covered by the tonner transport guide member 136, the covered width We2' is determined so as to be wider than the electrode width We1'.

That is, the toner guide member 136 covers the distal end portions 135*a*2 of the counter electrodes 135*a* over a range of the covered width We2', which is wider than the electrode width We1', extending longitudinally inward from the distal ends of the counter electrodes 135*a* (in FIG. 8, the right ends of the distal end portion 135*a*2).

As described above, the top surfaces 136*b* of the toner transport guide members 136 cover opposite end portions, with respect to the paper width direction (the main scanning direction), of a toner transport surface 135*d*, which is the surface (which faces the transport wiring substrate 133) of the counter-electrode coating layer 135*c* of the counter wiring substrate 135, thereby forming the pair of covered areas CA. An intermediate area of the toner transport surface 135*d* which lies between the paired covered areas CA is the toner transport area TTA on which the toner T (see FIG. 3) is transported.

<<Transfer Section>>

Referring again to FIG. 1, a transfer section 140 is provided in such a manner as to face the image carrying surface 121*b*1 at a position located downstream, with respect to the direction of rotation of the photoconductor drum 121, of the position where the photoconductor drum 121 and the developing device 130 face each other.

The transfer section 140 includes a rotary center shaft 141, which is a roller-like member and is made of metal, and a conductive rubber layer 142, which is circumferentially provided on the rotary center shaft 141. The rotary center shaft 141 is disposed in parallel with the main scanning direction (z-axis direction in FIG. 1). A high-voltage power supply is connected to the rotary center shaft 141. The conductive rubber layer 142 is configured such that conductive particles, such as carbon black, are kneadingly mixed into a synthetic rubber for establishing conduction or semiconduction.

The transfer section 140 is configured to be able to transfer the toner T from the image carrying surface 121*b*1 to the paper P by means of being rotatably driven counterclockwise while a predetermined transfer voltage is applied between the transfer section 140 and the drum body 121*a* of the photoconductor drum 121.

<<Paper Feed Cassette>>

A paper feed cassette 150 is disposed under the developing device 130. A paper feed cassette case 151 is a box-like member used to form the casing of the paper feed cassette 150 and opens upward. The paper feed cassette case 151 is configured to be able to contain a large number of sheets of the paper P of up to size A4 (210 mm width×297 mm length) in a stacked state.

A paper-pressing plate 153 is disposed within the paper feed cassette case 151. The paper-pressing plate 153 is supported by the paper feed cassette case 151 in such a manner as to pivotally move on a pivot at its front end portion, so that its rear end can move vertically in FIG. 1. An unillustrated spring urges the rear end portion of the paper-pressing plate 153 upward.

<<Paper Transport Section>>

A paper transport section 160 is housed within the body casing 112. The paper transport section 160 is configured to be able to feed the paper P to a paper transfer position TP where the transfer section 140 and the image carrying surface 121*b*1 face each other with a smallest gap therebetween. The paper transport section 160 includes a paper feed roller 161, a paper guide 163, and paper transport guide rollers 165.

The paper feed roller 161 includes a rotary center shaft 161 parallel to the main scanning direction and a rubber layer, which is circumferentially provided on the rotary center shaft 161. The paper feed roller 161 is disposed in such a manner as to face a leading end portion, with respect to the paper transport direction, of the paper P stacked on the paper-pressing plate 153 housed within the paper feed cassette case 151. The paper guide 163 and the paper transport guide rollers 165 are configured to be able to guide to the transfer position TP the paper P which has been delivered by the paper feed roller 161.

<<Fixing Section>>

A fixing section 170 is housed within the body casing 112. The fixing section 170 is disposed downstream of the transfer position TP with respect to the paper transport direction. The fixing section 170 is configured to apply pressure and heat to the paper P which has passed the transfer position TP and bears an image in the toner T, thereby fixing the image in the toner T on the paper P. The fixing section 170 includes a heating roller 172 and a pressure roller 173.

The heating roller 172 includes a cylinder which is made of metal and whose surface is exfoliation-treated, and a halogen lamp which is housed within the cylinder. The pressure roller 173 includes a rotary center shaft which is made of metal, and a silicone rubber layer which is circumferentially provided on the rotary center shaft. The heating roller 172 and the pressure roller 173 are disposed in such a manner as to press against each other under a predetermined pressure.

The heating roller 172 and the pressure roller 173 are configured and disposed so as to be able to deliver the paper P toward the paper ejection port 112*a* while applying pressure and heat to the paper P.

<Outline of Image Forming Operation of Laser Printer>

The outline of an image forming operation of the laser printer 100 having the above-described configuration will next be described with reference to the drawings.

<<Paper Feed Operation>>

Referring to FIG. 1, the paper-pressing plate 153 urges the paper P stacked thereon upward toward the paper feed roller 161. This causes the top paper P of a stack of the paper P on the paper-pressing plate 153 to come into contact with the circumferential surface of the paper feed roller 161. When the paper feed roller 161 is rotatably driven clockwise in FIG. 1, a leading end portion with respect to the paper transport direction of the top paper P is moved toward the paper guide 163. Then, the paper guide 163 and the paper transport guide rollers 165 transport the paper P to the transfer position TP.

<<Formation of Toner Image on Image Carrying Surface>>

While the paper P is being transported to the transfer position TP as described above, an image in the toner T is formed as described below on the image carrying surface 121*b*1, which is the circumferential surface of the photoconductor drum 121.

<<<Formation of Electrostatic Latent Image>>>

First, the charger 123 uniformly charges a portion of the image carrying surface 121*b*1 of the photoconductor drum 121 to positive polarity.

Referring to FIG. 3, in association with the clockwise rotation of the photoconductor drum 121, the portion of the image carrying surface 121*b*1 which has been charged by the charger 123 moves along the sub-scanning direction to the scanning position SP, where the portion of the image carrying surface 121*b*1 faces (faces straight toward) the scanner unit 122. At the scanning position SP, the charged portion of the image carrying surface 121*b*1 is irradiated with the laser beam LB modulated on the basis of image information, while the laser beam LB sweeps along the main scanning direction. Certain positive charges are lost from the charged portion of the image carrying surface 121*b*1, according to a state of modulation of the laser beam LB. By this procedure, an electrostatic latent image LI in the form of an imagewise distribution of positive charges is formed on the image carrying surface 121*b*1.

In association with the clockwise rotation of the photoconductor drum 121 in FIG. 3, the electrostatic latent image LI formed on the image carrying surface 121*b*1 moves toward the developing position DP.

<<<Transport of Charged Toner>>>

Referring to FIG. 2, predetermined voltages (similar to those shown in FIG. 4) are applied to the counter wiring substrate 135, thereby forming predetermined traveling-wave electric fields on the counter wiring substrate 135. By means of the electric fields, the toner T which resides on the bottom of the inner space of the developing casing 131 is transported rearward (leftward in FIG. 2) on the counter wiring substrate 135 supported on the casing bottom plate 131*b*. The toner T is transported to the rear end of the inner space of the developing casing 131; more specifically, to a position where the counter wiring substrate 135 and a rear end portion of the transport wiring substrate 133 face each other.

The toner T residing between the transport wiring substrate 133 and the counter wiring substrate 135 is transported toward the developing position DP by the effect of traveling-wave electric fields generated on the transport wiring substrate 133 (the toner transport surface 133*d*) and on the counter wiring substrate 135.

A toner-T-transporting motion effected by the counter wiring substrate 135 is similar to that effected by the transport wiring substrate 133. Thus, the toner-T-transporting motion effected by the transport wiring substrate 133 will be described below in detail.

Figure 9:
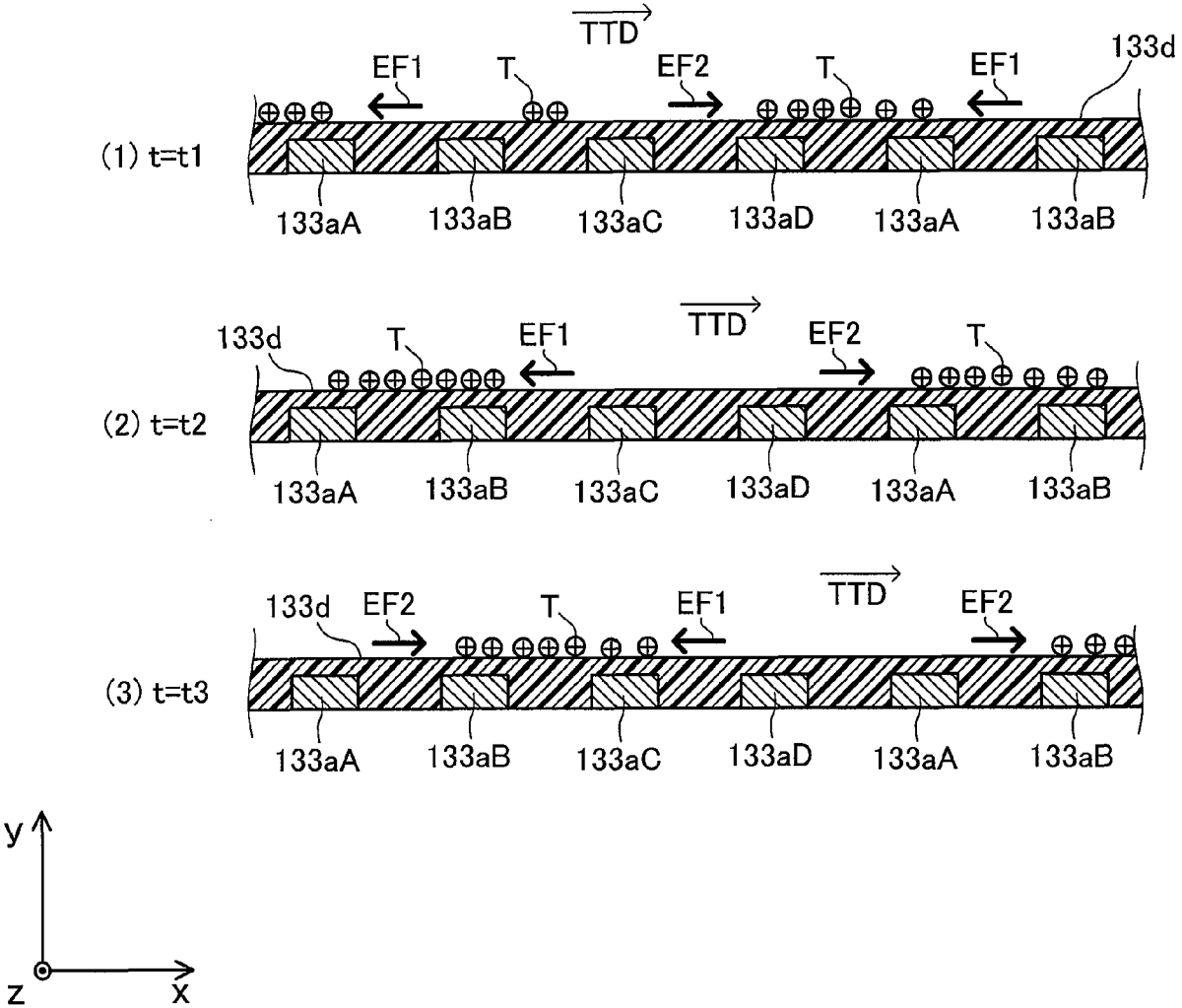
FIG. 9 is an enlarged side sectional view showing a toner transport surface of a transport wiring substrate shown in FIG. 3, and its periphery.

FIG. 9 is an enlarged side sectional view showing the toner transport surface 133*d* of the transport wiring substrate 133, and its periphery. Notably, the transport electrodes 133*a* connected to the power supply circuit VA in FIG. 3 are represented as transport electrodes 133*a*A in FIG. 9. This convention applies to transport electrodes 133*a*B through 133*a*D.

Referring to FIGS. 4 and 9, at time t1 in FIG. 4, an electric field EF1 directed opposite the toner transport direction TTD (directed opposite the x direction in FIG. 9) is formed in a section AB between the transport electrode 133*a*A and the transport electrode 133*a*B. Meanwhile, an electric field EF2 directed in the toner transport direction TTD (x direction in FIG. 9) is formed in a section CD between the transport electrode 133*a*C and the transport electrode 133*a*D. No electric field directed along the toner transport direction TTD is formed in a BC section between the transport electrode 133*a*B and the transport electrode 133*a*C and in a DA section between the transport electrode 133*a*D and the transport electrode 133*a*A.

That is, at time t1, the positively charged toner T in the sections AB is subjected to electrostatic force directed opposite the toner transport direction TTD. The positively charged toner T in the sections BC and DA is hardly subjected to electrostatic force directed along the toner transport direction TTD. The positively charged toner T in the CD sections is subjected to electrostatic force directed in the toner transport direction TTD. Thus, at time t1, the positively charged toner T is collected in the DA sections.

Similarly, at time t2, the positively charged toner T is collected in the sections AB. When time t3 is reached, the positively charged toner T is collected in the sections BC. In this manner, areas where the toner T is collected move with time in the toner transport direction TTD along the toner transport surface 133*d*.

Referring to FIGS. 5 to 8, as described above, traveling-wave transport voltages (see FIG. 4) are applied to the plurality of transport electrodes 133*a* and to the plurality of counter electrodes 135*a*, thereby forming traveling-wave electric fields on the toner transport surfaces 133*d* and 135*d*. Thus, the toner T (see FIG. 9) is transported toward the developing position DP (see FIG. 3) along the toner transport direction TTD while being guided by the pair of toner transport guide members 136.

<<<Development of Electrostatic Latent Image>>>

Referring to FIG. 3, the positively charged toner T is transported to the developing position DP as described above. In the vicinity of the developing position DP, the toner T adheres to portions of the electrostatic latent image on the image carrying surface 121*b*1 at which positive charges are lost. That is, the electrostatic latent image LI on the image carrying surface 121*b*1 of the photoconductor drum 121 is developed with the toner T. Thus, an image in the toner T is carried on the image carrying surface 121*b*1.

<<Transfer of Toner Image from Image Carrying Surface to Paper>>

Referring to FIG. 1, in association with clockwise rotation of the image carrying surface 121*b*1, an image in the toner T which has been carried on the image carrying surface 121*b* of the photoconductor drum 121 as described above is transported toward the transfer position TP. At the transfer position TP, the image in the toner T is transferred from the image carrying surface 121*b*1 onto the paper P.

<<Fixing and Ejection of Paper>>

The paper P onto which an image in the toner T has been transferred at the transfer position TP is sent to the fixing section 170 along the paper path PP. The paper P is nipped between the heating roller 172 and the pressure roller 173, thereby being subjected to pressure and heat. By this procedure, the image in the toner T is fixed on the paper P. Subsequently, the paper P is sent to the paper ejection port 112*a* and is then ejected onto the catch tray 114 through the paper ejection port 112*a*.

<Actions and Effects of Embodied Configuration>

According to the configuration of the present embodiment, each of the paired toner transport guide members 136 is provided in such a manner as to cover the transport-electrode electricity supply wiring section 137 and the root portions 133*a*1 and the distal end portions 133*a*2 of the transport electrodes 133*a*. In other words, longitudinally opposite end portions of the transport electrodes 133*a* and the transport-electrode electricity supply wiring section 137 are covered with the pair of toner transport guide members 136.

Meanwhile, good traveling-wave electric fields along the toner transport direction TTD are formed on intermediate portions (corresponding to the toner transport area TTA in FIG. 6) of the transport electrodes 133*a* between the distal end portions 133*a*2 and the root portions 133*a*1. By contrast, good traveling-wave electric fields are hard to form (or are not formed) on the distal end portions 133*a*2 and the root portions 133*a*1 of the transport electrodes 133*a* and on the transport-electrode electricity supply wiring section 137.

However, according to the configuration of the present embodiment, the toner transport guide members 136 cover the above-mentioned regions (corresponding to the covered areas CA in FIG. 6) where good traveling-wave electric fields are hard to form.

Thus, the configuration of the present embodiment enables smooth transport of the charged toner T on the toner transport surface 133*d* by means of a simple apparatus configuration. Therefore, the stagnation of the toner T on the toner transport surface 133*d* can be restrained to the greatest possible extent by means of a simple apparatus configuration.

According to the configuration of the present embodiment, the range (covered width We2) of covering the root portions 133*a*1 and the distal end portions 133*a*2 of the transport electrodes 133*a* with the toner transport guide member 136 is equal to or greater than the width (electrode width We1) of the transport electrode 133*a* as measured orthogonally to the longitudinal direction of the transport electrode 133*a*.

According to the above configuration, the above-mentioned regions where good traveling-wave electric fields are hard to form are more reliably covered with the toner transport guide members 136.

According to the configuration of the present embodiment, the counter wiring substrate 135 having the plurality of counter electrodes 135*a* is provided, and the toner transport guide members 136 intervene between the toner transport surface 133*d* and the counter electrodes 135*a* (the counter wiring substrate 135).

The above configuration enables more smooth transport of the charged toner T through application of predetermined traveling-wave voltages to the plurality of transport electrodes 133*a* and to the plurality of counter electrodes 135*a*.

According to the configuration of the present embodiment, each of the paired toner transport guide members 136 is provided in such a manner as to cover the counter-electrode electricity supply wiring section 138 and the root portions 135*a*1 and the distal end portions 135*a*2 of the counter electrodes 135*a*. In other words, longitudinally opposite end portions of the counter electrodes 135*a*, and the counter-electrode electricity supply wiring section 138 are covered with the pair of toner transport guide members 136.

Thus, the configuration of the present embodiment enables smooth transport of the charged toner T on the toner transport surface 135*d* by means of a simple apparatus configuration.

According to the configuration of the present embodiment, the toner transport guide members 136 are of an elastic material, and the top surfaces 136*b* of the toner transport guide members 136 are in contact with the counter wiring substrate 135 supported on the developing-section counter plate 131*a*1 of the casing top cover 131*a*.

The above configuration can restrain the stagnation of the toner T on the top surfaces 136*b* to the greatest possible extent.

<Modifications>

As mentioned previously, the above-described embodiment is a mere example of a typical embodiment of the present invention which the applicant contemplated as the best at the time of filing the present application. The present invention is not limited to the above-described embodiment. Various modifications to the above-described embodiment are possible, so long as the invention is not modified in essence.

Typical modifications will next be exemplified. In the following description of the modifications, members similar in structure and function to those used in the above-described embodiment are denoted by the same reference numerals as those of the above-described embodiment. As for the description of these members, an associated description appearing in the description of the above embodiment can be cited, so long as no technical inconsistencies are involved.

Needless to say, modifications are not limited to those exemplified below. Also, the plurality of modifications can be combined as appropriate, so long as no technical inconsistencies are involved.

The above-described embodiment and the following modifications should not be construed as limiting the present invention (particularly, those components which partially constitute means for solving the problems to be solved by the invention and are described operationally and functionally). Such limiting construal unfairly impairs the interests of an applicant (who is motivated to file as quickly as possible under the first-to-file system) while unfairly benefiting imitators, is contrary to the purpose of the patent law which promotes protection and utilization of inventions, and is thus impermissible, and is thus impermissible.

(1) Application of the present invention is not limited to a monochromatic laser printer. For example, the present invention can be preferably applied to so-called electrophotographic image forming apparatus, such as color laser printers and monochromatic and color copying machines.

Also, the present invention can be preferably applied to image forming apparatus of other than the above-mentioned electrophotographic system (for example, toner jet image forming apparatus and ion flow image forming apparatus).

(2) No particular limitation is imposed on the configurations of the toner electric field transport body 132, the transport wiring substrate 133, and the counter wiring substrate 135 in the above-described embodiment.

For example, the transport electrodes 133*a* can be embedded in the transport-electrode support substrate 133*b* so as not to project from the surface of the transport-electrode support substrate 133*b*. The transport-electrode coating layer 133*c* can be omitted. The transport electrodes 133*a* can be formed directly on the transport-substrate support member 134.

The counter electrodes 135*a* can also be, for example, embedded in the counter-electrode support substrate 135*b* so as not to project from the surface of the counter-electrode support substrate 135*b*. The counter-electrode coating layer 135*c* can be omitted. The counter electrodes 135*a* can be formed directly on the inner wall surface of the developing casing 131.

The longitudinal direction of the transport electrodes 133*a* and that of the counter electrodes 135*a* may be in parallel with the main scanning direction as in the case of the above-described embodiment or may intersect with the main scanning direction. The direction of arraying the transport electrodes 133*a* and that of arraying the counter electrodes 135*a* may be in parallel with the sub-scanning direction as viewed in plane as in the case of the above-described embodiment or may intersect with the sub-scanning direction as viewed in plane.

No particular limitation is imposed on the transport electrodes 133*a* and the counter electrodes 135*a* with respect to shape and the configuration of electrical connections. For example, in place of the form of a straight line as in the case of the above-described embodiment, the transport electrodes 133*a* and the counter electrodes 135*a* can assume various other forms, such as V-shaped, arc, waves, and serrated.

The pattern of connecting the electrodes is not limited to that of connecting every fourth electrode as in the case of the above-described embodiment. For example, every other electrode or every third electrode may be connected. In this case, the corresponding power circuits are not of four kinds, but can be modified as appropriate such that the phase shift of voltage waveforms is 180°, 120°, etc. Furthermore, the voltage waveform can be rectangular waves, sine waves, and waves of various other shapes.

(3) The counter wiring substrate 135 can be omitted partially or entirely.

(4) Referring to FIGS. 2, 3, and 5, in the above-described embodiment, the photoconductor drum 121 and the developing casing 131 are configured such that, by means of the photoconductor-drum outline width Wp1 being narrower than the width of the developing opening portion 131*a*2 along the main scanning direction, a portion of the image carrying surface 121*b*1 projects into the developing opening portion 131*a*2 at the developing position DP.

The present invention is not limited to the above-mentioned configuration. For example, the photoconductor-drum outline width Wp1 and the photoconductor-drum effective width Wp2 may be wider than the width of the developing opening portion 131*a*2 along the main scanning direction.

However, the configuration of the above-described embodiment reduces a developing gap (a gap between the image carrying surface 121*b*1 and the toner transport surface 133*d*) at the developing position DP to the greatest possible extent, whereby development can be performed more precisely. Since the developing opening portion 131*a*2 is covered with the photoconductor drum 121, leakage of the toner T through the developing opening portion 131*a*2 can be restrained to the greatest possible extent.

(5) The entire top surface 136*b* of each of the toner transport guide members 136 does not necessarily touch the counter wiring substrate 135. In this case, each of the toner transport guide members 136 is formed to have such a sectional shape as to restrain deposition of the toner T (see FIG. 9) on the top surface 136*b* of the toner transport guide member 136 in the process of transport.

Figure 10:
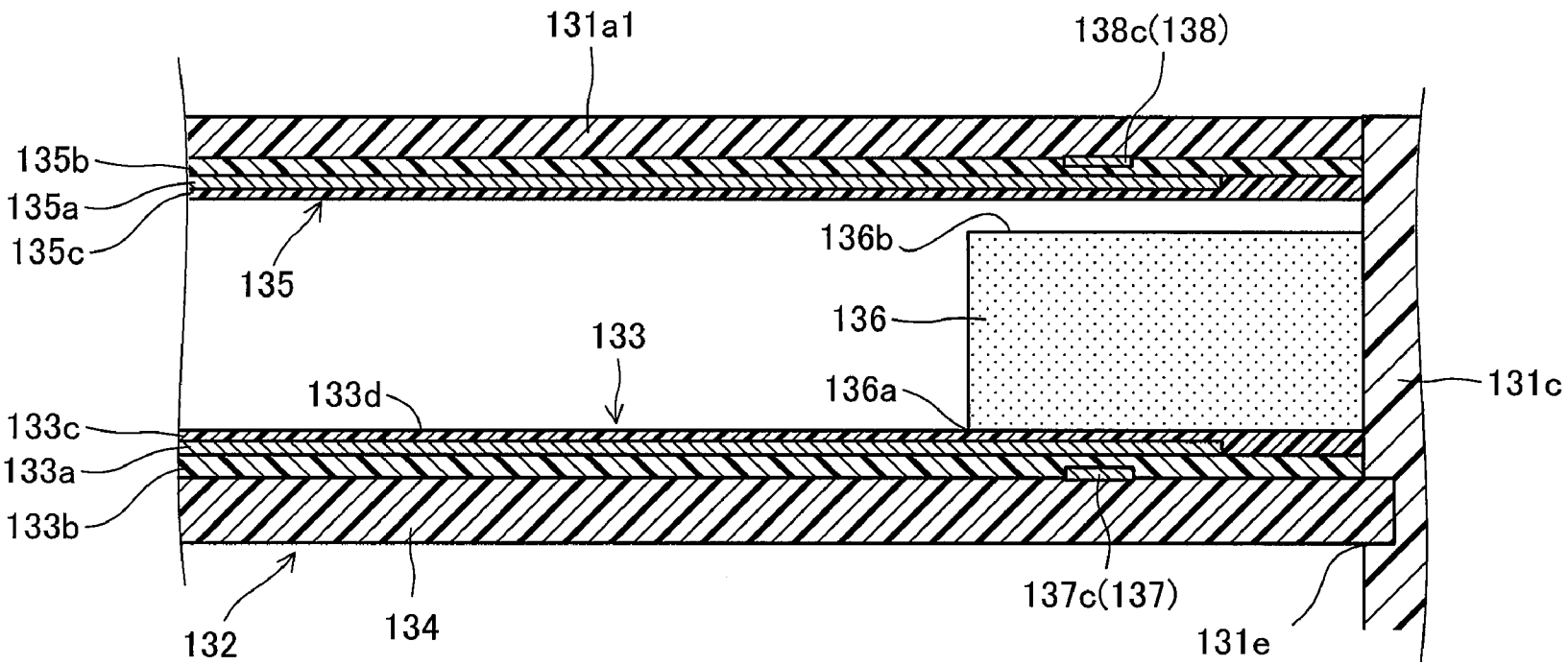
FIG. 10 is a sectional view showing the configuration of a modification of a toner transport guide member shown in FIG. 7.

FIG. 10 is a sectional view showing the configuration of a modification of the toner transport guide member 136 shown in FIG. 7. Referring to FIG. 10, in the present modification, the top surface 136*b* of the toner transport guide member 136, and the counter wiring substrate 135 are separated from each other.

Referring to FIG. 3, the height of the top surface 136*b* is determined so as to be sufficiently higher than the maximum hopping height along the height direction (y-axis direction in FIG. 3) of the toner T (e.g., three times or more the maximum hopping height) in a region other than the vicinity of the developing position DP, the toner T being transported in a hopping fashion on the toner transport surface 133*d* through application of the aforementioned traveling-wave transport voltages to the plurality of transport electrodes 133*a*. In the vicinity of the developing position DP, the toner T hops through the developing opening portion 131*a*2 at such a height as to reach the image carrying surface 121*b*1.

Figure 11:
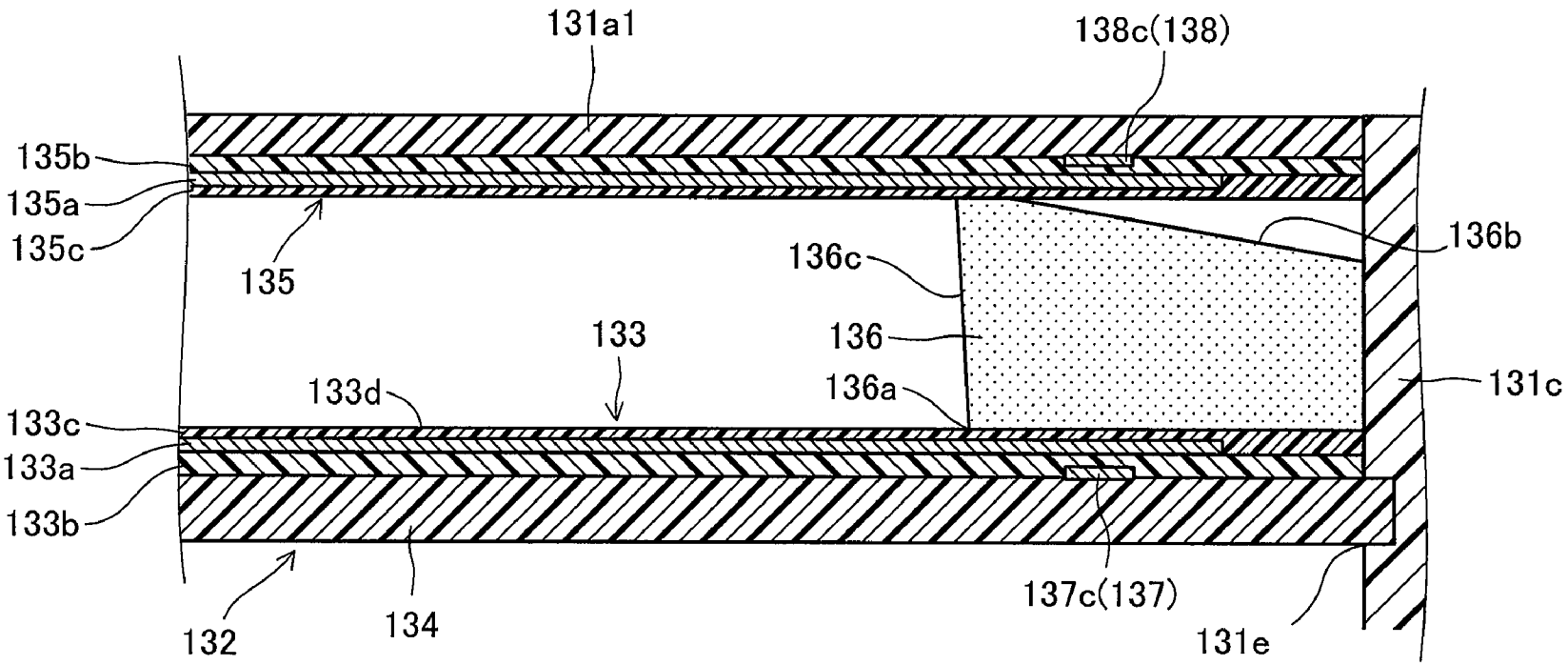
FIG. 11 is a sectional view showing the configuration of another modification of the toner transport guide member shown in FIG. 7.

FIG. 11 is a sectional view showing the configuration of another modification of the toner transport guide member 136 shown in FIG. 7.

Referring to FIG. 11, in the present modification, the top surface 136*b* of the toner transport guide member 136 slopes downwardly and outwardly with respect to the paper width direction. An inside edge portion of the top surface 136*b* of the toner transport guide member 136 touches the counter wiring substrate 135. That is, in the present modification, a portion of the top surface 136*b* of the toner transport guide member 136 touches the counter wiring substrate 135.

Even these configurations of the modifications can effectively restrain deposition of the toner T (see FIG. 9) on the top surfaces 136*b* of the toner transport guide members 136.

(6) As shown in FIG. 11, a restraining end surface 136*c* of the toner transport guide member 136 located inward with respect to the paper width direction (the main scanning direction) may be a steep overhang surface which overhangs toward the toner transport area TTA (see FIG. 6).

According to the above-mentioned configuration, the toner T (see FIG. 9) which is transported in a hopping fashion on the toner transport surface 133*d* impinges against the restraining end surface 136*c*, thereby being guided inward with respect to the paper transport direction. Thus, the scattering of the toner T (see FIG. 9) to the outside of the toner transport area TTA (see FIG. 6) can be restrained.

(7) In the case where, as in the case of the above-described embodiment, the counter wiring substrate 135 is also provided on the casing bottom plate 131*b*, the toner transport guide member 136 can be provided in such a manner as to correspond to the casing bottom plate 131*b*, That is, the toner transport guide member 136 can be formed in such a manner as to have a cross-sectional shape resembling the letter U so as to correspond to the casing top cover 131*a* and the casing bottom plate 131*b* which are formed integrally with each other in such a manner as to have a cross-sectional shape resembling the letter U.

Figure 12:
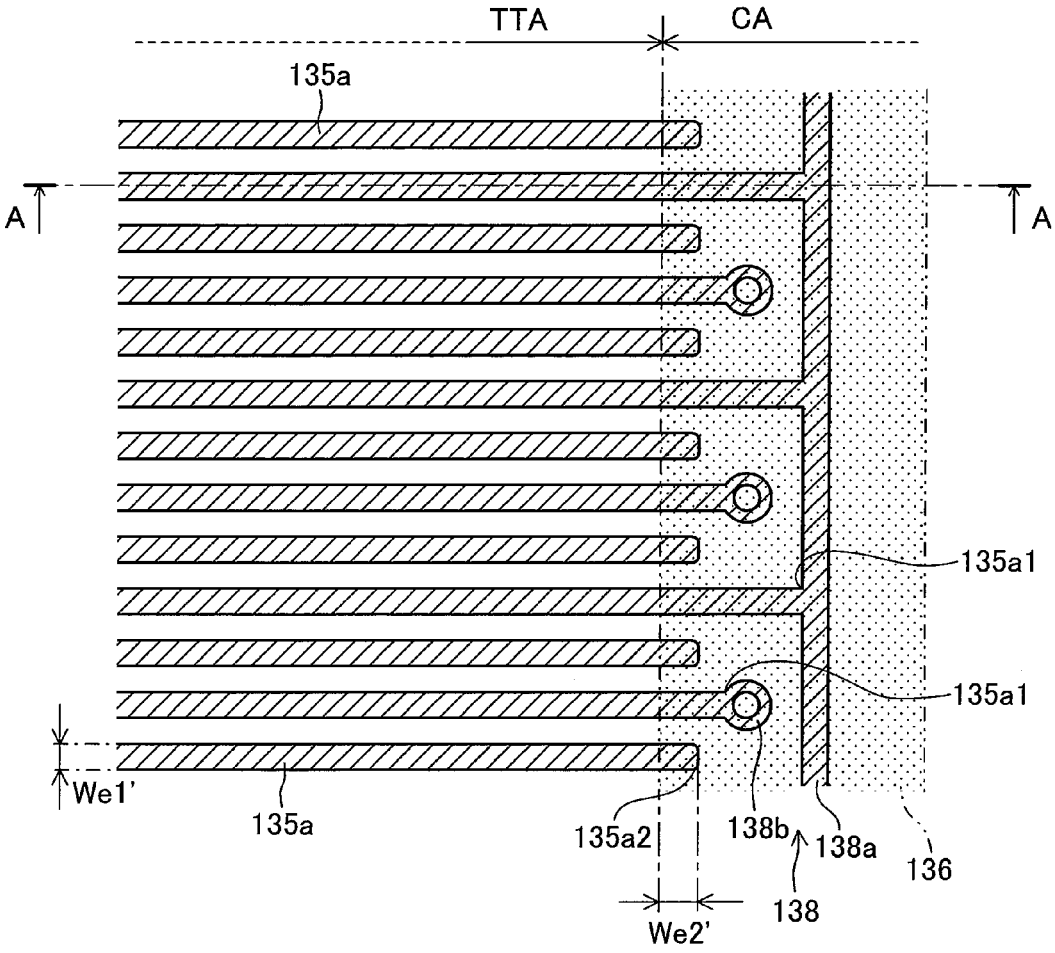
FIG. 12 is a plan view showing, in a see-through manner, a counter wiring substrate on a casing bottom plate in the configuration of a modification of the developing device shown in FIG. 2.
Figure 13:
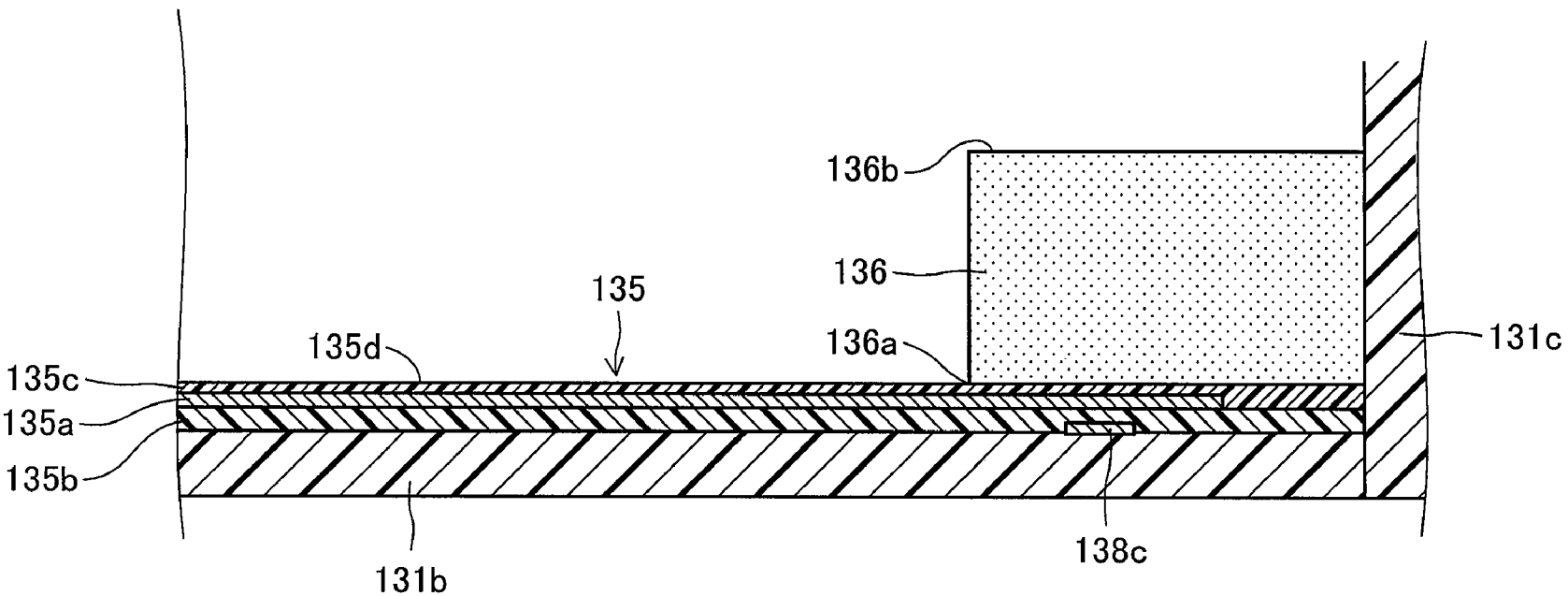
FIG. 13 is a sectional view taken along line A-A of FIG. 12.

FIGS. 12 and 13 show the configuration of the present modification. FIG. 12 is a plan view showing, in a see-through manner, the counter wiring substrate 135 on the casing bottom plate 131*b* in the configuration of a modification of the developing device 130 shown in FIG. 2. That is, FIG. 12 corresponds to FIG. 6. FIG. 13 is a sectional view taken along line A-A of FIG. 12.

Referring to FIGS. 12 and 13, in the present modification, the toner transport guide member 136 is provided in such a manner as to cover, from above, both end portions (root portions 135*a*1 and the distal end portions 135*a*2) of the counter electrodes 135*a* of the counter wiring substrate 135 supported on the casing bottom plate 131*b*. That is, the toner transport guide members 136 cover (from above) opposite end portions, with respect to the paper width direction (the main scanning direction), of the toner transport surface 135*d*, thereby forming the pair of covered areas CA. An intermediate area of the toner transport surface 135*d* which lies between the paired covered areas CA serves as the toner transport area TTA.

In this case, the height (thickness) of the toner transport guide member 136 is determined so as to be able to restrain deposition of the toner T (see FIG. 9) on the top surface 136*b*. Specifically, for example, the height of the toner transport guide member 136 can be set to three times or more the maximum possible hopping height of the toner T (see FIG. 9), which hops above the toner transport surface 135*d* by the action of traveling-wave electric fields generated through application of voltages to the plurality of counter electrodes 135*a*.

According to the configuration of the present modification, good traveling-wave electric fields can be formed in the toner transport area TTA, which is an inside area, with respect to the paper width direction (the main scanning direction), of the toner transport surface 135*d*, which is an inner surface of the counter wiring substrate 135. Outside areas, with respect to the paper width direction (the main scanning direction), of the toner transport surface 135*d* are the covered areas CA, which are covered with the respective toner transport guide members 136. The toner transport guide members 136 reliably cover the above-mentioned areas where traveling-wave electric fields are hard to form (or are not formed). Thus, the stagnation of the toner T in particular regions within the developing casing 131 (see FIG. 2) can be more effectively restrained.

Figure 14:
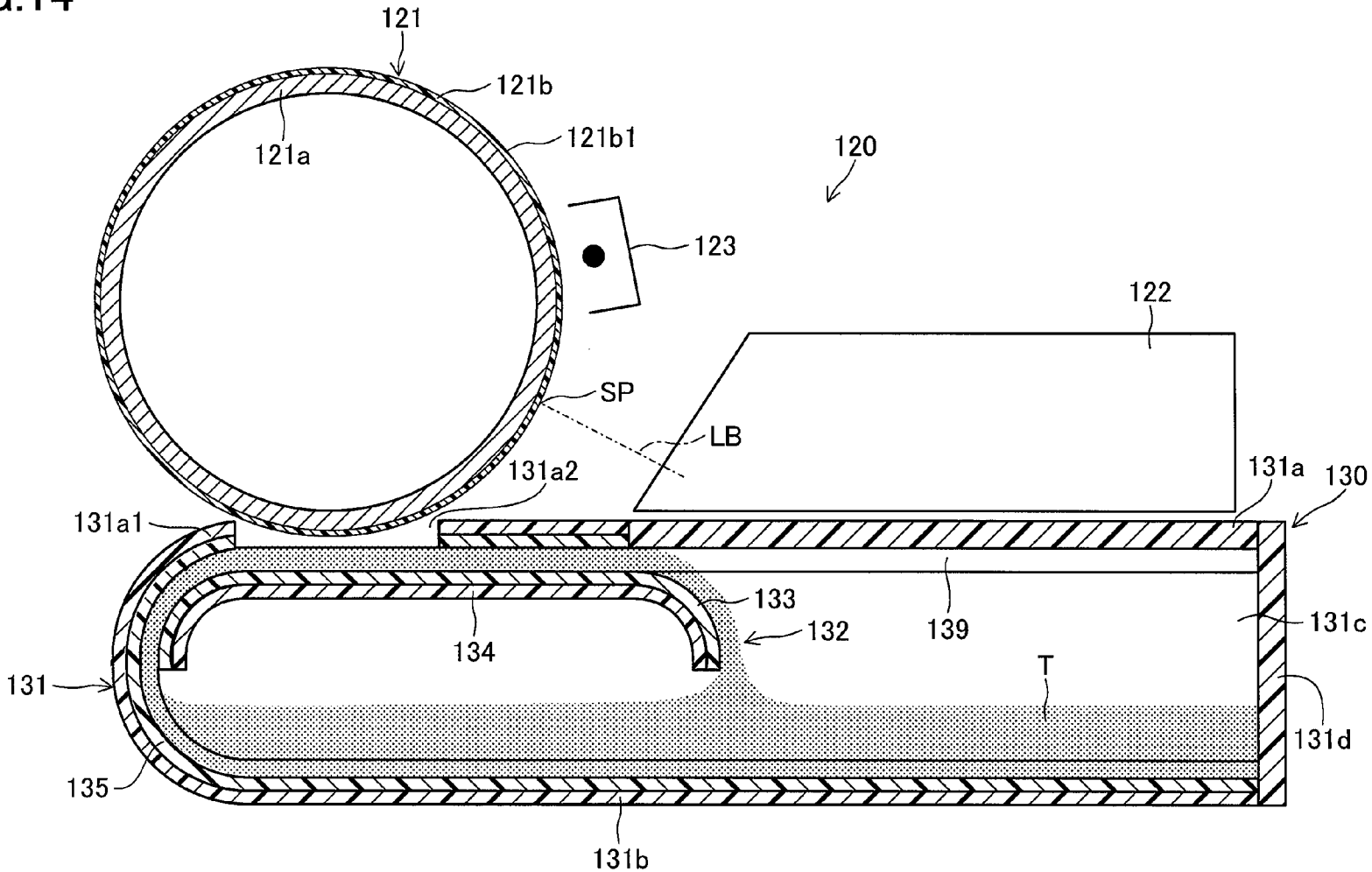
FIG. 14 is a side sectional view showing the configuration of another modification of the developing device shown in FIG. 2.

(8) FIG. 14 is a side sectional view showing the configuration of a further modification of the developing device 130 shown in FIG. 2.

Referring to FIG. 14, toner seal members 139 may be provided at opposite end portions of the developing casing 131 with respect to the paper width direction (the main scanning direction). The toner seal members 139 correspond to the seal members of the present invention. The toner seal members 139 are provided in joint regions between the casing top cover 131*a* and the casing side plates 131*c* and in joint regions between the casing bottom plate 131*b* and the casing side plates 131*c*.

Each of the toner seal members 139 is formed of an elastic material; namely, single-bubble-type foamed sponge, and assumes the form of a bar-like member whose longitudinal direction coincides with the sub-scanning direction (vertical direction in FIG. 5). The toner seal member 139 is provided in such a curved manner as to have a cross-sectional shape resembling the letter U so as to correspond to the casing top cover 131*a* and the casing bottom plate 131*b* which are formed integrally with each other in such a manner as to have a cross-sectional shape resembling the letter U.

The toner seal members 139 are configured to be able to restrain leakage of the toner T to the exterior of the developing casing 131 from the joint regions between the casing top cover 131*a* and the casing side plates 131*c* and from the joint regions between the casing bottom plate 131*b* and the casing side plates 131*c*. Also, similar to the toner transport guide members 136 shown in FIGS. 2 and 6, the pair of toner seal members 139 covers opposite end portions (the root portions 133*a*1 and the distal end portions 133*a*2) of the transport electrodes 133*a* and the transport-electrode electricity supply wiring section 137.

In the above configuration, the above-mentioned regions on the transport wiring substrate 133 where good traveling-wave electric fields are hard to form are more reliably covered by use of the members adapted to restrain leakage of the toner T from the developing casing 131.

(9) Those component elements which partially constitute the means for solving the problems to be solved by the invention and are described operationally and functionally include not only the specific structures disclosed in the above-described embodiment and modifications but also any other structures that can implement the operations and functions of the elements.

[2]

<Overall Configuration of Laser Printer>

Next, a second embodiment of the present invention will be described.

The laser printer 100 according to the present embodiment has an overall configuration substantially similar to that of the above-described first embodiment. Thus, configurational features peculiar to the present embodiment are described below. As for the description of other features, an associated description appearing in the above description of the first embodiment is cited as appropriate, so long as no technical inconsistencies are involved.

<<Developing Device>>

Figure 15:
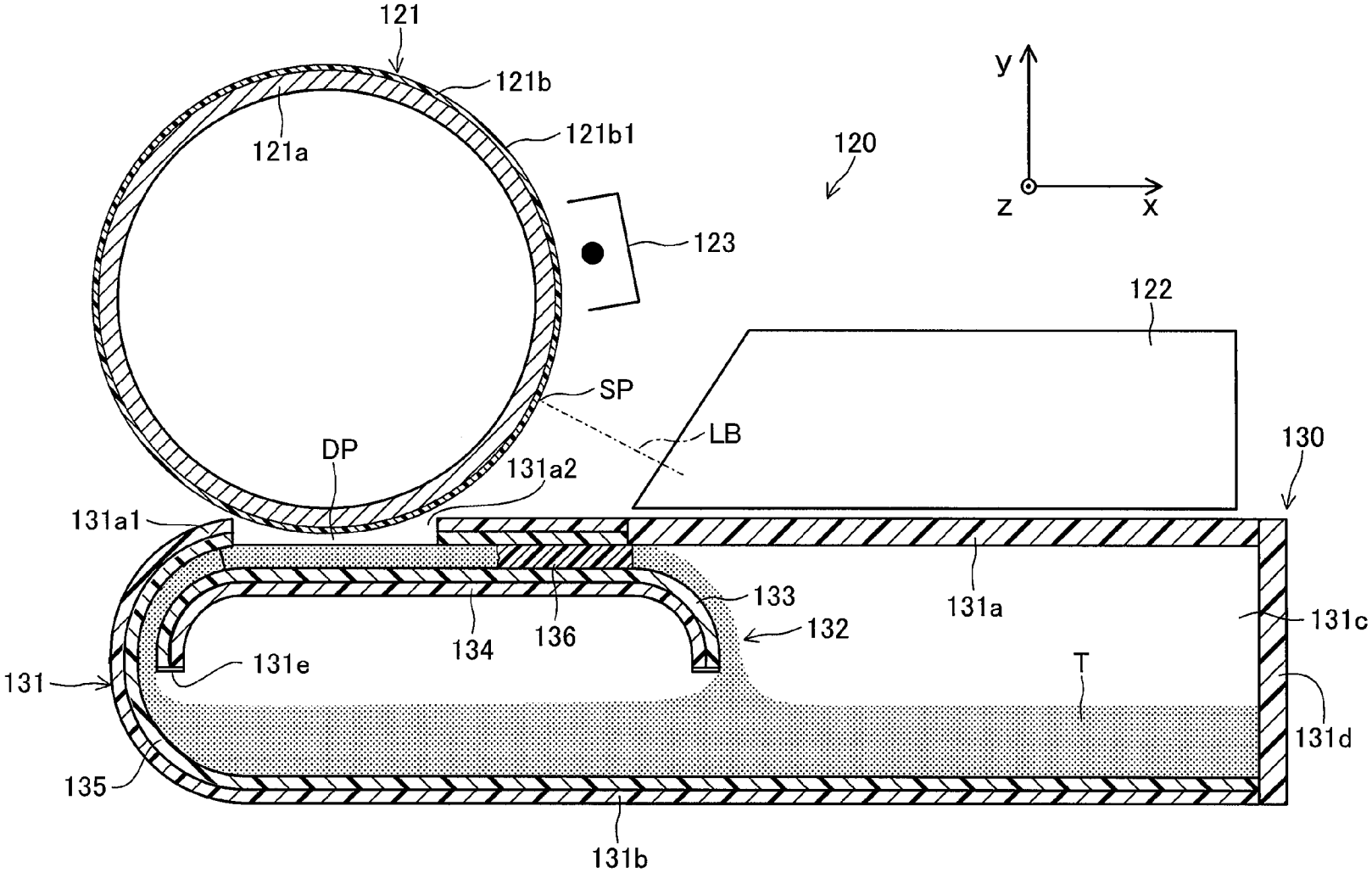
FIG. 15 is an enlarged side sectional view showing the electrostatic-latent-image forming section shown in FIG. 1 and a developing device according to a second embodiment of the present invention.

FIG. 15 is an enlarged side sectional view showing the electrostatic-latent-image forming section 120 shown in FIG. 1 and the developing device 130 according to the present embodiment.

<<<Toner Transport Guide Member>>>

Figure 16:
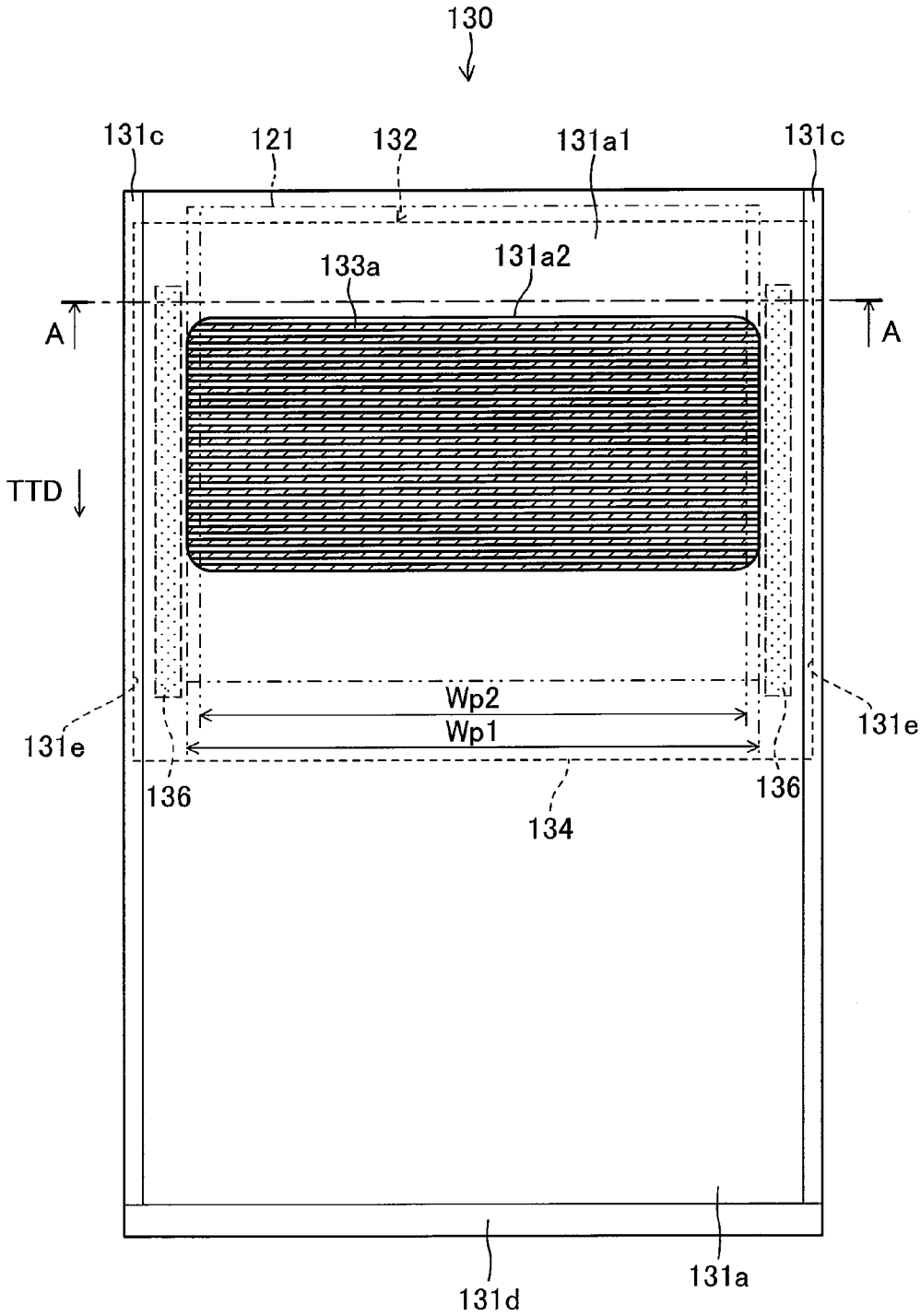
FIG. 16 is a plan view of the developing device shown in FIG. 15.
Figure 17:
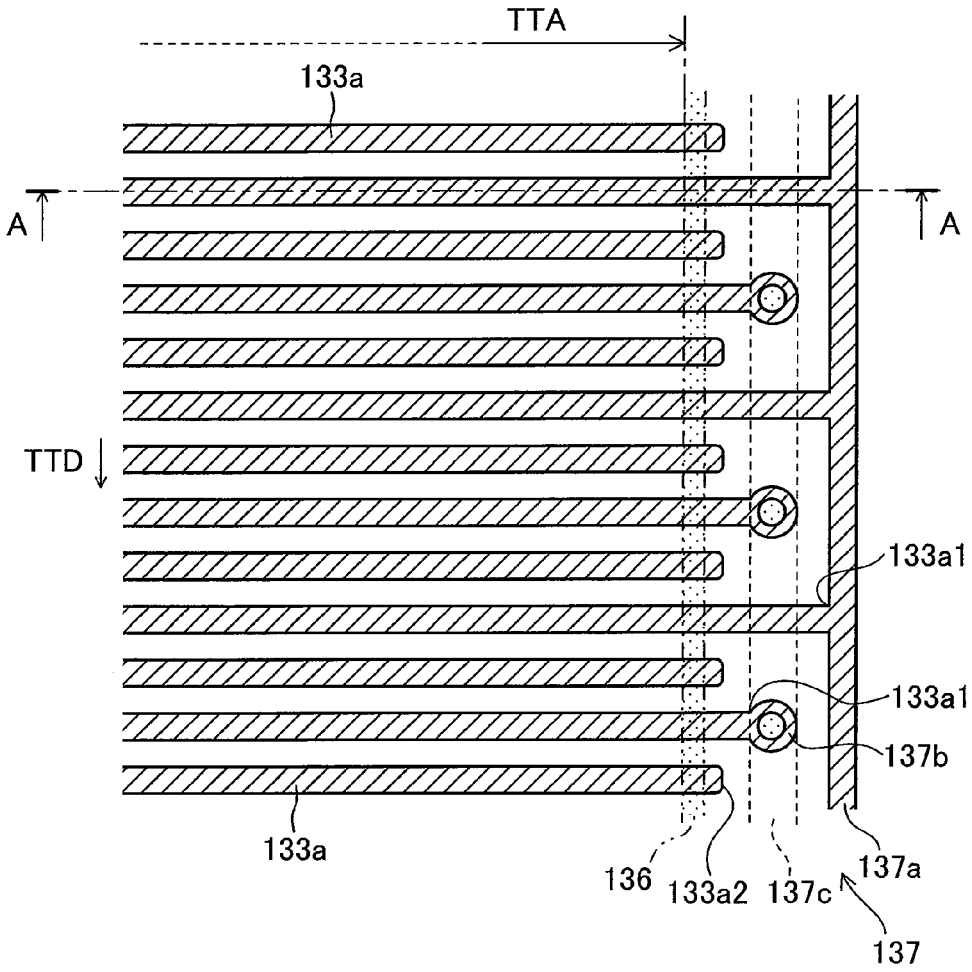
FIG. 17 is an enlarged plan view showing, in a see-through manner, end portions, with respect to the main scanning direction, of the transport electrodes shown in FIG. 3, and their periphery.
Figure 18:
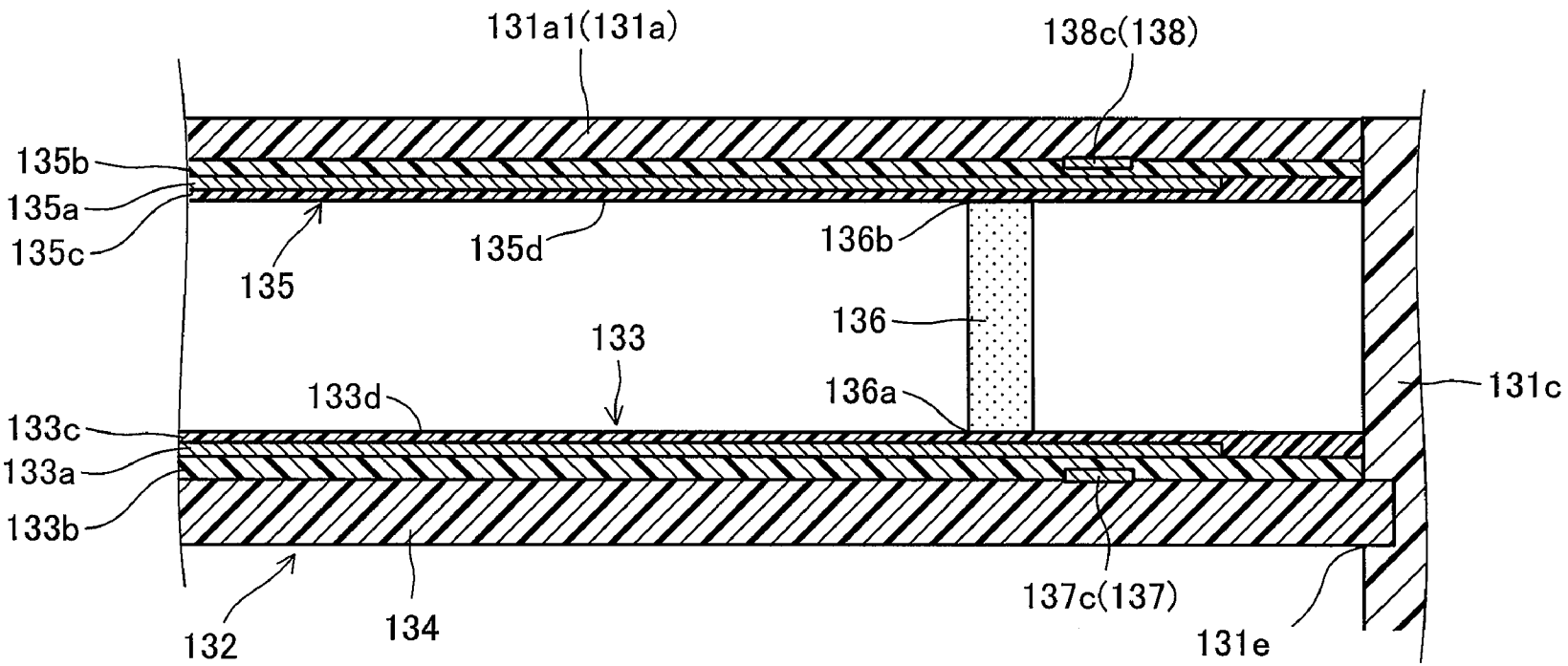
FIG. 18 is a sectional view taken along line A-A of FIGS. 16 and 17.
Figure 19:
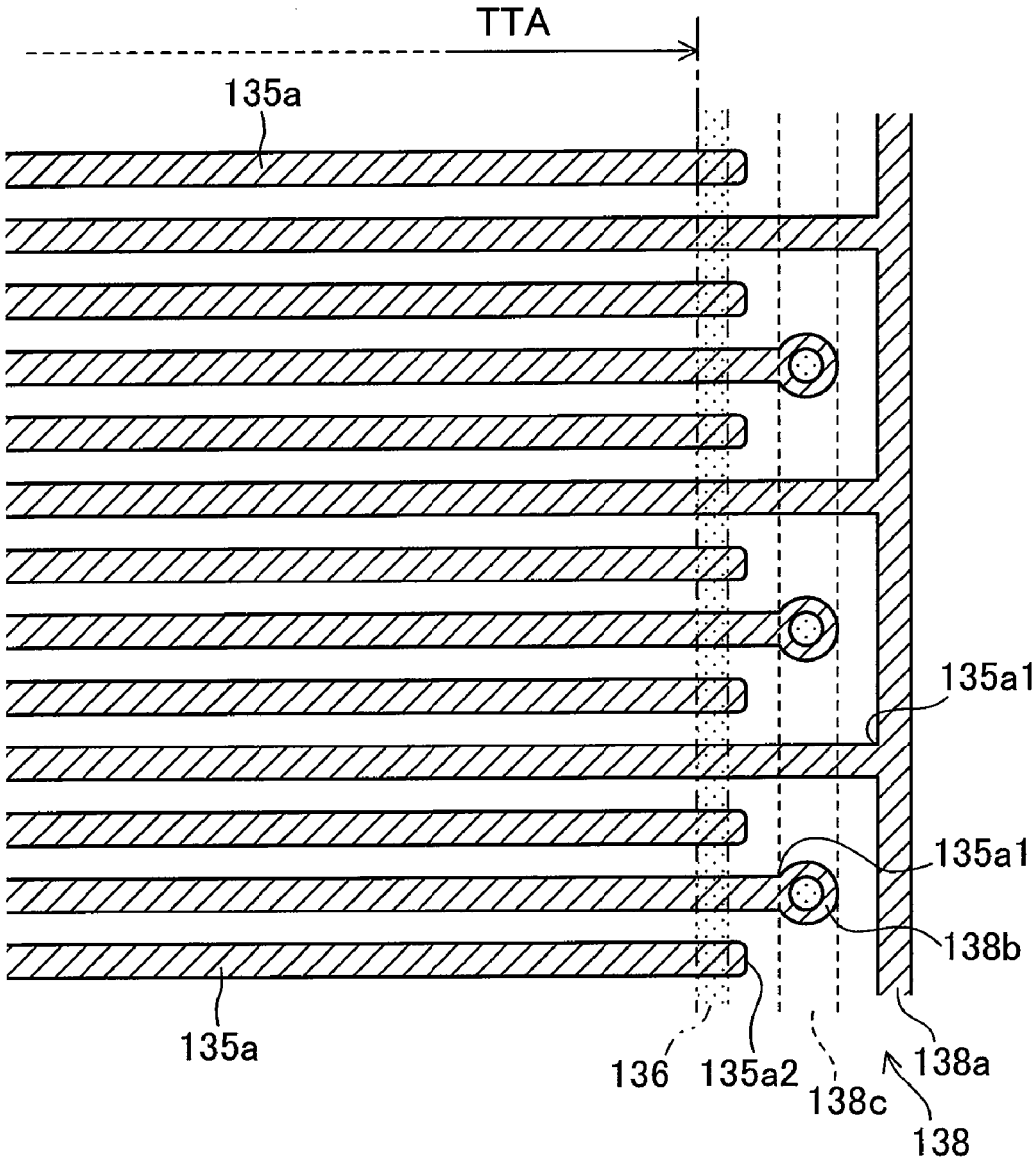
FIG. 19 is an enlarged plan view showing, in a see-through manner, end portions, with respect to the main scanning direction, of the counter electrodes shown in FIG. 3, and their periphery.

FIG. 16 is a plan view of the developing device 130 shown in FIG. 15. FIG. 17 is an enlarged plan view showing, in a see-through manner, end portions, with respect to the main scanning direction, of the transport electrodes 133*a* shown in FIG. 3, and their periphery. FIG. 18 is a sectional view taken along line A-A of FIGS. 16 and 17. FIG. 19 is an enlarged plan view showing, in a see-through manner, end portions, with respect to the main scanning direction, of the counter electrodes 135*a* shown in FIG. 3.

Referring to FIG. 16, the pair of toner transport guide members 136 intervenes between the casing top cover 131*a* (developing-section counter plate 131*a*1) and opposite end portions of the toner electric field transport body 132 with respect to the paper width direction (the main scanning direction). The paired toner transport guide members 136 correspond to the developer transport guide members of the present invention.

Each of the toner transport guide members 136 is formed of an elastic material;

namely, single-bubble-type foamed sponge, and assumes the form of a bar-like member whose longitudinal direction coincides with the sub-scanning direction (vertical direction in FIG. 16). The length of the toner transport guide member 136 is determined so as to be sufficiently longer than that of the developing opening portion 131*a*2 as measured along the sub-scanning direction.

The distance between the inner ends of the paired toner transport guide members 136 (the width of the toner transport area TTA in FIG. 17) along the paper width direction (the main scanning direction) is determined so as to be wider than the photoconductor-drum outline width Wp1 and the photoconductor-drum effective width Wp2. The photoconductor-drum outline width Wp1 is the width of the outline of the photoconductor drum 121 as measured along the main scanning direction. The photoconductor-drum effective width Wp2 is the width of an area of the photoconductor drum 121 in which an electrostatic latent image can be formed (the width of the photoconductor layer 121*b* shown in FIG. 15 as measured along the main scanning direction).

Referring to FIGS. 17 and 18, the toner transport guide members 136 are provided on opposite end portions of the toner electric field transport body 132 (toner transport surface 133*d*) with respect to the paper width direction (the main scanning direction) perpendicular to the toner transport direction TTD, in such a manner as to project upward toward the casing top cover 131*a* (toward the developing-section counter plate 131*a*1).

Referring to FIG. 18, a surface of the toner transport guide member 136 which faces the toner transport surface 133*d*; i.e., a bottom surface 136*a* of the toner transport guide member 136, is fixed on the toner transport surface 133*d* by bonding or by means of double-sided adhesive tape. The top surface 136*b* of the toner transport guide member 136 opposite the bottom surface 136*a* is in contact with the counter wiring substrate 135 under a predetermined pressure. That is, the toner transport guide members 136 intervene between the counter wiring substrate 135 supported on the casing top cover 131*a* (developing-section counter plate 131*a*1), and the opposite end portions, with respect to the main scanning direction, of the toner electric field transport body 132 (toner transport surface 133*d*) in a state of being elastically deformed under a predetermined pressure.

Referring to FIGS. 17 and 18, the toner transport guide member 136 is disposed inwardly of the root portions 133*a*1 and the distal end portions 133*a*2 of the transport electrodes 133*a* with respect to the paper width direction (the main scanning direction). The tonner transport area TTA lies between the inner ends of the paired toner transport guide members 136 with respect to the paper width direction.

The root portion 133*a*1 is one end portion of the transport electrode 133*a* with respect to the paper width direction (main scanning direction), which coincides with the longitudinal direction of the transport electrode 133*a*. The distal end portion 133*a*2 is the other end portion of the transport electrode 133*a* with respect to the longitudinal direction of the transport electrode 133*a*, the other end portion being opposite the one end portion (root portion 133*a*1).

That is, the toner transport guide members 136 are configured and disposed in such a manner as to project upward toward the casing top cover 131*a* (developing-section counter plate 131*a*1) at their positions located inwardly of the root portions 133*a*1 and the distal end portions 133*a*2 with respect to the paper width direction (the main scanning direction). Through employment of this configuration and disposition, the toner transport guide members 136 define an areal range within which the toner T (see FIG. 3) is transported on the toner transport surface 133*d* along the toner transport direction TTD; namely, the above-mentioned toner transport area TTA. Also, the toner transport guide members 136 can restrain leakage of the toner T to the outside of the toner transport direction TTD.

The transport-electrode electricity supply wiring section 137 is a wiring pattern for supplying electricity to the transport electrodes 133*a* and is formed of copper foil having a thickness of about several tens of micrometers. The transport-electrode electricity supply wiring section 137 corresponds to the electricity supply wiring section of the present invention. The transport-electrode electricity supply wiring section 137 is provided along the toner transport surface 133*d*.

The transport-electrode electricity supply wiring section 137 includes the transport-electrode electricity supply wiring pattern 137*a*, the plurality of through-holes 137*b*, and the through-hole electricity supply wiring pattern 137*c*.

The transport-electrode electricity supply wiring pattern 137*a* is provided, along the sub-scanning direction, on the same plane as that where the transport electrodes 133*a* reside (on the upper surface of the transport-electrode support substrate 133*b*). The transport-electrode electricity supply wiring pattern 137*a* is formed in such a manner as to be seamlessly integral with the root portion 133*a*1 of every fourth transport electrode 133*a* in an array of the transport electrodes 133*a* along the sub-scanning direction.

A large number of the through-holes 137*b* are arrayed along the sub-scanning direction. Each of the through-holes 137*b* is disposed between the transport electrodes 133*a* connected to the transport-electrode electricity supply wiring pattern 137*a*.

The through-hole electricity supply wiring pattern 137*c* is provided, along the sub-scanning direction, on the back surface (the surface opposite the aforementioned upper surface on which the transport electrodes 133*a* and the transport-electrode electricity supply wiring pattern 137*a* are formed) of the transport-electrode support substrate 133*b*. The through-holes 137*b* are formed such that each of the through-holes 137*b* is seamlessly integral with the root portion 133*a*1 of every corresponding fourth transport electrode 133*a* in an array of the transport electrodes 133*a* along the sub-scanning direction. The through-holes 137*b* are connected to the through-hole electricity supply wiring pattern 137*c* while extending through the transport-electrode support substrate 133*b*.

As shown in FIGS. 17 and 18, the transport-electrode electricity supply wiring section 137 is disposed outwardly of the toner transport guide member 136 with respect to the paper width direction (the main scanning direction).

Furthermore, as in the case of the above-mentioned end portions of the transport electrodes 133*a* and the transport-electrode electricity supply wiring section 137, end portions of the counter electrodes 135*a* and the counter-electrode electricity supply wiring section 138 for supplying electricity to the counter electrodes 135*a* are disposed outwardly of the toner transport guide members 136.

Specifically, referring to FIGS. 18 and 19, the counter-electrode electricity supply wiring pattern 138*a* and the plurality of through-holes 138*b*, which constitute the counter-electrode electricity supply wiring section 138, are connected to the root portions 135*a*1 of the counter electrodes 135*a*. The root portions 135*a*1 are one end portions of the counter electrodes 135*a* with respect to the longitudinal direction of the counter electrodes 135*a*. The through-hole electricity supply wiring pattern 138*c* electrically connects the through-holes 138*b* to one another.

The root portions 135*a*1 of the counter electrodes 135*a*, the distal end portions 135*a*2 which are the other end portions of the counter electrodes 135*a* opposite the root portions 135*a*1, and the counter-electrode electricity supply wiring section 138 are disposed outwardly of the toner transport guide member 136 with respect to the paper width direction (the main scanning direction).

<Outline of Image Forming Operation of Laser Printer>

The outline of an image forming operation of the laser printer 100 having the above-described configuration will next be described with reference to the drawings. As for the following description of operation, an associated description appearing in the above description of the first embodiment can be cited as appropriate.

<<<Transport of Charged Toner>>>

Referring to FIGS. 16 to 19, as described previously, traveling-wave transport voltages (see FIG. 4) are applied to the plurality of transport electrodes 133*a* and to the plurality of counter electrodes 135*a*, thereby forming traveling-wave electric fields on the toner transport surfaces 133*d* and 135*d*. Thus, the toner T (see FIG. 9) is transported toward the developing position DP (see FIG. 3) along the toner transport direction TTD while being guided within the toner transport areas TTA of the toner trans port surfaces 133*d* and 135*d* by the pair of toner transport guide members 136.

<Actions and Effects of Embodied Configuration>

According to the configuration of the present embodiment, the pair of toner transport guide members 136 brings an areal range within which the toner T is transported, into an areal range in which traveling-wave electric fields along the toner transport direction TTD are formed in a good condition; i.e., into the toner transport areas TTA of the toner transport surfaces 133*d* and 135*d*. The paired toner transport guide members 136 restrain leakage of the toner T to the outside of the toner transport area TTA; i.e., to an area where good traveling-wave electric fields are hard to form.

Thus, the configuration of the present embodiment enables smooth transport of the charged toner T along the toner transport direction TTD by means of a simple apparatus configuration. Therefore, the stagnation of the toner T in a toner path can be restrained to the greatest possible extent by means of a simple apparatus configuration.

According to the configuration of the present embodiment, the counter wiring substrate 135 having the plurality of counter electrodes 135*a* is provided, and the toner transport guide members 136 intervene between the toner transport surface 133*d* and the counter electrodes 135*a* (the counter wiring substrate 135).

The above configuration enables more smooth transport of the charged toner T through application of predetermined traveling-wave voltages to the plurality of transport electrodes 133*a* and to the plurality of counter electrodes 135*a*.

According to the configuration of the present embodiment, the toner transport guide members 136 are of an elastic material, and the top surfaces 136*b* of the toner transport guide members 136 are in contact with the counter wiring substrate 135 supported on the developing-section counter plate 131*a*1 of the casing top cover 131*a*.

The above configuration can effectively restrain deposition of the toner T on the top surfaces 136*b*. Also, the above-mentioned areal range of transport of the toner T can be effectively defined. Therefore, the above configuration can more effectively restrain the stagnation of the toner T in the toner path.

<Modifications>

In addition to general modifications, such as modification (1) of the first embodiment, the present embodiment can be modified as follows.

(1) The entire top surface 136*b* of each of the toner transport guide members 136 does not necessarily touch the counter wiring substrate 135. In this case, each of the toner transport guide members 136 is formed to have such a sectional shape as to restrain deposition of the toner T (see FIG. 9) on the top surface 136*b* of the toner transport guide member 136 in the process of transport.

Figure 20:
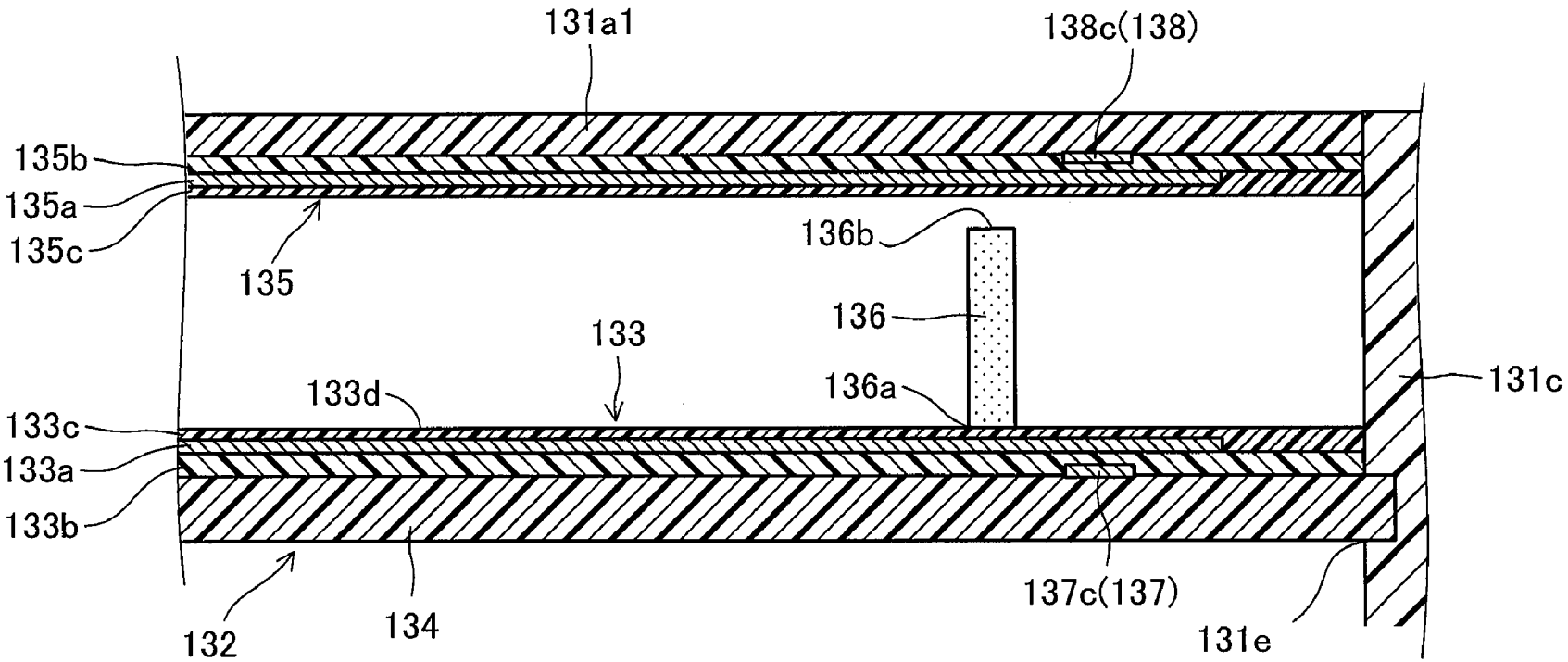
FIG. 20 is a sectional view showing the configuration of a modification of the toner transport guide member shown in FIG. 18.

FIG. 20 is a sectional view showing the configuration of a modification of the toner transport guide member 136 shown in FIG. 18. Referring to FIG. 20, in the present modification, the top surface 136*b* of the toner transport guide member 136, and the counter wiring substrate 135 are separated from each other.

Referring to FIG. 3, the height of the top surface 136*b* is determined so as to be sufficiently higher than the maximum hopping height along the height direction (y-axis direction in FIG. 3) of the toner T (e.g., three times or more the maximum hopping height) in a region other than the vicinity of the developing position DP, the toner T being transported in a hopping fashion on the toner transport surface 133*d* through application of the aforementioned traveling-wave transport voltages to the plurality of transport electrodes 133*a*. In the vicinity of the developing position DP, the toner T hops through the developing opening portion 131*a*2 at such a height as to reach the image carrying surface 121*b*1.

Figure 21:
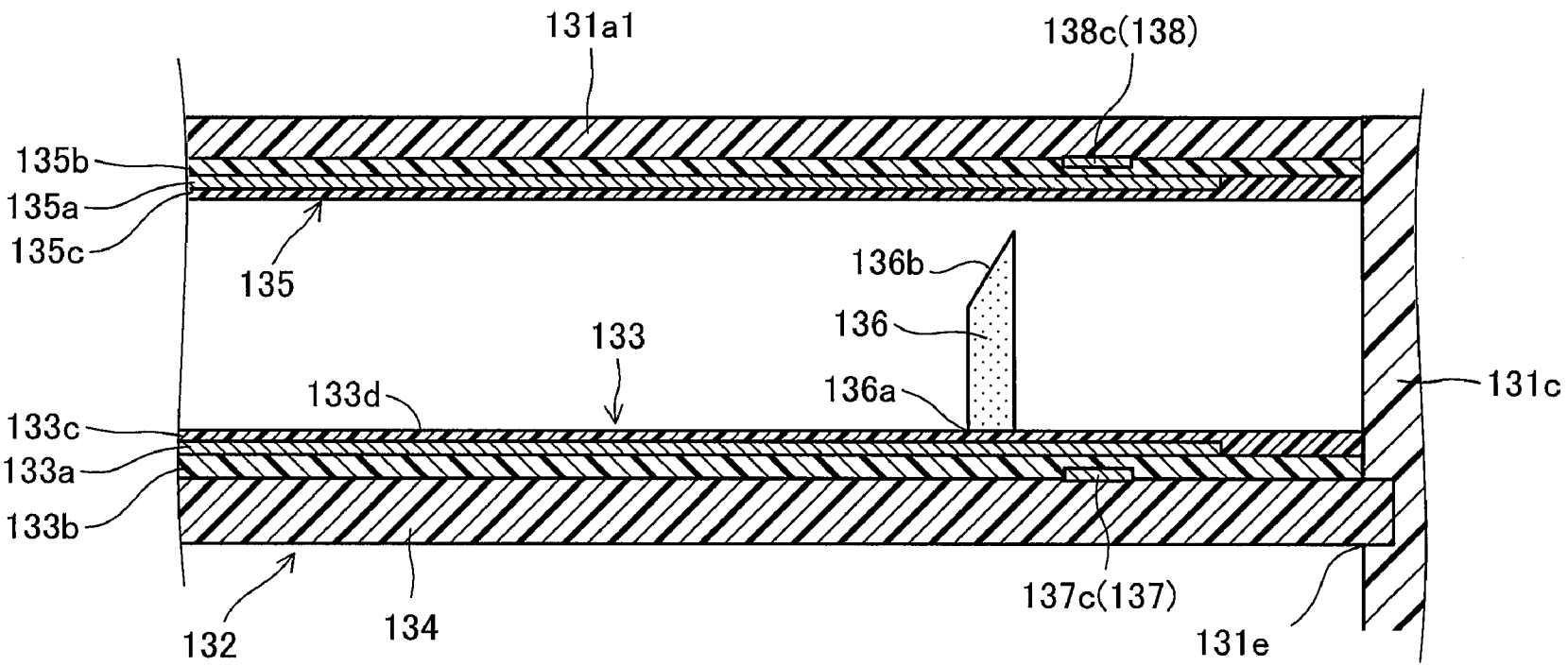
FIG. 21 is a sectional view showing the configuration of another modification of the toner transport guide member shown in FIG. 18.
Figure 22:
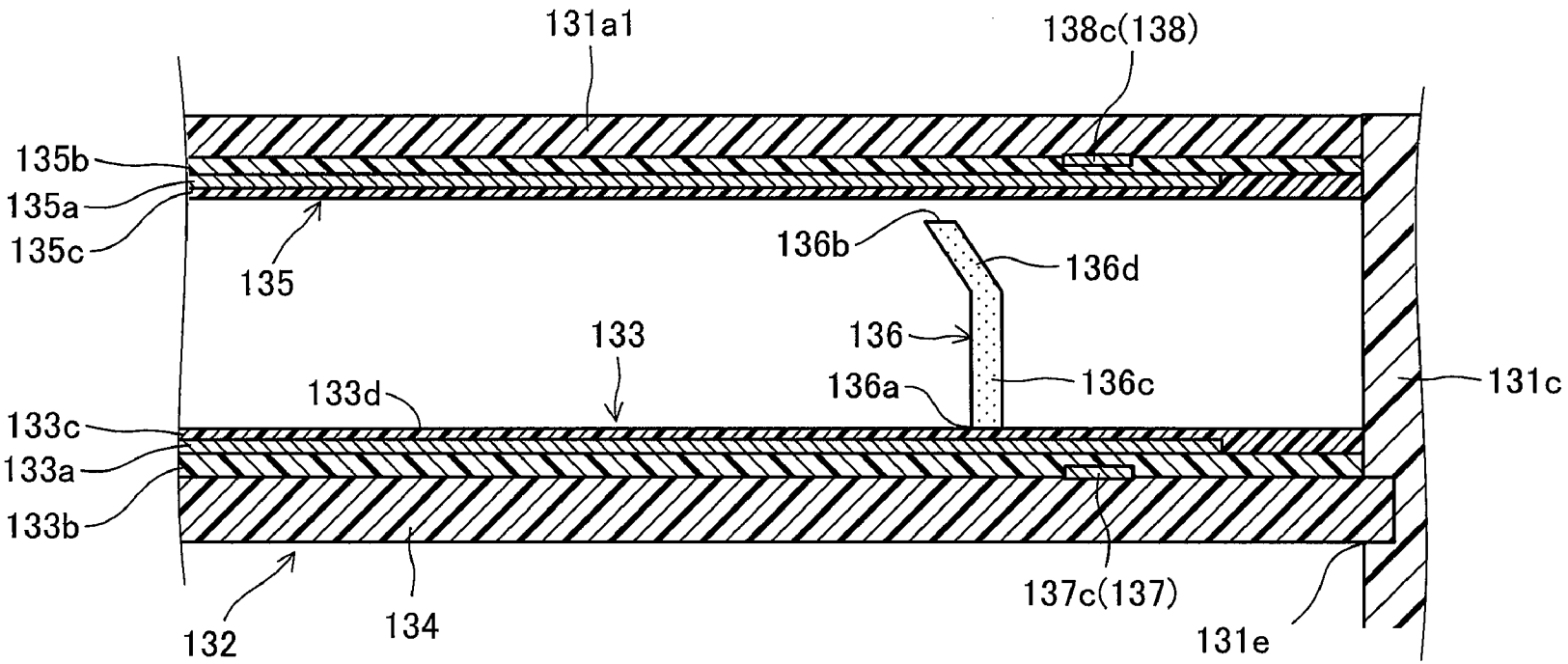
FIG. 22 is a sectional view showing the configuration of still another modification of the toner transport guide member shown in FIG. 18.

FIGS. 21 and 22 are sectional views showing the configurations of other modifications of the toner transport guide member 136 shown in FIG. 18.

Referring to FIG. 21, in the present modification, the top surface 136*b* of the toner transport guide member 136 slopes downwardly and inwardly with respect to the paper width direction.

Referring to FIG. 22, in the present modification, the toner transport guide member 136 has an eave. That is, the toner transport guide member 136 includes a base portion 136*c* and an overhang portion 136*d*.

The base portion 136*c* is fixed on the toner transport surface 133*d* and projects upright toward the counter wiring substrate 135. The overhang portion 136*d* extends obliquely upward from the top end of the base portion 136*c* in such a manner as to overhang toward the toner transport area TTA (see FIG. 17).

Even these configurations of the modifications can effectively define the areal range of transport of the toner T (see FIG. 9) and can effectively restrain deposition of the toner T (see FIG. 9) on the top surfaces 136*b* of the toner transport guide members 136.

(2) In the case where, as in the case of the above-described embodiment, the counter wiring substrate 135 is also provided on the casing bottom plate 131*b*, the toner transport guide members 136 can be provided in such a manner as to correspond to the casing bottom plate 131*b*, That is, each of the toner transport guide members 136 can be formed in such a manner as to have a cross-sectional shape resembling the letter U so as to correspond to the casing top cover 131 a and the casing bottom plate 131*b* which are formed integrally with each other in such a manner as to have a cross-sectional shape resembling the letter U.

Figure 23:
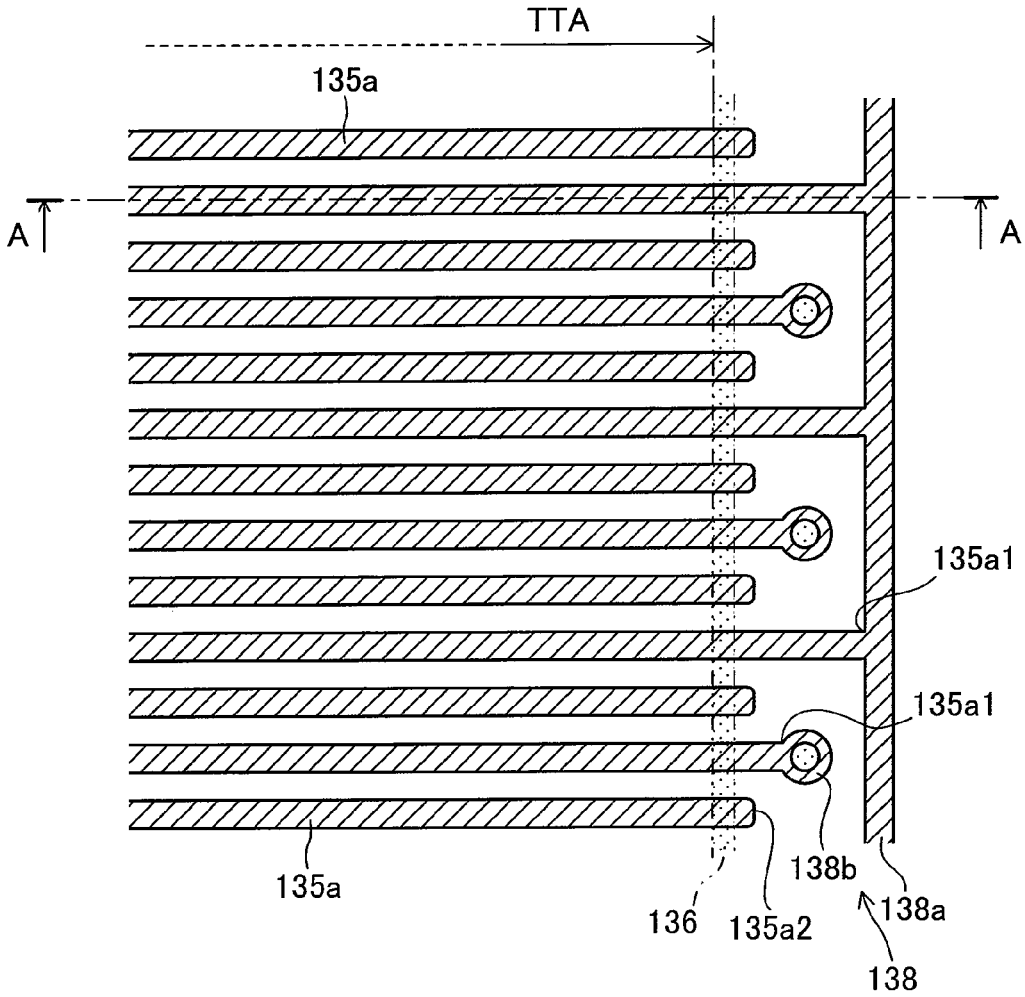
FIG. 23 is a plan view showing, in a see-through manner, the counter wiring substrate on the casing bottom plate in the configuration of a modification of the developing device shown in FIG. 15.
Figure 24:
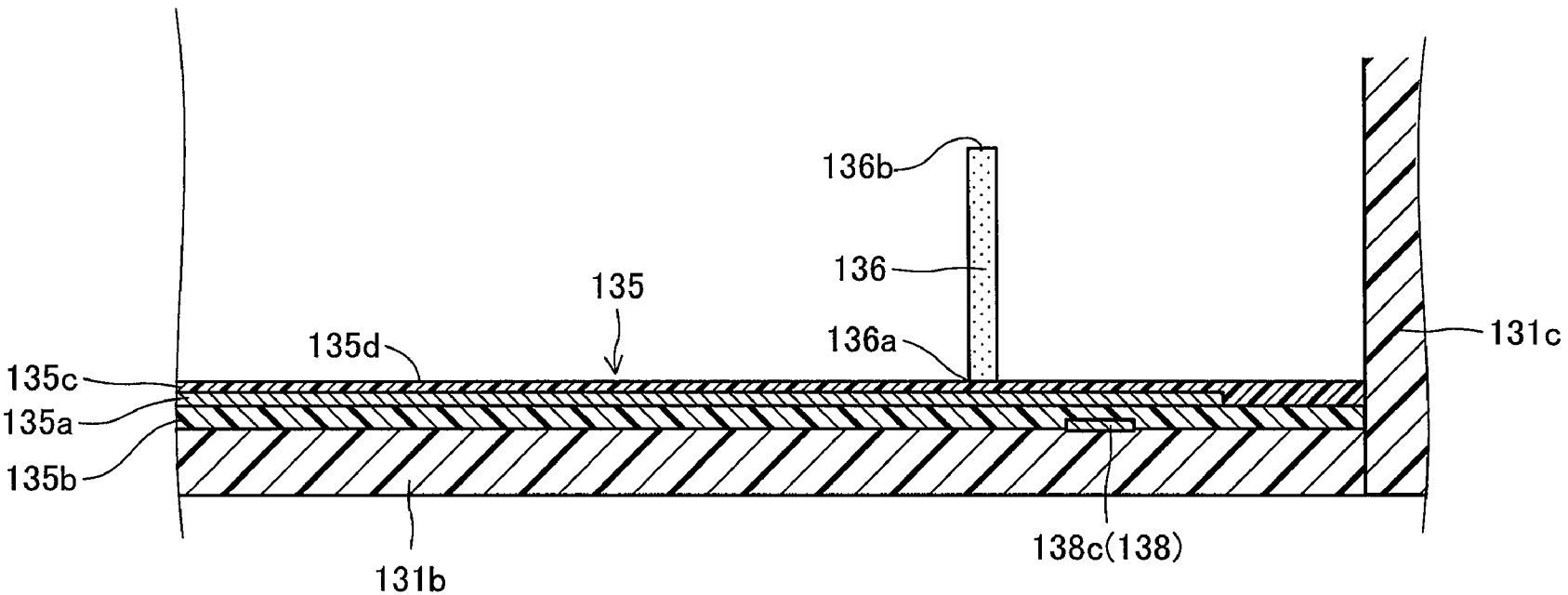
FIG. 24 is a sectional view taken along line A-A of FIG. 23.

FIGS. 23 and 24 show the configuration of the present modification. FIG. 23 is a plan view showing, in a see-through manner, the counter wiring substrate 135 on the casing bottom plate 131*b* in the configuration of a modification of the developing device 130 shown in FIG. 15. That is, FIG. 23 corresponds to FIG. 17. FIG. 24 is a sectional view taken along line A-A of FIG. 23.

Referring to FIGS. 23 and 24, in the present modification, the toner transport guide member 136 is provided inwardly of both end portions (root portions 135*a*1 and the distal end portions 135*a*2) of the counter electrodes 135*a* of the counter wiring substrate 135 supported on the casing bottom plate 131*b*, and the counter-electrode electricity supply wiring section 138. An intermediate area of the toner transport surface 135*d* which lies between the pair of toner transport guide members 136 serves as the toner transport area TTA.

In this case, the height of the toner transport guide member 136 is determined so as to be able to restrain deposition of the toner T (see FIG. 15) on the top surface 136*b*. Specifically, for example, the height of the toner transport guide member 136 can be set to three times or more the maximum possible hopping height of the toner T (see FIG. 15), which hops above the toner transport surface 135*d* by the action of traveling-wave electric fields generated through application of voltages to the plurality of counter electrodes 135*a*.

According to the configuration of the present modification, good traveling-wave electric fields can be formed in the toner transport area TTA, which is an inside area, with respect to the paper width direction (the main scanning direction), of the toner transport surface 135*d*, which is an inner surface of the counter wiring substrate 135. The pair of toner transport guide members 136 limits an area on the toner transport surface 135*d* where the toner T (see FIG. 15) is transported, to the toner transport area TTA.

Also, the paired toner transport guide members 136 restrain leakage of the toner T (see FIG. 15) to the outside, with respect to the paper width direction (the main scanning direction), of the toner transport area TTA of the toner transport surface 135*d*.

Therefore, the stagnation of the toner T in particular regions on the casing bottom plate 131*b* can be more effectively restrained.

(3) The width of the toner transport area TTA of the toner transport surface 133*d* and that of the toner transport area TTA of the toner transport surface 135*d* may be substantially the same as shown in FIGS. 18 and 20, or may differ from each other as shown in FIGS. 21 and 22.

[3]

A third embodiment of the present invention will next be described.

<Overall Configuration of Laser Printer>

The laser printer 100 according to the present embodiment has an overall configuration substantially similar to that of the above-described first embodiment. Thus, configurational features peculiar to the present embodiment are described below. As for the description of other features, an associated description appearing in the above description of the first embodiment is cited as appropriate, so long as no technical inconsistencies are involved.

<<Developing Device>>

Figure 25:
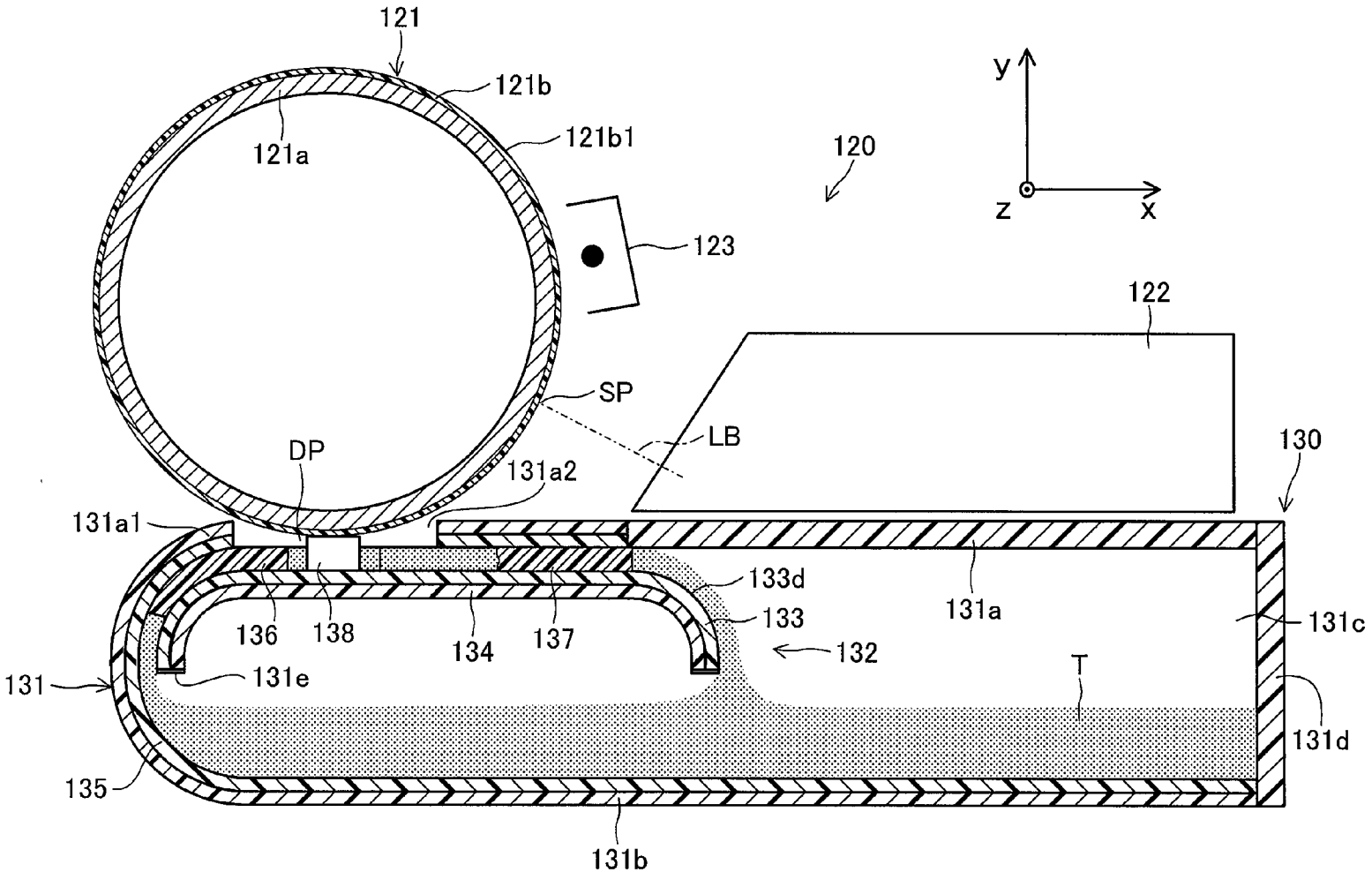
FIG. 25 is an enlarged side sectional view showing the electrostatic-latent-image forming section shown in FIG. 1 and a developing device according to a third embodiment of the present invention.

FIG. 25 is an enlarged side sectional view showing the electrostatic-latent-image forming section 120 shown in FIG. 1 and the developing device 130 according to the present embodiment.

<<<Toner Transport Guide Member>>>

Figure 26:
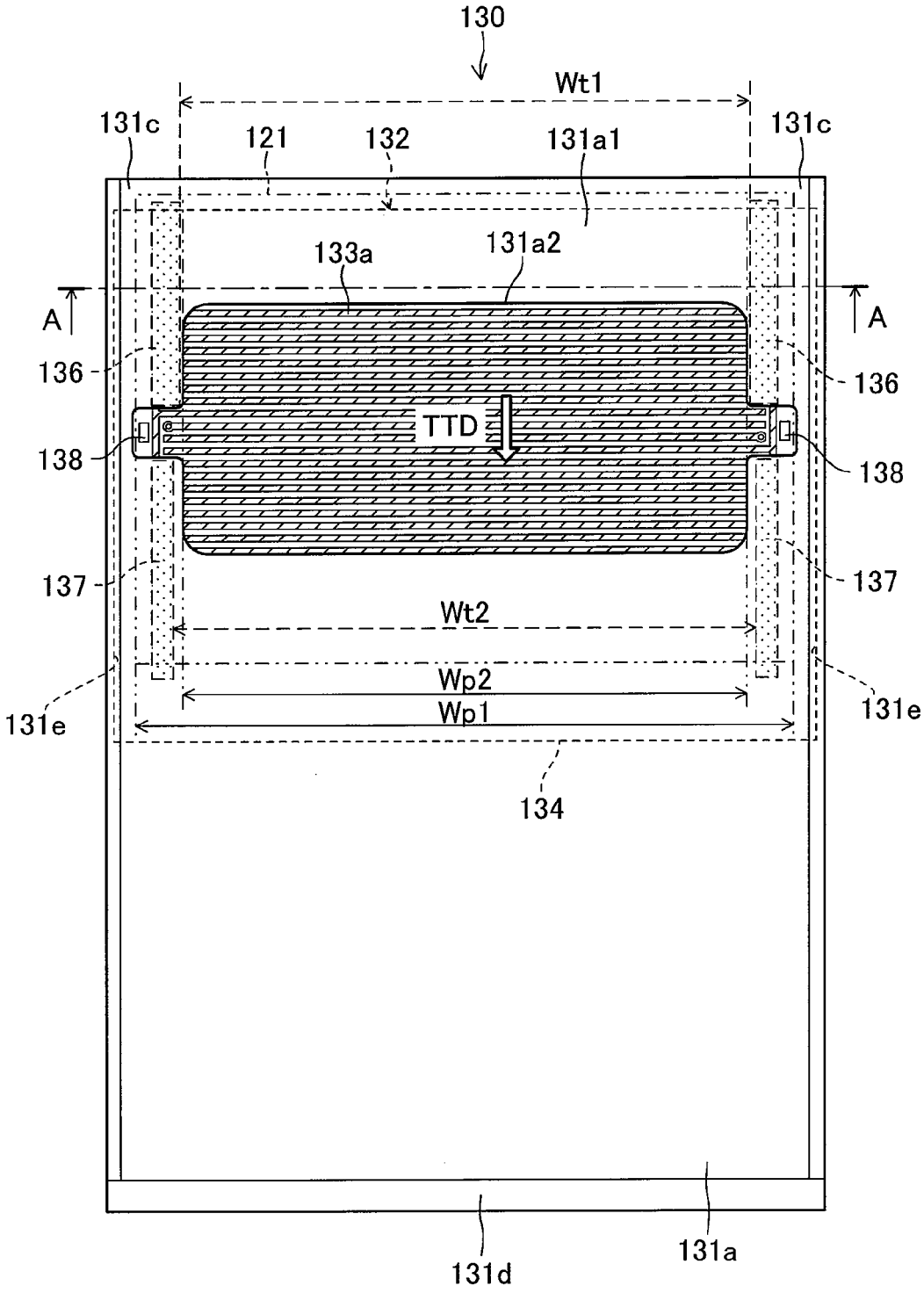
FIG. 26 is a plan view of the developing device shown in FIG. 25.
Figure 27:
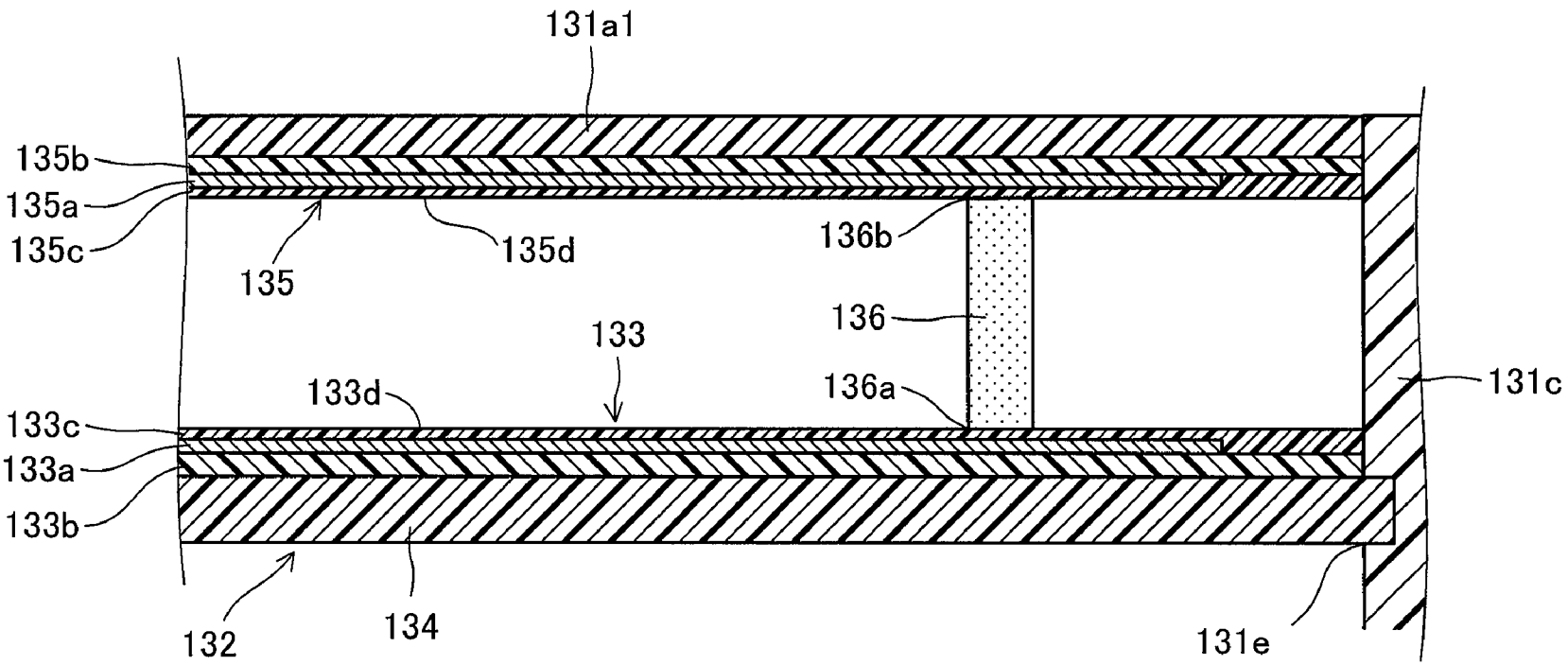
FIG. 27 is a sectional view taken along line A-A of FIG. 26.

FIG. 26 is a plan view of the developing device 130 shown in FIG. 25. FIG. 27 is a sectional view taken along line A-A of FIG. 26.

Referring to FIGS. 25 and 26, a pair of upstream toner transport guide members 136 is disposed within the developing casing 131. The paired upstream toner transport guide members 136 correspond to the pair of first developer transport guide members of the present invention. The upstream toner transport guide members 136 intervene between the casing top cover 131*a* (developing-section counter plate 131*a*1) and opposite end portions of the toner electric field transport body 132 with respect to the paper width direction (the main scanning direction). The upstream toner transport guide members 136 are disposed upstream of the developing position DP with respect to the toner transport direction TTD.

Each of the upstream toner transport guide members 136 is formed of an elastic material; namely, single-bubble-type foamed sponge, and assumes the form of a bar-like member whose longitudinal direction coincides with the sub-scanning direction (vertical direction in FIG. 26).

The upstream ends of the upstream toner transport guide members 136 with respect to the toner transport direction TTD are located at a halfway position on a curved slope of the toner transport surface 133*d* which extends obliquely upward right in FIG. 25, in the vicinity of the upstream end of the toner transport surface 133*d* with respect to the toner transport direction TTD. The downstream ends of the upstream toner transport guide members 136 with respect to the toner transport direction TTD are located at an approximately central position of the developing opening portion 131*a*2 with respect to the sub-scanning direction, slightly upstream of the developing position DP with respect to the toner transport direction TTD.

Referring to FIG. 27, the upstream toner transport guide members 136 are provided on opposite end portions of the toner electric field transport body 132 (toner transport surface 133*d*) with respect to the paper width direction (the main scanning direction) perpendicular to the toner transport direction TTD, in such a manner as to project upward toward the casing top cover 131*a* (toward the developing-section counter plate 131*a*1). Further, the upstream toner transport guide members 136 are disposed inward, with respect to the paper width direction, of the ends of the transport electrodes 133*a*.

A surface of each of the upstream toner transport guide members 136 which faces the toner transport surface 133*d*; i.e., the bottom surface 136*a* of the upstream toner transport guide member 136, is fixed on the toner transport surface 133*d* by bonding or by means of double-sided adhesive tape. The top surface 136*b* of the upstream toner transport guide member 136 opposite the bottom surface 136*a* is in contact with the counter wiring substrate 135 under a predetermined pressure.

Referring to FIGS. 25, 26, and 27, the pair of upstream toner transport guide members 136 is configured and disposed in such a manner as to project upward toward the casing top cover 131*a* (developing-section counter plate 131*a*1) at opposite end portions of the toner transport surface 133*d* with respect to the paper width direction (the main scanning direction). Through employment of this configuration and disposition, the upstream toner transport guide members 136 define an areal range within which the toner T is transported on the toner transport surface 133*d* along the toner transport direction TTD. Also, the upstream toner transport guide members 136 can restrain leakage of the toner T to the outside of the areal range.

That is, the pair of upstream toner transport guide members 136 is configured and disposed so as to define an upstream toner transport area with respect to the paper width direction (the main scanning direction). The upstream toner transport area is an area on the toner transport surface 133*d* in which the toner T is effectively transported along the toner transport direction TTD and is located upstream of the developing position DP with respect to the toner transport direction TTD. An upstream toner transport area width Wt1 shown in FIG. 26 is a distance between the inner ends of the paired upstream toner transport guide members 136 along the paper width direction (the main scanning direction).

The upstream toner transport guide members 136 intervene between the counter wiring substrate 135 supported on the casing top cover 131*a* (developing-section counter plate 131*a*1), and the opposite end portions, with respect to the main scanning direction, of the toner electric field transport body 132 (toner transport surface 133*d*) in a state of being elastically deformed under a predetermined pressure. As shown in FIG. 25, each of the upstream toner transport guide members 136 has a cross-sectional shape resembling the letter J.

Referring to FIGS. 25 and 26, a pair of downstream toner transport guide members 137 is housed within the developing casing 131. The paired downstream toner transport guide members 137 correspond to the pair of second developer transport guide members of the present invention. The downstream toner transport guide members 137 intervene between the casing top cover 131*a* (developing-section counter plate 131*a*1) and opposite end portions of the toner electric field transport body 132 with respect to the paper width direction (the main scanning direction).

The downstream toner transport guide members 137 are disposed downstream of the developing position DP with respect to the toner transport direction TTD. The downstream toner transport guide members 137 are formed of the same material as that used to form the upstream toner transport guide members 136. Each of the downstream toner transport guide members 137 is formed into a shape similar to that of each of the upstream toner transport guide members 136.

Similar to the upstream toner transport guide members 136, the downstream toner transport guide members 137 intervene between the counter wiring substrate 135 supported on the casing top cover 131*a* (developing-section counter plate 131*a*1), and the opposite end portions, with respect to the main scanning direction, of the toner electric field transport body 132 (toner transport surface 133*d*) in a state of being elastically deformed under a predetermined pressure. That is, similar to the upstream toner transport guide members 136, the downstream toner transport guide members 137 are configured to be able to restrain deposition of the toner T on their top surfaces.

The pair of downstream toner transport guide members 137 is configured and disposed so as to define a downstream toner transport area with respect to the paper width direction (the main scanning direction). The downstream toner transport area is an area on the toner transport surface 133*d* in which the toner T is effectively transported along the toner transport direction TTD and is located downstream of the developing position DP with respect to the toner transport direction TTD. A downstream toner transport area width Wt2 shown in FIG. 26 is a distance between the inner ends of the paired downstream toner transport guide members 137 along the paper width direction (the main scanning direction).

Referring to FIG. 26, the upstream toner transport guide members 136 and the downstream toner transport guide members 137 are configured and disposed such that the downstream toner transport area width Wt2 is wider than the upstream toner transport area width Wt1.

The pair of upstream toner transport guide members 136 is disposed such that the upstream toner transport area width Wt1 is narrower than the photoconductor-drum outline width Wp1 and is wider than the photoconductor-drum effective width Wp2. Similarly, the pair of downstream toner transport guide members 137 is disposed such that the downstream toner transport area width Wt2 is narrower than the photoconductor-drum outline width Wp1 and is wider than the photoconductor-drum effective width Wp2.

The photoconductor-drum outline width Wp1 is the width of the outline of the photoconductor drum 121 as measured along the main scanning direction. The photoconductor-drum effective width Wp2 is the width of an area of the photoconductor drum 121 in which an electrostatic latent image can be formed (the width of the photoconductor layer 121*b* shown in FIG. 25 as measured along the main scanning direction).

Referring to FIG. 26, the developing opening portion 131*a*2 has a generally rectangular shape as viewed in plane. The developing opening portion 131*a*2 has projecting portions which project outwardly from opposite ends thereof with respect to the paper width direction at substantially central positions with respect to the sub-scanning direction. The projecting portions are provided in such a manner as to correspond gaps between the downstream ends, with respect to the toner transport direction TTD, of the upstream toner transport guide members 136 and the upstream ends, with respect to the toner transport direction TTD, of the downstream toner transport guide members 137. Spacer members 138 are provided at positions corresponding to the projecting portions of the developing opening portion 131*a*2 which project from the opposite ends with respect to the paper width direction.

Referring to FIGS. 25 and 26, the spacer members 138 are provided in such a manner as to intervene between the photoconductor drum 121 and the toner electric field transport body 132. The spacer members 138 are configured and disposed so as to be able to determine the distance between the image carrying surface 121*b*1 and the toner transport surface 133*d* at the developing position DP.

Specifically, the spacer members 138 of the present embodiment are block-like members. Top end portions of the spacer members 138 which face the image carrying surface 121*b*1 are formed of a fluorine-containing resin having a low friction coefficient (polytetrafluoroethylene [trade name TEFLON (registered trademark)] or the like). Bottom end portions of the spacer members 138 are fixed on the toner transport surface 133*d*.

The spacer members 138 are disposed in such a manner as to face portions of the photoconductor drum 121 which are located outwardly of the image carrying surface 121*b* with respect to the main scanning direction. That is, the spacer members 138 face portions of the photoconductor drum 121 which are located outwardly of the image carrying surface 121*b* with respect to the main scanning direction and at which the drum body 121*a* is exposed.

<Outline of Image Forming Operation of Laser Printer>

The outline of an image forming operation of the laser printer 100 having the above-described configuration will next be described with reference to the drawings. As for the following description of operation, an associated description appearing in the above description of the first embodiment can be cited as appropriate.

<<<Transport of Charged Toner>>>

Referring to FIG. 25, predetermined voltages (similar to those shown in FIG. 4) are applied to the counter wiring substrate 135, thereby forming predetermined traveling-wave electric fields on the counter wiring substrate 135. By means of the electric fields, the toner T which resides on the bottom of the inner space of the developing casing 131 is transported rearward (leftward in FIG. 25) on the counter wiring substrate 135 supported on the casing bottom plate 131*b*. The toner T is transported to the rear end of the inner space of the developing casing 131; more specifically, to a position where the counter wiring substrate 135 and a rear end portion of the transport wiring substrate 133 face each other.

The toner T residing between the transport wiring substrate 133 and the counter wiring substrate 135 is transported toward the developing position DP while being guided by the upstream toner transport guide members 136, by the effect of traveling-wave electric fields generated on the transport wiring substrate 133 (the toner transport surface 133*d*) and on the counter wiring substrate 135.

Referring to FIGS. 3, 25, and 26, as described above, traveling-wave transport voltages (see FIG. 4) are applied to the plurality of transport electrodes 133*a* and to the plurality of counter electrodes 135*a*, thereby forming traveling-wave electric fields on the toner transport surfaces 133*d* and 135*d*. Thus, the toner T is transported toward the developing position DP along the toner transport direction TTD while being guided within the upstream toner transport areas (within the upstream toner transport area width Wt1 in FIG. 26) of the toner transport surfaces 133*d* and 135*d* by the pair of upstream toner transport guide members 136.

As mentioned above, the toner T which has been transported to the developing position DP moves past the developing position DP and further downstream along the toner transport direction TTD. Then, the toner T moves further downstream along the toner transport direction TTD while being guided within the downstream toner transport areas (within the downstream toner transport area width Wt2 in FIG. 26) of the toner transport surfaces 133*d* and 135*d*. Subsequently, the toner T returns to a bottom portion of the developing casing 131.

<Actions and Effects of Embodied Configuration>

According to the configuration of the present embodiment, the distance between the paired downstream toner transport guide members 137 along the main scanning direction is greater than that between the paired upstream toner transport guide members 136 along the main scanning direction.

That is, according to the above configuration, the width of the downstream toner transport area is wider than the upstream toner transport area. Thus, the toner T which has been transported to the developing position DP while being guided within the upstream toner transport area by the pair of upstream toner transport guide members 136 passes the developing position DP and is then guided smoothly into the downstream toner transport area, which is wider than the upstream toner transport area.

The above configuration can effectively restrain the stagnation of the toner T when the toner T passes the developing position DP and is to be guided into the downstream toner transport area. Also, the configuration can effectively restrain leakage of the toner T from the developing opening portion 131*a*2 to the exterior of the developing casing 131 in the vicinity of opposite end portions of the photoconductor drum 121.

Thus, the configuration of the present embodiment enables smooth transport of the charged toner T on the toner transport surface 133*d* by means of a simple apparatus configuration. Therefore, the stagnation of the toner T on the toner transport surface 133*d* can be restrained to the greatest possible extent by means of a simple apparatus configuration.

According to the configuration of the present embodiment, the width of the image carrying surface 121*b*1 (photoconductor-drum effective width Wp2) along the main scanning direction is wider than the distance between the paired upstream toner transport guide member 136 (upstream toner transport area width Wt1) along the main scanning direction.

According to the above configuration, the toner T is not transported on end portions, with respect to the main scanning direction, of the photoconductor drum 121 which do not contribute to formation of an image and at which the drum body 121*a* is exposed. Thus, adhesion of the toner T to the end portions of the photoconductor drum 121 is effectively restrained. Therefore, the configuration can effectively restrain the occurrence of smudge on the end portions of the photoconductor drum 121 and leakage of the toner T form the vicinity of the end portions to the exterior of the developing device 130.

According to the configuration of the present embodiment, the distance between the paired downstream toner transport guide members 137 along the main scanning direction (downstream toner transport area width Wt2) is wider than the width of the image carrying surface 121*b*1 (photoconductor-drum effective width Wp2) along the main scanning direction.

By virtue of the above configuration, when the toner T moves from the developing position DP to the downstream toner transport area, the toner T which attempts to scatter from end portions, with respect to the main scanning direction, of the image carrying surface 121*b*1 to the outside, with respect to the main scanning direction, of the image carrying surface 121*b*1 can be reliably guided into the downstream toner transport area, which lies between the paired downstream toner transport guide members 137. Therefore, the configuration can effectively restrain leakage of the toner T to the exterior of the developing device 130 in the vicinity of the end portions, with respect to the main scanning direction, of the photoconductor drum 121.

In the present embodiment, the spacer members 138 are disposed in such a manner as to face portions of the photoconductor drum 121 which are located outwardly of the image carrying surface 121*b*1 with respect to the main scanning direction (the above-mentioned portions at which the drum body 121*a* is exposed).

The above configuration can effectively restrain a problem in that, when the image carrying surface 121*b*1 on which the electrostatic latent image LI (see FIG. 3) is formed moves along the sub-scanning direction, the spacer members 138 scratch or wear the image carrying surface 121*b*1.

According to the present embodiment, the top surfaces of the upstream toner transport guide members 136 and those of the downstream toner transport guide members 137 (FIG. 27 shows only the top surface 136*b*) touch the developing casing 131, whereby deposition of the toner T on the top surfaces can be restrained.

The above configuration can restrain the stagnation of the toner T on the top surfaces of the upstream toner transport guide members 136 and on those of the downstream toner transport guide members 137 to the greatest possible extent.

According to the present embodiment, the counter wiring substrate 135 having the plurality of counter electrodes 135*a* is provided. The upstream toner transport guide members 136 and the downstream toner transport guide members 137 intervene between the toner transport surface 133*d* and the counter electrodes 135*a*.

By virtue of the above configuration, by means of applying predetermined traveling-wave voltages to the plurality of transport electrodes 133*a* and to the plurality of counter electrodes 135*a*, the charged toner T can be transported more smoothly in a space between the toner transport surface 133*d* and the toner transport surface 135*d* while being guided by the upstream toner transport guide members 136 and the downstream toner transport guide members 137.

According to the present embodiment, the upstream toner transport guide members 136 and the downstream toner transport guide members 137 are of an elastic material. The upstream toner transport guide members 136 and the downstream toner transport guide members 137, which are of an elastic material, intervene between the developing casing 131 and opposite end portions, with respect to the main scanning direction, of the toner electric field transport body 132, in a compressed state.

The above configuration can more reliably guide transport of the toner T within the upstream toner transport area and within the downstream toner transport area. That is, the areal range of transport of the toner T can be effectively defined.

Also, the stagnation of the toner T on the top surfaces of the upstream toner transport guide members 136 and on the top surfaces of the downstream toner transport guide members 137 can be more effectively restrained.

Therefore, the above configuration can more effectively restrain the stagnation of the toner T in the toner path.

<Modifications>

In addition to general modifications, such as modification (1) of the first embodiment, the present embodiment can be modified as follows.

(1) The entire top surface 136*b* of each of the upstream toner transport guide members 136 does not necessarily touch the counter wiring substrate 135. In this case, each of the toner transport guide members 136 is formed to have such a sectional shape as to restrain deposition of the toner T in the process of transport on the top surface 136*b* of the upstream toner transport guide member 136.

Typical modifications of the upstream toner transport guide members 136 will next be described. The downstream toner transport guide member 137 can also be modified similarly.

Figure 28:
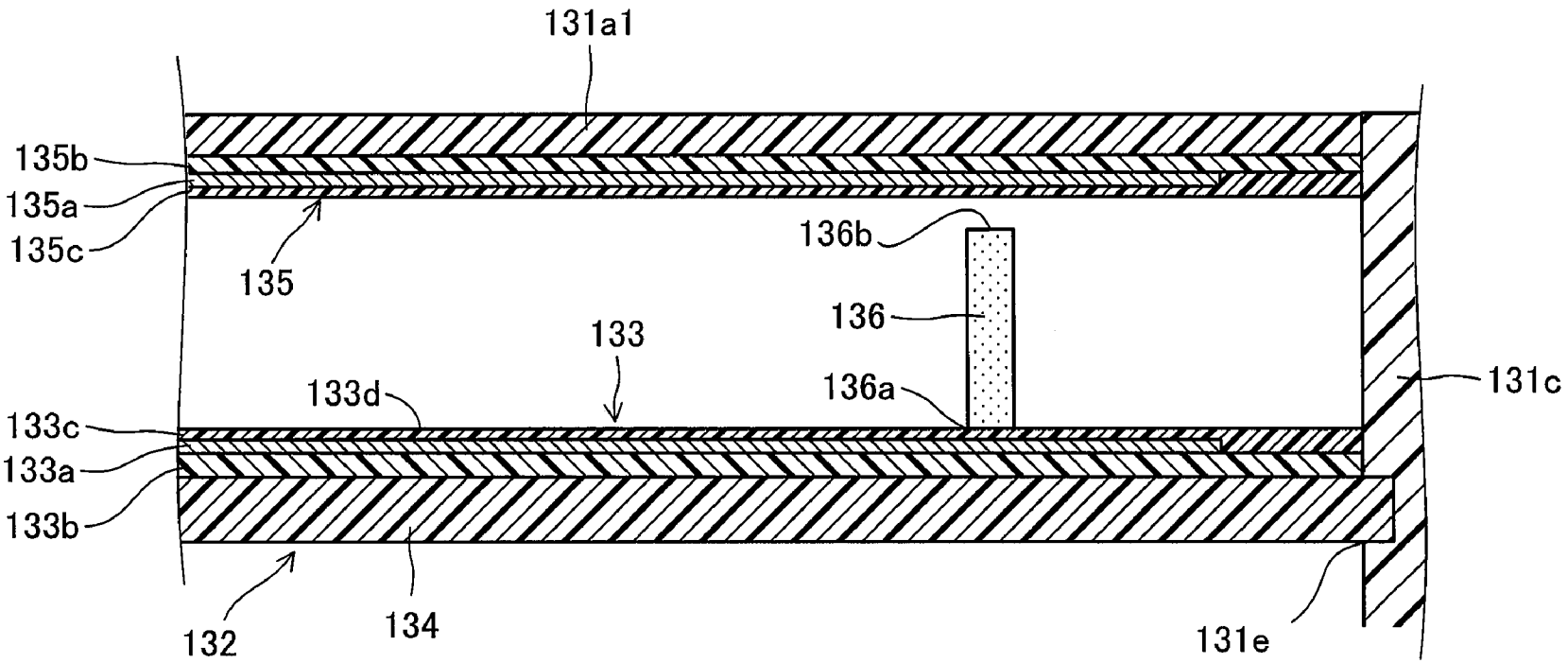
FIG. 28 is a sectional view showing the configuration of a modification of the toner transport guide member shown in FIG. 27.

FIG. 28 is a sectional view showing the configuration of a modification of the upstream toner transport guide member 136 shown in FIG. 27. Referring to FIG. 28, in the present modification, the top surface 136*b* of the upstream toner transport guide member 136, and the counter wiring substrate 135 are separated from each other.

Referring to FIG. 3, the height of the top surface 136*b* is determined so as to be sufficiently higher than the maximum hopping height along the height direction (y-axis direction in FIG. 3) of the toner T (e.g., three times or more the maximum hopping height) in a region other than the vicinity of the developing position DP, the toner T being transported in a hopping fashion on the toner transport surface 133*d* through application of the aforementioned traveling-wave transport voltages to the plurality of transport electrodes 133*a*. In the vicinity of the developing position DP, the toner T hops through the developing opening portion 131*a*2 at such a height as to reach the image carrying surface 121*b*1.

Figure 29:
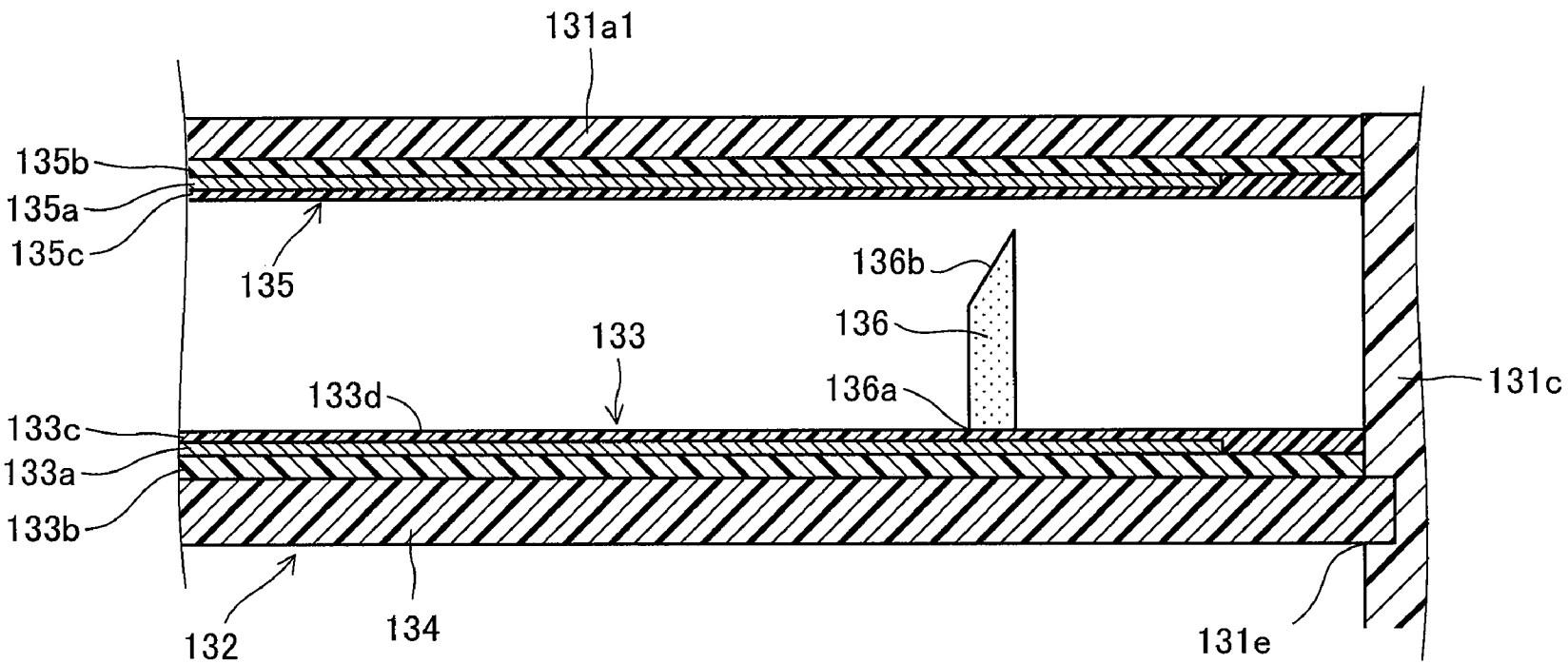
FIG. 29 is a sectional view showing the configuration of another modification of the toner transport guide member shown in FIG. 27.
Figure 30:
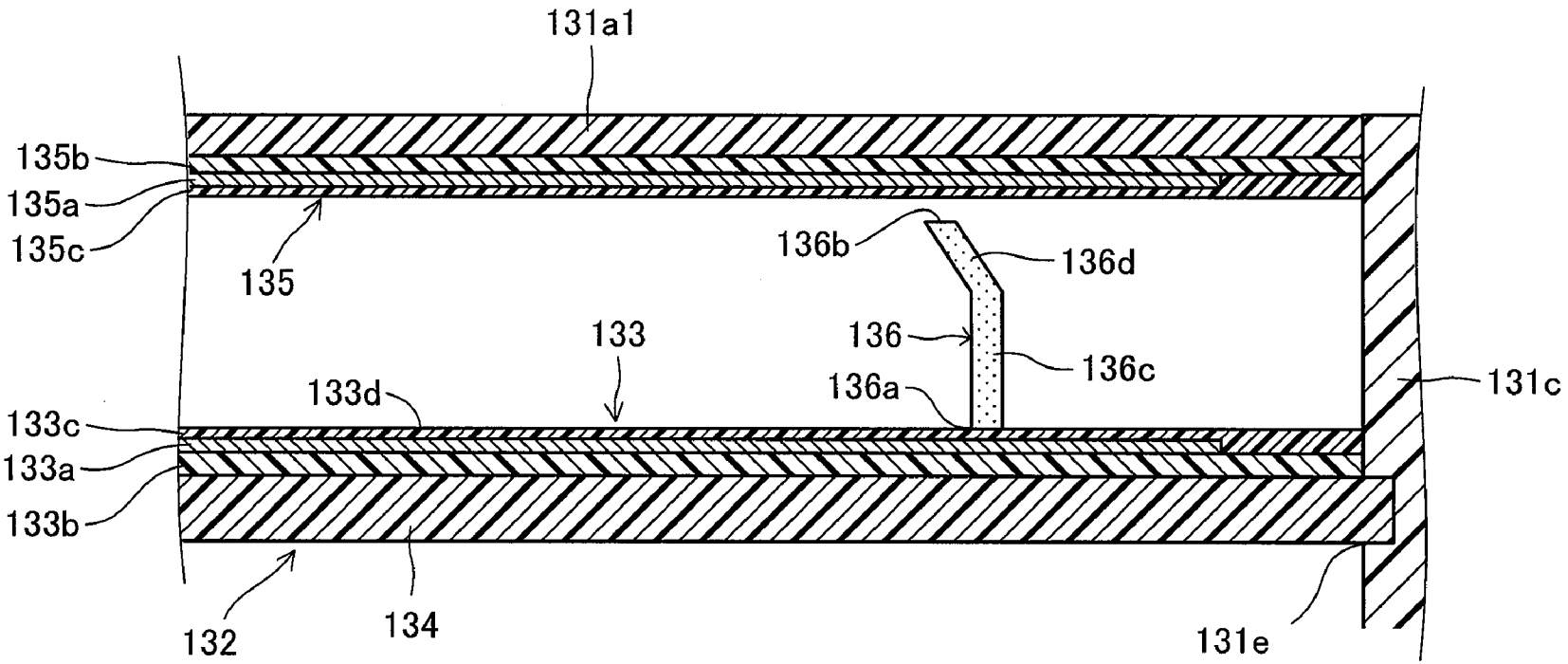
FIG. 30 is a sectional view showing the configuration of still another modification of the toner transport guide member shown in FIG. 27.

FIGS. 29 and 30 are sectional views showing the configurations of other modifications of the upstream toner transport guide member 136 shown in FIG. 27.

Referring to FIG. 29, the top surface 136*b* of the upstream toner transport guide member 136 may slope downwardly and inwardly with respect to the paper width direction. That is, in the present modification, the top surface 136*b* slopes such that the toner T thereon slips down toward an intermediate portion of the toner transport surface 133*d*. Preferably, the height of the bottom end portion of the slope is determined so as to be sufficiently higher than the maximum hopping height along the height direction (y-axis direction in FIG. 3) of the toner T (e.g., three times or more the maximum hopping height).

Referring to FIG. 30, in the present modification, the upstream tonner transport guide member 136 has an eave. That is, the upstream toner transport guide member 136 includes the base portion 136*c* and the overhang portion 136*d*.

The base portion 136*c* is fixed on the toner transport surface 133*d* and projects upright toward the counter wiring substrate 135. The overhang portion 136*d* extends obliquely upward from the top end of the base portion 136*c* in such a manner as to overhang toward the toner transport area. Further, Even these configurations of the modifications can effectively define the areal range of transport of the toner T and can effectively restrain deposition of the toner T on the top surfaces 136*b* of the upstream toner transport guide members 136.

(2) The width of the toner transport area of the toner transport surface 133*d* and that of the toner transport area of the toner transport surface 135*d* may be substantially the same as shown in FIGS. 27 and 28 or may differ from each other as shown in FIGS. 29 and 30.

(3) In the case where, as in the case of the above-described embodiment, the counter wiring substrate 135 is also provided on the casing bottom plate 131*b*, the upstream toner transport guide members 136 can be provided in such a manner as to correspond to the casing bottom plate 131*b*. That is, each of the upstream toner transport guide members 136 can be formed in such a manner as to have a cross-sectional shape resembling the letter J so as to correspond to the casing top cover 131*a* and the casing bottom plate 131*b* which are formed integrally with each other in such a manner as to have a cross-sectional shape resembling the letter U.

(4) Each of the spacer members 138 may assume the form of a roller so as to be rollable.

(5) The upstream toner transport guide members 136 and the downstream toner transport guide members 137 may be spaced apart from each other along the toner transport direction TTD as shown in FIG. 26 or may be in contact with each other. Alternatively, each of the upstream toner transport guide members 136 and each of the downstream toner transport guide members 137 may be formed integrally with each other.

What is claimed is:

1. An image forming apparatus comprising:

a developer-carrying body having a developer-carrying surface formed in parallel with a predetermined main scanning direction and configured to carry a developer thereon, and configured such that the developer-carrying surface is allowed to move along a sub-scanning direction orthogonal to the main scanning direction; and a developer feed device disposed to face the developer-carrying body and configured to feed the developer in a charged state to the developer-carrying surface;

wherein the developer feed device comprises:

a plurality of transport electrodes configured to have their longitudinal direction intersecting with the sub-scanning direction and arrayed in a predetermined developer transport direction along the sub-scanning direction;

an electricity supply wiring section connected to root portions of the transport electrodes, the root portions being one end portions of the transport electrodes with respect to the longitudinal direction;

a developer transport body having a developer transport surface parallel to the main scanning direction, configured such that the transport electrodes and the electricity supply wiring section are provided along the developer transport surface and such that the developer transport surface faces the developer-carrying body, and configured to transport the developer along the developer transport direction by traveling-wave electric fields which are generated on the developer transport surface through application of predetermined transport voltages to the plurality of transport electrodes; and a pair of developer transport guide members provided on the developer transport surface at opposite end portions, with respect to a width direction perpendicular to the developer transport direction, of the developer transport body, and configured to define an areal range within which the developer is transported on the developer transport surface along the developer transport direction, wherein each of the paired developer transport guide members is provided to cover the electricity supply wiring section and the root portions and distal end portions of the transport electrodes, the distal end portions being end portions of the transport electrodes opposite the root portions.

2. The image forming apparatus according to claim 1, wherein the developer transport guide members are provided such that a range over which the root portions and the distal end portions of the transport electrodes are covered with each of the developer transport guide members is equal to or greater than a width of each of the transport electrodes as measured orthogonally to the longitudinal direction.

3. The image forming apparatus according to claim 1, further comprising a plurality of counter electrodes configured to have their longitudinal direction intersecting with the sub-scanning direction, disposed to face the developer transport surface with a predetermined gap therebetween, and arrayed along the developer transport direction, wherein the developer transport guide members intervene between the developer transport surface and the counter electrodes.

4. The image forming apparatus according to claim 1, wherein the developer transport guide members are configured to restrain deposition of the developer on their top surfaces opposite their surfaces which face the developer transport surface.

5. The image forming apparatus according to claim 1, further comprising:

a developer containing casing which is a box-like member configured to cover the developer transport body and to contain the developer therein and which has an opening portion formed at a position where the developer-carrying body and the developer transport surface face each other; and a pair of seal members provided at opposite end portions, with respect to the width direction, of the developer containing casing and configured to restrain leakage of the developer to the exterior of the developer containing casing, wherein the seal members serve as the developer transport guide members.

6. The image forming apparatus according to claim 5, wherein the seal members are formed of an elastic material.

7. An image forming apparatus comprising:

a developer-carrying body having a developer-carrying surface formed in parallel with a predetermined main scanning direction and configured to carry a developer thereon, and configured such that the developer-carrying surface is allowed move along a sub-scanning direction orthogonal to the main scanning direction; and a developer feed device disposed to face the developer-carrying body and configured to feed the developer in a charged state to the developer-carrying surface;

wherein the developer feed device comprises:

a plurality of transport electrodes configured to have their longitudinal direction intersecting with the sub-scanning direction and arrayed in a predetermined developer transport direction along the sub-scanning direction;

an electricity supply wiring section connected to root portions of the transport electrodes, the root portions being one end portions of the transport electrodes with respect to the longitudinal direction;

a developer transport body having a developer transport surface parallel to the main scanning direction, configured such that the transport electrodes and the electricity supply wiring section are provided along the developer transport surface and such that the developer transport surface faces the developer-carrying body, and configured to transport the developer along the developer transport direction by traveling-wave electric fields which are generated on the developer transport surface through application of predetermined transport voltages to the plurality of transport electrodes;

a pair of developer transport guide members provided on the developer transport surface at opposite end portions, with respect to a width direction perpendicular to the developer transport direction, of the developer transport body, and configured to define an areal range within which the developer is transported on the developer transport surface along the developer transport direction; and a developer containing casing which is a box-like member configured to cover the developer transport body and the developer transport guide members and to contain the developer therein and which has an opening portion formed at a position where the developer-carrying body and the developer transport surface face each other, wherein the developer transport guide members are configured and disposed so as to be able to restrain outward leakage of the developer beyond the developer transport guide members with respect to the width direction by means of projecting toward a surface of the developer containing casing in which the opening portion is formed, at positions located inwardly, with respect to the width direction, of the root portions and distal end portions of the transport electrodes, the distal end portions being end portions of the transport electrodes opposite the root portions, wherein the developer transport guide members are configured to be able to restrain deposition of the developer on their top surfaces opposite their surfaces which face the developer transport surface, and wherein the developer transport guide members are configured such that their top surfaces opposite their surfaces which face the developer transport surface touch the developer containing casing.

8. The image forming apparatus according to claim 7, further comprising a plurality of counter electrodes configured to have their longitudinal direction intersecting with the sub-scanning direction, disposed to face the developer transport surface with a predetermined gap therebetween, and arrayed along the developer transport direction, wherein the developer transport guide members intervene between the developer transport surface and the counter electrodes.

9. The image forming apparatus according to claim 7, wherein the developer transport guide members are formed of an elastic material.

10. An image forming apparatus comprising:

a developer-carrying body having a developer-carrying surface formed in parallel with a predetermined main scanning direction and configured to carry a developer thereon, and configured such that the developer-carrying surface is allowed move along a sub-scanning direction orthogonal to the main scanning direction; and a developer feed device disposed to face the developer-carrying body and configured to feed the developer in a charged state to the developer-carrying surface;

wherein the developer feed device comprises:

a plurality of transport electrodes configured to have their longitudinal direction intersecting with the sub-scanning direction and arrayed in a predetermined developer transport direction along the sub-scanning direction;

a developer transport body having a developer transport surface parallel to the main scanning direction, configured such that the transport electrodes are provided along the developer transport surface and such that the developer transport surface faces the developer-carrying body, and configured to transport the developer along the developer transport direction by traveling-wave electric fields which are generated on the developer transport surface through application of predetermined transport voltages to the plurality of transport electrodes;

a pair of first developer transport guide members provided on the developer transport surface at opposite end portions, with respect to a width direction perpendicular to the developer transport direction, of the developer transport body, and upstream, with respect to the developer transport direction, of a developing position where the developer-carrying body and the developer transport body face in the closest proximity to each other; and a pair of second developer transport guide members provided on the developer transport surface at opposite end portions, with respect to the width direction, of the developer transport body, and downstream of the developing position with respect to the developer transport direction, wherein the first and second developer transport guide members are configured and disposed to define an areal range on the developer transport surface within which the developer is transported along the developer transport direction, by means of restraining outward leakage of the developer beyond the first and second developer transport guide members with respect to the width direction; and the first and second developer transport guide members are configured and disposed such that a distance between the paired second developer transport guide members along the main scanning direction is greater than a distance between the paired first developer transport guide members along the main scanning direction.

11. The image forming apparatus according to claim 10, wherein a width of the developer-carrying surface along the main scanning direction is equal to or greater than the distance between the paired first developer transport guide members along the main scanning direction.

12. The image forming apparatus according to claim 10, wherein the distance between the paired second developer transport guide members along the main scanning direction is greater than the width of the developer-carrying surface along the main scanning direction.

13. The image forming apparatus according to claim 10, further comprising spacer members provided to intervene between the developer-carrying body and the developer transport body, and configured to determine the distance between the developer-carrying surface and the developer transport surface at the developing position, wherein the spacer members are disposed to face portions of the developer-carrying body which are located outwardly of the developer-carrying surface with respect to the main scanning direction.

14. The image forming apparatus according to claim 10, wherein the first and second developer transport guide members are configured to restrain deposition of the developer on their top surfaces opposite their surfaces which face the developer transport surface.

15. The image forming apparatus according to claim 10, further comprising a plurality of counter electrodes configured to have their longitudinal direction intersecting with the sub-scanning direction, disposed to face the developer transport surface with a predetermined gap therebetween, and arrayed along the developer transport direction, wherein the first and second developer transport guide members intervene between the developer transport surface and the counter electrodes.

16. The image forming apparatus according to claim 10, further comprising a developer containing casing which is a box-like member configured to cover the developer transport body and the first and second developer transport guide members and to contain the developer therein and which has an opening portion formed at a position where the developer-carrying body and the developer transport surface face each other, wherein the first and second developer transport guide members are configured such that their top surfaces opposite their surfaces which face the developer transport surface touch the developer containing casing.

17. The image forming apparatus according to claim 16, wherein the first and second developer transport guide members are formed of an elastic material.

18. An image forming apparatus comprising:

a developer-carrying body having a developer-carrying surface formed in parallel with a predetermined main scanning direction and configured to carry a developer thereon, and configured such that the developer-carrying surface is allowed to move along a sub-scanning direction orthogonal to the main scanning direction; and a developer feed device disposed to face the developer-carrying body and configured to feed a developer in a charged state to the developer-carrying surface;

wherein the developer feed device comprises:

a plurality of transport electrodes configured to have their longitudinal direction intersecting with the sub-scanning direction and arrayed in a predetermined developer transport direction along the sub-scanning direction;

a developer transport body having a developer transport surface parallel to the main scanning direction, configured such that the transport electrodes are provided along the developer transport surface and such that the developer transport surface faces the developer-carrying body, and configured to transport the developer along the developer transport direction by traveling-wave electric fields which are generated on the developer transport surface through application of predetermined transport voltages to the plurality of transport electrodes;

a pair of first developer transport guide members provided on the developer transport surface at opposite end portions, with respect to a width direction perpendicular to the developer transport direction, of the developer transport body, and upstream, with respect to the developer transport direction, of a developing position where the developer-carrying body and the developer transport body face in the closest proximity to each other;

a pair of second developer transport guide members provided on the developer transport surface at opposite end portions, with respect to the width direction, of the developer transport body, and downstream of the developing position with respect to the developer transport direction; and a spacer member provided in such a manner as to intervene between the developer-carrying body and the developer transport body, and configured to determine the distance between the developer-carrying surface and the developer transport surface at the developing position, wherein the spacer member is disposed to face portions of the developer-carrying body which are located outwardly of the developer-carrying surface with respect to the main scanning direction, wherein the first and second developer transport guide members are configured and disposed such that a distance between the paired second developer transport guide members along the main scanning direction is greater than a distance between the paired first developer transport guide members along the main scanning direction.

* * * * *